US006296672B1

(12) United States Patent
Barfoed et al.

(10) Patent No.: US 6,296,672 B1
(45) **Date of Patent: *Oct. 2, 2001**

(54) ENZYMATIC METHOD FOR TEXTILE DYEING

(75) Inventors: Martin Barfoed, Espergaerde; Ole Kirk, Virum, both of (DK); Sonja Salmon, Raleigh, NC (US)

(73) Assignees: Novozymes A/S Patents, Bagsvaerd (DK); Novozymes North America, Franklinton, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/461,441

(22) Filed: Dec. 14, 1999

Related U.S. Application Data

(63) Continuation-in-part of application No. 08/770,760, filed on Dec. 19, 1996, now Pat. No. 6,036,729.

(60) Provisional application No. 60/016,729, filed on May 2, 1996, and provisional application No. 60/009,198, filed on Dec. 22, 1995.

(51) Int. Cl.[7] ..... D06P 1/32; D06M 16/00

(52) U.S. Cl. ..... 8/401; 8/405; 8/406; 8/416; 8/421; 8/423; 8/436; 8/916; 8/917; 8/552; 8/649; 8/918; 8/920; 8/922; 8/924; 435/263

(58) Field of Search ..... 8/401, 405, 406, 8/416, 421, 423, 436, 916, 917, 552, 649, 918, 920, 922, 924; 435/263

(56) References Cited

U.S. PATENT DOCUMENTS

| | | | | |
|---|---|---|---|---|
| 5,667,531 | * | 9/1997 | Yaver et al. | 8/401 |
| 5,849,041 | | 12/1998 | Kunz et al. | 8/401 |
| 5,925,148 | * | 7/1999 | Barfoed et al. | 8/401 |
| 5,972,042 | * | 10/1999 | Barfoed et al. | 8/401 |
| 6,001,134 | * | 12/1999 | Sorensen | 8/401 |
| 6,036,729 | * | 3/2000 | Barfoed et al. | 8/401 |

FOREIGN PATENT DOCUMENTS

| | | | |
|---|---|---|---|
| 0 431 682 | | 6/1991 | (EP) . |
| 504005 | * | 9/1992 | (EP) . |
| 2112549 | | 6/1972 | (FR) . |
| WO 92/18683 | | 10/1992 | (WO) . |
| WO 94/00100 | | 1/1994 | (WO) . |
| WO 95/33836 | | 12/1995 | (WO) . |

OTHER PUBLICATIONS

Derwent Publication Ltd., 90–161489 (Apr. 17, 1990).
Derwent Publication Ltd., 91–143144 (Apr. 3, 1991).
Derwent Publication Ltd., 95–033019 (Nov. 15, 1994).
Derwent Publication Ltd., 96–295885 (May 21, 1996).

* cited by examiner

*Primary Examiner*—Alan Diamond
(74) *Attorney, Agent, or Firm*—Elias J. Lambiris, Esq.

(57) ABSTRACT

The present invention relates to methods of dyeing a material which involve contacting the material with a dyeing system which comprises: (a) a mixture of (i) an aromatic diamine and (ii) one or more of a naphthol and an aminonaphthalene and (b) an oxidation system comprising (i) a hydrogen peroxide source and an enzyme exhibiting peroxidase activity or (ii) an enzyme exibiting oxidase activity on one or more of the compounds of mixture (a). The material may be a fabric, yarn, fiber, garment or film made of fur, hide, leather, silk or wool, or made of cationic polysaccharide, cotton, diacetate, flax, linen, lyocel, polyacrylic, synthetic polyamide, polyester, ramie, rayon, triacetate, or viscose.

30 Claims, No Drawings

ENZYMATIC METHOD FOR TEXTILE DYEING

CROSS-REFERENCE TO RELATED APPLICATIONS

This application is a continuation-in-part of application Ser. No. 08/770,760, filed Dec. 19, 1996, now U.S. Pat. No. 6,036,729, which claims priority under 35 U.S.C. 119 of U.S. Provisional Applications Nos. 60/016,729 filed May 2, 1996, and 60/009,198 filed Dec. 22, 1995, which are incorporated herein by reference.

FIELD OF THE INVENTION

The present invention relates to methods of dyeing a material, comprising contacting the material with dye intermediates in combination with an enzymatic oxidation system.

BACKGROUND OF THE INVENTION

Dyeing of textiles is often considered to be the most important and expensive single step in the manufacturing of textile fabrics and garments. In the textile industry, two major types of processes, batch and continuous, are currently used for dyeing. In the batch process, among others, jets, drums, and vat dyers are used. In continuous processes, among others, padding systems are used. See, e.g., I. D. Rattee, In C. M. Carr (Ed.), "The Chemistry of the Textiles Industry," Blackie Academic and Professional, Glasgow, 1995, p. 276.

The major classes of dyes are azo (mono-, di-, tri-, etc.), carbonyl (anthraquinone and indigo derivatives), cyanine, di- and triphenylmethane and phthalocyanine. All these dyes contain chromophoric groups which give rise to color. Two classes of dyes, vat and sulfur dyes, are applied to materials by an oxidation/reduction mechansim. The purpose of the oxidation/reduction step is to change the vat or sulfur dyestuff between an insoluble and a soluble form.

The dominant chemical class of dyestuffs is azo dyes. Most commonly, azo dyestuffs are manufactured as the dye, then applied to a material to color the material. In a variation of this technology, known as azoic dyeing, coupling between the strongly electrophilic diazonium ion and a nucleophilic compound leads to formation of colored azo compounds in situ on the material. The mechanism and process for azoic dyeing are described, for example, in *Colorants and Auxiliaries, Volume* 1—*Colorants*, Society of Dyers and Colourists, West Yorkshire, England, 1990 and *Cellulosics Dyeing*, Society of Dyers and Colourists, West Yorkshire, England, 1995.

Oxidoreductases, e.g., oxidases and peroxidases, are well known in the art.

One class of oxidoreductases is laccases (benzenediol:oxygen oxidoreductases) which are multicopper containing enzymes that catalyze the oxidation of phenols and related compounds. Laccase-mediated oxidation results in the production of aromatic radical intermediates from suitable substrates; the ultimate coupling of the intermediates so produced provides a combination of dimeric, oligomeric, and polymeric reaction products. Such reactions are important in nature in biosynthetic pathways which lead to the formation of melanin, alkaloids, toxins, lignins, and humic acids.

Another class of oxidoreductases are peroxidases, which oxidize compounds in the presence of hydrogen peroxide.

Laccases have been found to be useful for hair dyeing. See, e.g., PCT applications Serial No. PCT/US95/06815 and PCT/US95/06816. European Patent No. 0504005 discloses that laccases can be used for dyeing wool at a pH in the range of between 6.5 and 8.0.

Saunders et al., *Peroxidase*, London, 1964, p. 10 ff. discloses that peroxidases act on various amino and phenolic compounds resulting in the production of a color.

Kunz et al., U.S. Pat. No. 5,849,041, discloses a hair dyeing composition containing a combination of aromatic diamine, e.g. 1,4-phenylenediamine (developer), α-naphthol (coupler), an oxygen-oxido-reductase/substrate system and a peroxidase. Kunz further teaches that the preferred coupler substance comprises a substituted m-phenylenediamine.

French Patent 2,112,549 discloses dyeing hair with an aqueous solution containing oxidase enzyme and aromatic compounds, such as aromatic diamines, phenols, and derivatives of these, that are precursors for oxidative color. Sulfonated and carboxylated aromatic diamines and phenols are disclosed. The use of laccase is disclosed.

Roure et al., European Patent 504,005, discloses that 1-naphthol (α-naphthol), 1,5-dihydroxynaphthalene, 2,7-dihydroxynaphthalene are known oxidative couplers for hair dyeing that can be used in combination with aromatic diamines, such as 1,4-phenylenediamine and N-phenyl-1,4-phenylenediamine, and with laccase enzyme.

Peck, U.S. Pat. No. 2,539,202 discloses a method of dyeing animal fibers, such as fur, animal pelts, and the like, comprising the steps of applying to the animal fibers an aqueous solution of a tyrosine or dioxyphenylalanine propigment followed by applying an oxidase, such as tyrosinase or polyphenolase.

Soloway, U.S. Pat. No. 3,251,742 discloses a method for coloring hair using a polyhydric aromatic compound, aromatic amine, and an oxidation enzyme.

Yaver et al., U.S. Pat. No. 5,667,531 discloses a dye composition for dyeing hair, wherein the composition contains a laccase and a dye precursor and optional coupler of the types disclosed by Soloway (e.g., phenylenediamine and aminophenol).

Japanese Patent Application publication no. 6-316874 discloses a method for dyeing cotton comprising treating the cotton with an oxygen-containing medium, wherein an oxidation reduction enzyme selected from ascorbate oxidase, bilirubin oxidase, catalase, laccase, peroxidase, and polyphenol oxidase is used to generate the oxygen.

WO 91/05839 discloses that oxidases and peroxidases are useful for inhibiting the transfer of textile dyes.

However, none of these citations suggests or discloses the use of combinations of dye intermediates in which at least one intermediate is an aromatic diamine and at least one intermediate is either a naphthol or an aminonaphthalene, in combination with an oxidizing enzyme, particularly when the naphthol is anything other than unsubstituted α(alpha)-naphthol, halogenated 1-naphthol, or unsubstituted dihydroxynapthalene, or when one or more of the dye intermediates is substituted with a sulfonic acid (or salt thereof), a carboxylic acid (or salt thereof), a sulfonamide, or a quaternary ammonium salt.

Thus, there is a need in the art for improved enzymatic methods for dyeing textile materials.

SUMMARY OF THE INVENTION

The present invention provides a method of dyeing a material, which is carried out by contacting the material with a dyeing system which comprises:

(a) a mixture of dye intermediates comprising (i) at least one aromatic diamine and (ii) at least one compound selected from a naphthol and an aminonaphthalene; and (b) an oxidation system comprising (i) a hydrogen peroxide source and an enzyme exhibiting peroxidase activity or (ii) an enzyme exhibiting oxidase activity on one or more of the compounds of mixture (a), under conditions in which a colored material is produced or the color is altered. In some embodiments, at least one of the compounds of (a)(i) or (a)(ii) is substituted with a sulfonic acid (or salt thereof), a carboxylic acid (or salt thereof), a sulfonamide, or a quaternary ammonium salt. In some embodiments, the naphthol is any naphthol other than α(alpha)-naphthol (also referred to as 1-naphthol), halogenated 1-naphthol, or unsubstituted dihydroxynaphthalene. In some embodiments, either (a) the aromatic diamine is substituted with a functional group selected from the group consisting of a sulfonic acid, a carboxylic acid, a salt of a sulfonic acid or carboxylic acid, a sulfonamide, and a quaternary ammonium salt or (b) the naphthol is not unsubstituted α(alpha)-naphthol, halogenated 1-napthol, or an unsubstituted dihydroxynaphthalene Preferably, the enzyme is a peroxidase or a laccase.

The presence of the above-cited substituent groups on at least one compound of the dye intermediate mixture improves ease of handling of the dye intermediate compounds, facilitates dyeing of the materials, and improves color performance properties, such as, e.g., by decreasing wash staining.

The materials to be dyed include, without limitation, a fabric, yarn, fiber, garment or film made of fur, hide, leather, silk, wool, cationic polysaccharide, cotton, diacetate, flax, linen, lyocel, polyacrylic, synthetic polyamide, polyester, ramie, rayon, triacetate, or viscose.

In some embodiments, the aromatic diamine is a compound of formula A, the naphthol is a compound of formula B, and the aminonaphthalene is a compound of formula C as shown below:

A

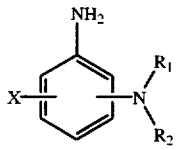

B

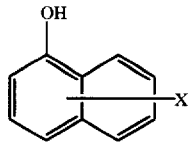

C

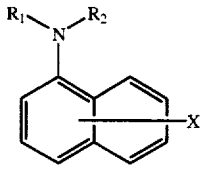

wherein X may independently be hydrogen, sulfonic acid, carboxylic acid, a salt of sulfonic acid, a salt of carboxylic acid, sulfonamide, or a quaternary ammonium salt; R1 and R2 may each independently be one of hydrogen, $C_{1-18}$-alkyl, $C_{1-18}$-hydroxyalkyl, phenyl, aryl, azobenzene, amidophenyl, azobenzene substituted with one or more functional groups, and amidophenyl substituted with one or more functional groups; and the remaining positions on the aromatic ring(s) of A, B, and C are optionally substituted with one or more functional groups, including, without limitation, hydrogen, halogen, sulfo, sulfonato, sulfamino, sulfanyl, amino, amido, amidoaryl, nitro, azo, azoaryl, imino, carboxy, cyano, formyl, hydroxy, halocarbonyl, carbamoyl, carbamidoyl, phenyl, aryl, phosphonato, phosphonyl, $C_{1-18}$-alkyl, $C_{2-18}$-alkenyl, $C_{2-18}$-alkynyl, $C_{1-18}$-alkoxy, $C_{1-18}$-oxycarbonyl, $C_{1-18}$-oxoalkyl, $C_{1-18}$-alkyl sulfanyl, $C_{1-18}$-alkyl imino, and amino which is substituted with one, two, or three $C_{1-18}$-alkyl groups. In some embodiments, the halogen may be one of fluorine, chlorine, bromine or iodine.

In other embodiments, the naphthol may be a compound of formula D

D

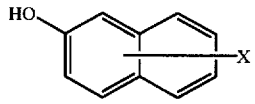

wherein X may independently be hydrogen, sulfonic acid, carboxylic acid, a salt of sulfonic acid, a salt of carboxylic acid, sulfonamide, or a quaternary ammonium salt and the remaining positions on the aromatic rings of D are one or more functional groups, including, without limitation, hydrogen, halogen, sulfo, sulfonato, sulfamino, sulfanyl, amino, amido, amidoaryl, nitro, azo, azoaryl, imino, carboxy, cyano, formyl, hydroxy, halocarbonyl, carbamoyl, carbamidoyl, phenyl, aryl, phosphonato, phosphonyl, $C_{1-18}$-alkyl, $C_{2-18}$-alkenyl, $C_{2-18}$-alkynyl, $C_{1-18}$-alkoxy, $C_{1-18}$-oxycarbonyl, $C_{1-18}$-oxoalkyl, $C_{1-18}$-alkyl sulfanyl, $C_{1-18}$-alkyl imino, and amino which is substituted with one, two, or three $C_{1-18}$-alkyl groups. In some embodiments, the halogen may be one of fluorine, chlorine, bromine or iodine.

Examples of aromatic diamines useful in practicing the present invention include, without limitation, 2-methoxy-p-phenylenediamine, N,N-bis-(2-hydroxyethyl)-p-phenylenediamine, N-β-methoxyethyl-p-phenylenediamine, 2-methyl-1,3-diamino-benzene, 2,4-diaminotoluene, 2,5-Diaminotoluene, 2,6-diaminopyridine, 1-N-methylsulfonato-4-aminobenzene, 1-methoxy-2,4-diaminobenzene, 1-ethoxy-2,3-diamino-benzene, 1-β-hydroxyethyloxy-2,4-diamino-benzene, 1,4-Phenylenediamine, 2-Chloro-1,4-phenylenediamine, 1,3-Phenylenediamine, 2,3-diaminobenzoic acid, 2,4-diaminobenzoic acid, 2,5-diaminobenzoic acid, 3,4-diaminobenzoic acid, 3,5-diaminobenzoic acid, methyl-2,3-diaminobenzoate, ethyl-2,3-diaminobenzoate, isopropyl-2,3-diaminobenzoate, methyl-2,4-diaminobenzoate, ethyl-2,4-diaminobenzoate, isopropyl-2,4-diaminobenzoate, methyl-3,4-diaminobenzoate, ethyl-3,4-diaminobenzoate, isopropyl-3,4-diaminobenzoate, methyl-3,5-diaminobenzoate, ethyl-3,5-diaminobenzoate, isopropyl-3,5-diaminobenzoate, N,N-dimethyl-3,4-diaminobenzoic acid amide, N,N-diethyl-3,4-diaminobenzoic acid amide, N,N-dipropyl-3,4-diaminobenzoic acid amide, N,N-dibutyl-3,4-diaminobenzoic acid amide, N-phenyl-p-phenylenediamine, Disperse Black 9, Solvent Brown 1 (CI 11285), 4,4'-Diaminodiphenylamine sulfate, 4-aminodiphenylamine-2-sulfonic acid, N-(4'-aminophenyl)aminobenzene-4-sulfonic acid, N,N-dimethyl-1,4-phenylenediamine, N,N-diethyl-1,4-phenylenediamine, Disperse Yellow 9, N-phenyl-1,2-phenylenediamine, 1,2-phenylenediamine, and 4'-aminoacetanilide, and N-phenyl-2-aminobenzene-4-sulfonic acid, N-(4'-aminophenyl)-aminobenzene-4-sulfonic acid, 2,3-diaminobenzenesulfonic acid, 2,4-diaminobenzenesulfonic acid 2,5-diaminobenzenesulfonic acid, 3,5-diaminobenzenesulfonic acid, and 3,4-diaminobenzenesulfonic acid.

Useful naphthols include, without limitation, 4-Chloro-1-naphthol, 4-Bromo-1-naphthol, 4-Methoxy-1-naphthol, 2-Nitroso-1-naphthol, 1-Naphthol-3-sulfonamide, and 1-Naphthol-8-sulfonamide, 4,8-Disulfonato-1-naphthol, 3-Sulfonato-6-amino-1-naphthol, 6,8-Disulfonato-2-naphthol, 4,5-Dihydroxynapthalene-2,7-disulfonic acid, 2-Amino-8-naphthol-6-sulfonic acid, 5-Amino-1-naphthol-3-sulfonic acid, 2-Naphthol-3,6-disulfonic acid, 1-Amino-8-naphthol-2,4-disulfonic acid, 1-Naphthol-4-sulfonic acid, N-Benzoyl J acid, N-Phenyl J acid, Mordant Black 3 (CI 14640), 4-Amino-5-hydroxy-2,6-naphthalene disulphonic acid, Acid Black 52 (CI 15711), Palantine Chrome Black 6BN (CI 15705), Eriochrome Blue Black R, Mordant Black 11, Eriochrome Black T, Naphthol Blue Black, Acid Black 1 (CI 20470), Acid Red 176 (CI 1657), Acid Red 29 (CI 16570), Acid Red 14 (CI 14720), and 1-Naphthol-3-sulfonic acid.

Useful aminonapthalenes include, without limitation, 1-Amino-8-hydroxynaphthalene-4-sulfonic acid, 2-Amino-8-naphthol-6-sulfonic acid, 5-Amino-1-naphthol-3-sulfonic acid, 1-Amino-8-naphthol-2,4-disulfonic acid, 8-Amino-1-naphthalenesulfonic acid, 8-Anilino-1-naphthalenesulfonic acid, 8-Amino-2-naphthalenesulfonic acid, 5-Amino-2-naphthalenesulfonic acid, 4-Amino-5-hydroxy-2,6-naphthalenedisulphonic acid, 2,3-Diaminonaphthalene, 1,5-Diaminonaphthalene, 1,8-Diaminonaphthalene, 6-Amino-2-naphthol, 3-Amino-2-naphthol, 5-Amino-1-naphthol, Acid Black 1 (CI 20470), 4-Amino-1-naphthalenesulfonic acid, 6-(p-Toluidino)-2-naphthalenesulfonic acid, 1,4-Diamino-2-naphthalenesulfonic acid, and 5,8-Diamino-2-naphthalenesulfonic acid.

In practicing the invention, the material may be contacted simultaneously with the dye intermediates, enzyme, and electron acceptor. In another embodiment, the material may be contacted with one or both of the dye intermediates, after which the second dye intermediate (where applicable), enzyme, and electron acceptor are added. In yet another embodiment, the material is first contacted with the enzyme, after which the dye intermediates and electron acceptor are added.

In preferred embodiments, the methods of the invention provide dyed materials having an activation ratio (AR) of at least 0.25, preferably at least 1, and most preferably at least 2, where AR is defined as: AR=(L* control−L* enzyme)/L* enzyme and the dye intermediates are used at an aggregate concentration of about 5% o.w.g. (of weight of goods).

In another aspect, the invention provides dyes produced using the methods described herein.

In another aspect, the invention provides dyeing kits comprising:

(a) at least one aromatic diamine;

(b) at least one of a naphthol and an aminonaphthalene; and (c) one or more of a peroxidase and a laccase.

In some embodiments, the aromatic diamine in the kit is substituted with a sulfonic acid (or salt thereof), a carboyxlic acid (or salt thereof), a sulfonamide, or a quaternary ammonium salt. In preferred embodiments, at least one of the aromatic diamine, naphthol, and aminonaphthalene is substituted with a sulfonic acid (or salt thereof), a carboyxlic acid (or salt thereof), a sulfonamide, or a quaternary ammonium salt. In some embodiments, the naphthol in the kit is any naphthol other than α(alpha)-napthol, halogenated 1-naphthol, or unsubstituted dihydroxynaphthalene. In some embodiments, either (a) the aromatic diamine is substituted with a functional group selected from the group consisting of a sulfonic acid, a carboxylic acid, a salt of a sulfonic acid or carboxylic acid, a sulfonamide, and a quaternary ammonium salt or (b) the naphthol is not unsubstituted α(alpha)-naphthol, halogenated 1-napthol, or an unsubstituted dihydroxynaphthalene. In preferred embodiments, the aromatic diamine is one of: 1,4-Phenylenediamine, N-Phenyl-p-phenylenediamine, N,N-Diethyl-1,4-phenylenediamine, 4-aminodiphenylamine-2-sulfonic acid, N-(4'-aminophenyl) aminobenzene-4-sulfonic acid, and 2-5-diaminobenzenesulfonic acid; the naphthol or aminonaphthalene is one of 1-Naphthol-4-sulfonic acid, N-Phenyl J acid, 8-amino-1-naphthalenesulfonic acid, 8-anilino-1-naphthalenesulfonic acid, 8-amino-2-naphthalenesulfonic acid, and 5-amino-2-naphthalenesulfonic acid; and the oxidation enzyme is a laccase.

DETAILED DESCRIPTION OF THE INVENTION

The use of oxidoreductases for dyeing materials has several significant advantages. For example, the dyeing system used in the process of the present invention utilizes inexpensive color precursors and couplers. Moreover, the mild conditions in the process result in less damage to the fabric.

The methods of the present invention can be used to dye materials such as fabrics, yams, fibers, garments and films. The material, without limitation, may be made of fur, hide, leather, silk or wool; synthetic polyamide, such as nylon 6.6 or nylon 6; a cationic polymer, such as a cationic polysaccharide, diacetate, or triacetate; a material containing a high percentage of cellulose, such as, e.g., cotton, flax, linen, lyocel, ramie, rayon, or viscose; or an anionic polymer, such as polyacrylic or may be polyester. The material may be coated, coextruded, or made together in an intimate mix with a cationic polymer. The material may be a blend of any of the foregoing materials.

In practicing the invention, the material to be dyed is treated sequentially or simultaneously with at least two dye intermediate compounds and at least one oxidoreductase enzyme in the presence of a suitable electron acceptor. At least one dye intermediate is an aromatic diamine and the second is at least one of a naphthol or an aminonaphthalene. In some embodiments, the diamine, naphthol, and/or aminonaphthalene may be substituted with one or more of a sulfonic acid, a carboxylic acid, a salt of a sulfonic acid or carboxylic acid, a sulfonamide, and a quaternary ammonium salt. In some embodiments, the naphthol is anything other than α(alpha)-napthol, halogenated 1-naphthol, or an unsubstituted dihydroxynaphthalene.

In one embodiment, the dye intermediates, enzyme, and electron acceptor are combined first and then contacted with the material. In another embodiment, the dye intermediates are combined first and then contacted with the material, followed by the enzyme and electron acceptor. In yet another embodiment, the material is contacted first with one dye intermediate, after which the second dye intermediate, enzyme, and electron acceptor are added, simultaneously or sequentially. In yet another embodiment, the material is contacted first with the enzyme, after which the dye intermediates and electron acceptor are added, simultaneously or sequentially.

Dye Intermediates

The dye intermediate compounds useful in practicing the present invention (which are also referred to as precursor and coupler compounds), include, without limitation, aromatic diamines of formula A, naphthols of formula B, and aminonaphthalenes of formula C as shown below:

A

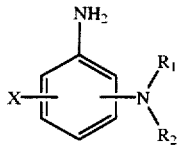

B

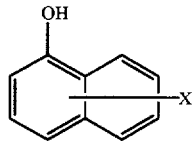

C

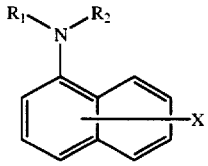

wherein X may independently be hydrogen, sulfonic acid, carboxylic acid, a salt of sulfonic acid, a salt of carboxylic acid, sulfonamide, or a quaternary ammonium salt; R1 and R2 may each independently be one of hydrogen, $C_{1-18}$-alkyl, $C_{1-18}$-hydroxyalkyl, phenyl, aryl, azobenzene, amidophenyl, azobenzene substituted with one or more functional groups, and amidophenyl substituted with one or more functional groups; and the remaining positions on the aromatic ring(s) of A, B, and C are optionally substituted with one or more functional groups, including, without limitation, hydrogen, halogen, sulfo, sulfonato, sulfamino, sulfanyl, amino, amido, amidoaryl, nitro, azo, azoaryl, imino, carboxy, cyano, formyl, hydroxy, halocarbonyl, carbamoyl, carbamidoyl, phenyl, aryl, phosphonato, phosphonyl, $C_{1-18}$-alkyl, $C_{2-18}$-alkenyl, $C_{2-18}$-alkynyl, $C_{1-18}$-alkoxy, $C_{1-18}$-oxycarbonyl $C_{1-18}$-oxoalkyl, $C_{1-18}$-alkyl sulfanyl, $C_{1-18}$-alkyl imino, and amino which is substituted with one, two, or three $C_{1-18}$-alkyl groups. In some embodiments, the halogen may be one of fluorine, chlorine, bromine or iodine.

In other embodiments, the naphthol may be a compound of formula D

D

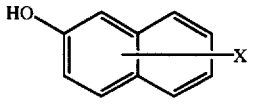

wherein X may independently be hydrogen, sulfonic acid, carboxylic acid, a salt of sulfonic acid, a salt of carboxylic acid, sulfonamide, or a quaternary ammonium salt and the remaining positions on the aromatic rings of D are one or more functional groups, including, without limitation, hydrogen, halogen, sulfo, sulfonato, sulfamino, sulfanyl, amino, amido, amidoaryl, nitro, azo, azoaryl, imino, carboxy, cyano, formyl, hydroxy, halocarbonyl, carbamoyl, carbamidoyl, phenyl, aryl, phosphonato, phosphonyl, $C_{1-18}$-alkyl, $C_{2-18}$-alkenyl, $C_{2-18}$-alkynyl, $C_{1-18}$-alkoxy, $C_{1-18}$-oxycarbonyl, $C_{1-18}$-oxoalkyl, $C_{1-18}$-alkyl sulfanyl, $C_{1-18}$-alkyl imino, and amino which is substituted with one, two, or three $C_{1-18}$-alkyl groups. In some embodiments, the halogen may be one of fluorine, chlorine, bromine or iodine.

The dye intermediate compounds useful in practicing the present invention are preferably substituted with a water-solubilizing functional group. Water soluble compounds are easy to handle in the dyeing process and tend to be less toxic than the corresponding water-insoluble compounds. In one series of embodiments, the water-solubilizing functional group(s) of one or more dye intermediate compounds can form ionic bonds with the material being dyed. Ionic attraction between the material and the dye intermediate compounds serves to enhance dye affinity for the material and improve color fastness properties. Depending on the ionic charge of the material, ionic attraction can occur when the dye intermediate carries a negative charge, such as conferred by sulfonic acid and carboxylic acid groups or their salts, or a positive charge, such as conferred by quaternary ammonium compounds.

In one series of embodiments, the first dye intermediate is selected from an aromatic diamine, a substituted aromatic diamine, a sulfonated aromatic diamine, a carboxylated aromatic diamine, a halogenated aromatic diamine, an alkoxylated aromatic diamine, an N-alkyl-substituted aromatic diamine, an N-hydroxyalkyl-substituted aromatic diamine, and an N-aryl-substituted aromatic diamine, and the second dye intermediate is selected from a substituted naphthol, a sulfonated naphthol, a sulfonamide-substituted naphthol, a carboxylated naphthol, a naphthylamine, a substituted naphthylamine, a sulfonated naphthylamine, a sulfonamide-substituted naphthylamine, or a carboxylated naphthylamine.

In one embodiment, the first dye intermediate is one of a sulfonated aromatic diamine, a carboxylated aromatic diamine, a halogenated aromatic diamine, an N-alkyl-substituted aromatic diamine, or an N-aryl-substituted aromatic diamine; the second dye intermediate is one of a sulfonated naphthol, a carboxylated naphthol, a sulfonated naphthylamine, or a carboxylated naphthylamine; and the oxidoreductase enzyme is one of peroxidase or laccase.

In a preferred embodiment, the first dye intermediate is a sulfonated aromatic diamine or a carboxylated aromatic diamine and the second dye intermediate is one or more of a naphthol, a substituted naphthol, a sulfonated naphthol, a carboxylated naphthol, a halogenated naphthol, a naphthylamine, a substituted naphthylamine, a sulfonated naphthylamine, a carboxylated naphthylamine, or a halogenated naphthylamine.

Dye intermediate compounds useful in practicing the present invention, include, without limitation, those described in Tables 1 through 8.

TABLE 1

(I)

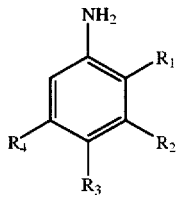

Precursor Compounds Based on Aromatic Amine and Derivatives (I).

| Code | $R_1$ | $R_2$ | $R_3$ | $R_4$ |
|---|---|---|---|---|
| P5 | | —OH | | |
| P19 | | —OCH2CH3 | —OCH2CH3 | |
| P30 | | | —SO3H | |
| P31 | —COOH | | | |
| P32 | | —COOH | | |
| P183 | —OH | | | —CH3 |
| P184 | —OCH2CH3 | | | —CH3 |
| P185 | —OCH2CH2CH3 | | | —CH3 |
| P186 | —O(CH2)4CH3 | | | —CH3 |
| P187 | —OCH2CH2OH | | | —CH3 |
| P188 | —O(CH2)3OH | | | —CH3 |
| P189 | —O(CH2)5OH | | | —CH3 |
| P190 | —OH | | —CH3 | |
| P191 | —OCH2CH3 | | —CH3 | |
| P192 | —OCH2CH2CH3 | | —CH3 | |
| P193 | —O(CH2)4CH3 | | —CH3 | |
| P194 | —OCH2CH2OH | | —CH3 | |
| P195 | —O(CH2)3OH | | —CH3 | |
| P196 | —O(CH2)5OH | | —CH3 | |
| P197 | —OCH2CH3 | | | —OCH3 |
| P198 | —OCH2CH2CH3 | | | —OCH3 |
| P199 | —OCH2CH2OH | | | —OCH3 |
| P200 | —O(CH2)3OH | | | —OCH3 |
| P201 | —O(CH2)5OH | | | —OCH3 |
| P205 | —OCH3 | | | |
| P206 | | | —OCH3 | |
| P207 | —OCH2CH3 | | | |
| P208 | —OCH3 | | | —OCH3 |
| P209 | | | —OCH2CH3 | |
| P216 | | —OCH2CH2CH3 | —OCH2CH2CH3 | |
| P217 | | —O(CH2)4CH3 | —O(CH2)4CH3 | |
| P218 | | —O(CH2)5OH | —O(CH2)5OH | |
| P219 | —OH | | | —Ph |
| P220 | —OCH2CH3 | | | —Ph |
| P221 | —OCH2CH2CH3 | | | —Ph |
| P222 | —O(CH2)4CH3 | | | —Ph |
| P223 | —OCH2CH2OH | | | —Ph |
| P224 | —O(CH2)3OH | | | —Ph |
| P225 | —O(CH2)5OH | | | —Ph |
| P226 | —OH | | | —OCH3 |
| P227 | —O(CH2)4CH3 | | | —OCH3 |

Ph = phenyl

TABLE 2

(II)

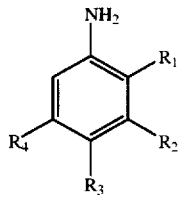

Precursor Compounds Based on Aromatic Diamine and Derivatives (II).

| Code | $R_1$ | $R_2$ | $R_3$ | $R_4$ |
|---|---|---|---|---|
| P1 | | | —NH2 | |
| P3 | Cl | | —NH2 | |
| P16 | —NH2 | | —COOH | |
| P17 | | —NH2 | | —COOH |
| P46 | | | —N=N—Ph-4-N(CH2CH2OH)2 | |
| P74 | | | —NH—Ph—NH2 | |
| P75 | | | —NH—Ph | |
| P78 | | | —N(CH3)2 | |
| P79 | | | —N(CH2CH3)2 | |
| P80 | | | —N=N—Ph-4-(N02) | |
| P81 | | | —NH—Ph-2,4-(N02)2 | |
| P83 | —NH—Ph | | | |
| P182 | | —SO3H | —NH—Ph | |
| P203 | | —SO3H | —NH2 | |
| P230 | —NH—Ph-2-(SO3H) | | | |
| P231 | —NH—Ph-3-(SO3H) | | | |
| P236 | | | —NH—Ph-2-(NO2)-4-(SO3H) | |
| P247 | | | —NH—Ph-4-(OCH3) | |
| P248 | —OCH3 | | —NH—Ph | |
| P276 | —NH—Ph-4-(SO3H) | | | |
| P284 | | | —NH—Ph-4-(SO3H) | |

Ph = phenyl

TABLE 3

(III)

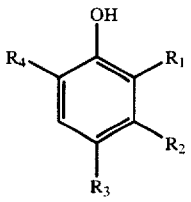

Precursor Compounds Based on Derivatives of Phenol (III).

| Code | $R_1$ | $R_2$ | $R_3$ | $R_4$ |
|---|---|---|---|---|
| P9 | | —OH | —Cl | |
| P10 | —OH | —OH | | |
| P11 | | —OH | | |
| P12* | —OH | | | |
| P13 | —CH=CHCOOH | | | |
| P14 | | —CH=CHCOOH | | |
| P15 | | | CH=CHCOOH | |
| P20 | —OH | | —CHO | |

TABLE 4

(IV)

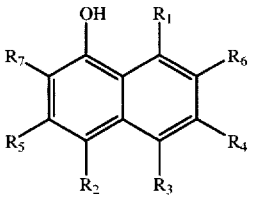

Coupler Compounds Based on 1-Naphthol and Derivatives (IV).

| Code | $R_1$ | $R_2$ | $R_3$ | $R_4$ | $R_5$ | $R_6$ | $R_7$ |
|---|---|---|---|---|---|---|---|
| P8 | | | | | | | |
| P18 | | —Cl | | | | | |
| P28 | —NH2 | | —SO3H | | | | |
| P29 | —OH | | | —SO3H | —SO3H | | |
| P33 | | | | | —SO3H | —NH2 | |
| P36 | —NH2 | | —SO3H | | | —SO3H | |
| P37 | | —SO3H | | | | | |
| P38 | | | | —NH2 | —SO3H | | |
| P40 | | | | —NH—Ph | —SO3H | | |
| P41 | —NH—Ph | —SO3H | | | | | |
| P62 | | | —OH | | | | |
| P286 | | | | | | | —COOH |
| P292 | | —Br | | | | | |
| P293 | | —OCH3 | | | | | |
| P294 | | | | | | | —NO |
| P295 | | | | | —SO2NH2 | | |
| P296 | —SO2NH2 | | | | | | |
| P297 | | | | | —SO3H | | |

TABLE 5

(V)

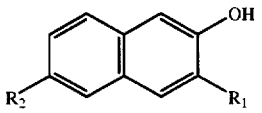

Coupler Compounds Based on Derivatives of 2-Naphthol (V).

| Code | $R_1$ | $R_2$ |
|---|---|---|
| P35 | —SO3H | —SO3H |
| P44 | —COOH | |
| P45 | —CONH—Ph | |
| P47 | —CONH—Ph-2-OCH3 | |
| P48 | —CONH—PH-2-OC2H5 | |
| P49 | —CONH—Ph-2-CH3-5-Cl | |
| P50 | —CONH—Ph-3-NO2 | |
| P51 | —CONH—Ph-2-CH3 | |
| P63 | | —OH |
| P64 | —OH | |

TABLE 6

(VI)

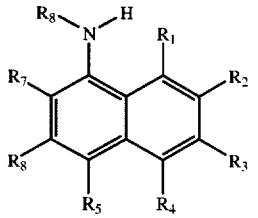

Coupler Compounds Based on Derivatives of 1-Aminonaphthalene (VI).

| Code | $R_1$ | $R_2$ | $R_3$ | $R_4$ | $R_5$ | $R_6$ | $R_7$ | $R_8$ |
|---|---|---|---|---|---|---|---|---|
| P34 | | | | —OH | | —SO3H | | |
| P39 | —SO3H | | | | | | | |
| P42* | | —SO3H | | | | | | |
| P43 | | | —SO3H | | | | | |
| P53 | —OH | | —SO3 | | | —SO3H | | |
| P68 | —NH2 | | | | | | | |
| P287 | —SO3H | | | | | | | —Ph |
| P288 | —SO3H | | | | | | | —Ph-4-(CH3) |
| P289 | | | | | —NH2 | | | |
| P290 | | —SO3H | | | —NH2 | | | |
| P291 | | | | | —SO3H | | | |

Ph = phenyl

TABLE 7

(VII)

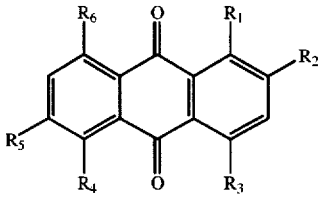

Coupler Compounds Based on Derivatives of Anthraquinone (VII).

| Code | $R_1$ | $R_2$ | $R_3$ | $R_4$ | $R_5$ |
|---|---|---|---|---|---|
| P98 | —OH | —OH | | | |
| P100 | —NH2 | | | | |
| P101 | | | | | |
| P102 | | —OH | | | —OH |
| P103 | —OH | | | —OH | |
| P112 | —OH | | —OH | | |

TABLE 8

(VIII)

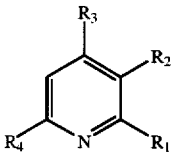

Coupler Compounds Based on Derivatives of Pyridine (VIII).

| Code | $R_1$ | $R_2$ | $R_3$ | $R_4$ |
|---|---|---|---|---|
| P104 | | —CONH2 | | |
| P105 | | —COOH | | |

TABLE 8-continued (VIII)

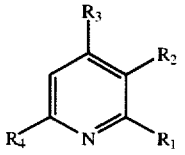

Coupler Compounds Based on Derivatives of Pyridine (VIII).

| Code | $R_1$ | $R_2$ | $R_3$ | $R_4$ |
|---|---|---|---|---|
| P120 | —OH | | —COOH | —OH |

Also encompassed by the present invention are aromatic diamines and their derivatives as disclosed in French Patent 2,112,549.

Examples of dye intermediate compounds suitable for use in the present invention include, without limitation:

3,4-diethoxyaniline 2-methoxy-p-phenylenediamine, 1-amino-4-b-methoxyethylamino-benzene (N-b-methoxyethyl p-phenylenediamine), 1-amino-4-bis-(b-hydroxyethyl)-aminobenzene (N,N-bis-(b-hydroxyethyl)-p-phenylenediamine), 2-methyl-1,3-diamino-benzene (2,6-diaminotoluene), 2,4-diaminotoluene, 2,6-diaminopyridine, 1-amino-4-sulfonato-benzene, 1-N-methylsulfonato-4-aminobenzene, 1-methyl-2-hydroxy-4-amino-benzene (3-amino o-cresol), 1-methyl-2-hydroxy-4-b-hydroxyethylamino-benzene (2-hydroxy-4-b-hydroxyethylamino-toluene), 1-hydroxy-4-methylamino-benzene (p-methylaminophenol), 1-methoxy-2,4-diamino-benzene (2,4-diaminoanisole), 1-ethoxy-2,3-diamino-benzene (2,4-diaminophenetole),
1-b-hydroxyethyloxy-2,4-diamino-benzene (2,4-diaminophenoxyethanol),
1,3-dihydroxy-2-methylbenzene (2-methyl resorcinol),
1,2,4-trihydroxybenzene,
1,2,4-trihydroxy-5-methylbenzene (2,4,5-trihydroxytoluene),
2,3,5-trihydroxytoluene,
4,8-disulfonato-1-naphtol,
3-sulfonato-6-amino-1-naphtol (J acid),
6,8-disulfonato-2-naphtol,
1,4-Phenylenediamine
2,5-Diaminotoluene
2-Chloro-1,4-phenylenediamine
2-Aminophenol
3-Aminophenol
4-Aminophenol
1,3-Phenylenediamine
1-Naphthol
2-Naphthol
4-Chlororesorcinol
1,2,3-benzenetriol (Pyrogallol)
1,3-Benzenediol (Resorcinol)
1,2-Benzenediol (Pyrocatechol)
2-Hydroxy-cinnamic acid
3-Hydroxy-cinnamic acid
4-Hydroxy-cinnamic acid
2,3-diaminobenzoic acid
2,4-diaminobenzoic acid
2,5-diaminobenzoic acid
3,4-diaminobenzoic acid
3,5-diaminobenzoic acid
Methyl 2,3-diaminobenzo ate
Ethyl 2,3-diaminobenzoate
Isopropyl 2,3-diaminobenzoate
Methyl 2,4-diaminobenzoate
Ethyl 2,4-diaminobenzoate
Isopropyl 2,4-diaminobenzoate
Methyl 3,4-diaminobenzoate
Ethyl 3,4-diaminobenzoate
Isopropyl 3,4-diaminobenzoate
Methyl 3,5-diaminobenzoate
Ethyl 3,5-diaminobenzoate
Isopropyl 3,5-diaminobenzoate
N,N-dimethyl-3,4-diaminobenzoic acid amide
N,N-diethyl-3,4-diaminobenzoic acid amide
N,N-dipropyl-3,4-diaminobenzoic acid amide
N,N-dibutyl-3,4-diaminobenzoic acid amide
4-Chloro-1-naphthol
N-Phenyl-p-phenylenediamine
3,4-Dihydroxybenzaldehyde
Pyrrole
Pyrrole-2-isoimidazole
1,2,3-Triazole
Benzotriazole
Benzimidazole
Imidazole
Indole
1-Amino-8-hydroxynaphthalene-4-sulfonic acid (S acid)
4,5-Dihydroxynapthalene-2,7-disulfonic acid (Chromotropic acid)
Anthranilic acid
4-Aminobenzoic acid (PABA)
2-Amino-8-naphthol-6-sulfonic acid (Gamma acid)
5-Amino-1-naphthol-3-sulfonic acid (M acid)
2-Naphthol-3,6-disulfonic acid (R acid)
1-Amino-8-naphthol-2,4-disulfonic acid (Chicago acid)
1-Naphthol-4-sulfonic acid (Neville-winther acid)
8-Amino-1-naphthalenesulfonic acid (Peri acid)
8-Anilino-1-naphthalenesulfonic acid (N-Phenyl Peri acid)
N-Benzoyl J acid
N-Phenyl J acid
8-Amino-2-naphthalenesulfonic acid (1,7-Cleves acid)
5-Amino-2-naphthalenesulfonic acid (1,6-Cleves acid)
3-Hydroxy-2-naphthoic acid (Bon acid)
Naphthol AS, Azoic Coupling Compound 2 (CI 37505)
Disperse Black 9
Naphthol AS OL, Azoic Coupling Compound 20 (CI 37530)
Naphthol AS PH, Azoic Coupling Compound 14 (CI 37558)
Naphthol AS KB, Azoic Coupling Compound 21 (CI 37526)
Naphthol AS BS, Azoic Coupling Compound 17 (CI 37515)
Naphthol AS D, Azoic Coupling Compound 18 (CI 37520)
Naphthol AS B1
Mordant Black 3 CI 14640 (Eriochrome Blue Black B)
4-Amino-5-hydroxy-2,6-Naphthalene Disulphonic acid (H acid)
Fat Brown RR Solvent Brown 1 (CI 11285)
Hydroquinone
Mandelic Acid
Melamine
o-Nitrobenzaldehyde
1,5-Dihydroxynaphthalene
2,6-Dihydroxynaphthalene
2,3-Dihydroxynaphthalene
Benzylimidazole
2,3-Diaminonaphthalene
1,5-Diaminonaphthalene
1,8-Diaminonaphthalene
Salicylic acid
3-aminosalicylic acid
4-aminosalicylic acid
5-aminosalicylic acid
Methyl-3-aminosalicylate
Meth-4-aminosalicylate
Methyl-5-aminosalicylate
Ethyl-3-aminosalicylate
Ethyl-4-aminosalicylate
Ethyl-5-aminosalicylate
Propyl-3-aminosalicylate
Propyl-4-aminosalicylate
Propyl-5-aminosalicylate
Salicylic amide
4-Aminothiophenol
4-Hydroxythiophenol
Aniline
4,4'-Diaminodiphenylamine sulfate
4-Phenylazoaniline
4-Nitroaniline
N,N-Dimethyl-1,4-phenylenediamine
N,N-Diethyl-1,4-phenylenediamine
Disperse Orange 3
Disperse Yellow 9
Disperse Blue 1
N-Phenyl-1,2-phenylenediamine
6-Amino-2-naphthol
3-Amino-2-naphthol
5-Amino-1-naphthol
1,2-Phenylenediamine
2-Aminopyrimidine
4-Aminoquinaldine
2-Nitroaniline
3-Nitroaniline
2-Chloroaniline
3-Chloroaniline 4-Chloroaniline
4-(phenylazo)resorcinol (Sudan Orange G, CI 11920)
Sudan Red B, CI 26110
Sudan Red 7B, CI 26050
4'-Aminoacetanilide
Alizarin
1-Anthramine (1-Aminoanthracene)
1-Aminoanthraquinone
Anthraquinone
2,6-Dihydroxyanthraquinone (Anthraflavic Acid)
1,5-Dihydroxyanthraquinone (Anthrarufin)
3-Amidopyridine (Nicotinamide)
Pyridine-3-carboxylic acid (Nicotinic Acid)
Mordant Yellow 1, Alizarin Yellow GG, CI 14025
Coomassie Grey, Acid Black 48, CI 65005
Palantine Fast Black WAN, Acid Black 52, CI 15711
Palantine Chrome Black 6BN, CI 15705, Eriochrome Blue Black R
Mordant Black 11, Eriochrome Black T
Naphthol Blue Black, Acid Black 1, CI 20470
1,4-Dihydroxyanthraquinone (Quinizarin)
4-Hydroxycoumarin
Umbelliferone, 7-Hydroxycoumarin
Esculetin 6,7-Dihydroxycoumarin
Coumarin
Chromotrope 2B Acid Red 176, CI 16575
Chromotrope 2R Acid Red 29, CI 16570
Chromotrope FB Acid Red 14, CI 14720
2,6-Dihydroxyisonicotinic acid, Citrazinic acid
2,5-Dichloroaniline
2-Amino-4-chlorotoluene
2-Nitro-4-chloroaniline
2-Methoxy-4-nitroaniline and
p-Bromophenol.

Enzymatic Oxidizing Systems

In the methods of the present invention, the dye intermediate compound(s) may be oxidized by (a) a hydrogen peroxide source and an enzyme exhibiting peroxidase activity or (b) an enzyme exhibiting oxidase activity on at least one of the compounds in the mixture. Enzymes exhibiting peroxidase activity include, but are not limited to, peroxidase (EC 1.11.1.7) and haloperoxidase, e.g., chloro-(EC 1.11.1.10), bromo-(EC 1.11.1) and iodoperoxidase (EC 1.11.1.8). Enzymes exhibiting oxidase activity are preferably copper oxidases (e.g., blue copper oxidases), which include, but are not limited to, bilirubin oxidase (EC 1.3.3.5), catechol oxidase (EC 1.10.3.1), laccase (EC 1.10.3.2), o-aminophenol oxidase (EC 1.10.3.4), polyphenol oxidase (EC 1.10.3.2), ascorbate oxidase (EC 1.10.3.3), and ceruloplasmin. Assays for determining the activity of these enzymes are well known to persons of ordinary skill in the art.

When the one or more enzymes employed in the invention are oxidases, an oxygen source, e.g., air, must be used. In one embodiment, oxygen is supplied by simply aerating the solution that comes into contact with the enzyme.

Oxygen may also be supplied by chemical means. For example, oxygen may be supplied by the decomposition of hydrogen peroxide, inorganic peroxides, and organic peroxides. Suitable inorganic and organic peroxides are described, for example, in Kirk-Othmer *Encyclopedia of Chemical Technology*, Vol. 18, 4th ed., John Wiley & Sons, Inc., NY, 1995, pp. 202–310. Decomposition of peroxides to yield oxygen may be catalyzed by the presence of metal ions, including ferrous, ferric, cuprous, cupric, chromate, dichromate, molybdate, tungstate, and vanadate; by the presence of halide ions; and by catalytic surfaces including copper, mild steel, iron, silver, palladium, platinum, and oxides of iron, lead, nickel, manganese, and mercury (Kirk-Othmer *Encyclopedia of Chemical Technology*, Vol. 13, 4th ed., John Wiley & Sons, Inc., NY, 1995, pp. 964–965). Oxygen may also be supplied by treating hydrogen peroxide in the presence of catalase enzyme (E.C. 1.11.1.6).

When the enzyme employed in the invention is a peroxidase, a hydrogen peroxide source, such as, e.g., hydrogen peroxide itself, must be used. The hydrogen peroxide source may be added at the beginning or during the process, e.g., at a concentration of about 0.001–100 mM, particularly 0.01–50 mM.

One source of hydrogen peroxide includes precursors of hydrogen peroxide, such as, e.g., a perborate or a percarbonate. Another source of hydrogen peroxide includes enzymes which are able to convert molecular oxygen and an organic or inorganic substrate into hydrogen peroxide and the oxidized substrate, respectively. These enzymes produce only low levels of hydrogen peroxide, but they may be employed to great advantage in the process of the invention as the presence of peroxidase ensures an efficient utilization of the hydrogen peroxide produced. Examples of enzymes which are capable of producing hydrogen peroxide include, but are not limited to, glucose oxidase, urate oxidase, galactose oxidase, alcohol oxidase, amine oxidase, amino acid oxidase and cholesterol oxidase.

The laccase may be a plant, microbial, insect, or mammalian laccase.

In one embodiment, the laccase is a plant laccase. For example, the laccase may be lacquer, mango, mung bean, peach, pine, poplar, prune, sycamore, or tobaco laccase.

In another embodiment, the laccase is an insect laccase. For example, the laccase may be a Bombyx, Calliphora, Diploptera, Drosophila, Lucilia, Manduca, Musca, Oryctes, Papilio, Phorma, Rhodnius, Sarcophaga, Schistocerca, or Tenebrio laccase.

The laccase is preferably a microbial laccase, such as a bacterial or a fungal laccase. Bacterial laccases include, without limitation, an Acetobacter, Acinetobacter, Agrobacterium, Alcaligenes, Arthrobacter, Azospirillum, Azotobacter, Bacillus, Comamonas, Clostridium, Gluconobacter, Halobacterium, Mycobacterium, Rhizobium, Salmonella, Serratia, Streptomyces, E. coli, Pseudomonas, Wolinella, or methylotrophic bacterial laccase.

In one embodiment, the laccase is an *Azospirillum lipoferum* laccase.

In another embodiment, the laccase is a fungal laccase. Fungal laccases include, without limitation, yeast laccases such as a Candida, Kluyveromyces, Pichia, Saccharomyces, Schizosaccharomyces, or Yarrowia laccases; or filamentous fungal laccases such as Acremonium, Agaricus, Antrodiella, Armillaria, Aspergillus, Aureobasidium, Bjerkandera, Botrytis, Cerrena, Chaetomium, Chrysosporium, Collybia, Coprinus, Cryptococcus, Cryphonectria, Curvularia, Cyathus, Daedalea, Filibasidium, Fomes, Fusarium, Geotrichum, Halosarpheia, Humicola, Junghuhnia, Lactarius, Lentinus, Magnaporthe, Monilia, Monocillium, Mucor, Myceliophthora, Neocallimastix, Neurospora, Paecilomyces, Panus, Penicillium, Phanerochaete, Phellinus, Phlebia, Pholiota Piromyces, Pleurotus, Podospora, Pycnoporus, Polyporus (Trametes), Pyricularia, Rhizoctonia, Rigidoporus, Schizophyllum, Sclerotium, Scytalidium, Sordaria, Sporotrichum, Stagonospora, Talaromyces, Thermoascus, Thielavia, Tolypocladium, or Trichoderma laccases.

Preferably, the enzyme is a laccase obtained from a genus selected from the group consisting of Aspergillus, Botrytis, Collybia, Fomes, Lentinus, Myceliophthora, Neurospora, Pleurotus, Podospora, Polyporus (Trametes), Scytalidium, and Rhizoctonia.

In one series of embodiments, the laccase is obtained from a species selected from *Coprinus cinereus, Humicola brevis* var. *thermoidea, Humicola brevispora, Humicola grisea* var. *thermoidea, Humicola insolens*, and *Humicola lanuginosa* (also known as *Thermomyces lanuginosus*), *Myceliophthora thermophila, Myceliophthora vellerea, Polyporus pinsitus* (also known as *Trametes villosa*), *Scytalidium thermophila, Scytalidium indonesiacum*, and *Torula thermophila*. The laccase may be obtained from other species of Scytalidium, such as *Scytalidium acidophilum, Scytalidium album, Scytalidium aurantiacum, Scytalidium circinatum, Scytalidium flaveobrunneum, Scytalidium hyalinum, Scytalidium lignicola*, and *Scytalidium uredinicolum*. The laccase may be obtained from a species of Polyporus, such as *Polyporus zonatus, Polyporus alveolaris, Polyporus arcularius, Polyporus australiensis, Polyporus badius, Polyporus biformis, Polyporus brumalis, Polyporus ciliatus, Polyporus colensoi, Polyporus eucalyptorum, Polyporus meridionalis, Polyporus varius, Polyporus palustris, Polyporus rhizophilus, Polyporus rugulosus, Polyporus squamosus, Polyporus tuberaster*, and *Polyporus tumulosus. The laccase may also be obtained from a species of Rhizoctonia, e.g., Rhizoctonia solani*. The laccase may also be a modified laccase by at least one amino acid residue in a Type I (T1) copper site, wherein the modified oxidase possesses an altered pH and/or specific activity relative to the wild-type oxidase. For example, the modified laccase could be modified in segment (a) of the T1 copper site.

The peroxidase may be a plant, microbial, insect, or mammalian peroxidase.

Peroxidases which may be employed for the present purpose may be isolated from and are producible by plants (e.g., horseradish peroxidase and soybean peroxidase) or microorganisms such as fungi or bacteria. Some preferred fungi include strains belonging to the subdivision Deuteromycotina, class Hyphomycetes, e.g., Fusarium, Humicola, Trichoderma, Myrothecium, Verticillum, Arthromyces, Caldariomyces, Ulocladium, Embellisia, Cladosporium or Dreschlera, in particular *Fusarium oxysporum* (DSM 2672), *Humicola insolens, Trichoderma resii, Myrothecium verrucana* (IFO 6113), *Verticillum alboatrum, Verticillum dahlie, Arthromyces ramosus* (FERM P-7754), *Caldariomyces fumago, Ulocladium chartarum, Embellisia alli* or *Dreschlera halodes*.

Other preferred fungi include strains belonging to the subdivision Basidiomycotina, class Basidiomycetes, e.g., Coprinus, Phanerochaete, Coriolus or Trametes, in particular *Coprinus cinereus* f. *microsporus* (IFO 8371), *Coprinus macrorhizus, Phanerochaete chrysosporium* (e.g., NA-12) or *Coriolus versicolor* (e.g., PR4 28-A).

Further preferred fungi include strains belonging to the subdivision Zygomycotina, class Mycoraceae, e.g., Rhizopus or Mucor, in particular *Mucor hiemalis*.

Some preferred bacteria include strains of the order Actinomycetales, e.g., *Streptomyces spheroides* (ATTC 23965), *Streptomyces thermoviolaceus* (IFO 12382) or *Streptoverticillum verticillium* ssp. *verticillium*.

Other preferred bacteria include *Bacillus pumillus* (ATCC 12905), *Bacillus stearothermophilus, Rhodobacter sphaeroides, Rhodomonas palustri, Streptococcus lactis, Pseudomonas purrocinia* (ATCC 15958) or *Pseudomonas fluorescens* (NRRL B-11).

Other potential sources of peroxidases are listed in B.C. Saunders et al., op. cit., pp. 41–43.

Methods of producing enzymes to be used according to the invention are described in the art, e.g., *FEBS Letters* 1625, 173(1), *Applied and Environmental Microbiology*, February 1985, pp. 273–278, *Applied Microbiol. Biotechnol.* 26, 1987, pp. 158–163, *Biotechnology Letters* 9(5), 1987, pp. 357–360, *Nature* 326, Apr. 2 1987, *FEBS Letters* 4270, 209(2), p. 321, EP 179 486, EP 200 565, GB 2 167 421, EP 171 074, and *Agric. Biol. Chem.* 50(1), 1986, p. 247.

Particularly preferred enzymes are those which are active at a pH in the range of about 2.5 to about 12.0, preferably in the range of about 4 to about 10, more preferably in the range of about 4.0 to about 7.0 or in the range of about 7.0 to about 10.0. Such enzymes may be isolated by screening for the relevant enzyme production by alkalophilic microorganisms, e.g., using the ABTS assay described in R. E. Childs and W. G. Bardsley, *Biochem. J.* 145, 1975, pp. 93–103.

Other preferred enzymes are those which exhibit a good thermostability as well as a good stability towards commonly used dyeing additives such as non-ionic, cationic, or anionic surfactants, chelating agents, salts, polymers, etc.

The enzymes may be wild-type (i.e., native) enzymes, or may be naturally produced or recombinant variants containing substitutions, deletions, and/or insertions relative to a wild-type parent. The enzymes may be fusion proteins or may be synthetic, shuffled, or designed proteins. Such proteins may be produced using conventional methods for in vivo or in vitro mutagenesis and gene construction.

The enzymes, whether wild-type or variant, may also be produced by a method comprising (a) cultivating a host cell transformed with a recombinant DNA vector which carries a DNA sequence encoding said enzyme as well as DNA sequences encoding functions permitting the expression of the DNA sequence encoding the enzyme, in a culture medium under conditions permitting the expression of the enzyme and recovering the enzyme from the culture; and (b) recovering the enzyme from the culture.

A DNA fragment encoding the enzyme may, for instance, be isolated by establishing a cDNA or genomic library of a microorganism producing the enzyme of interest, such as one of the organisms mentioned above, and screening for positive clones by conventional procedures such as by hybridization to oligonucleotide probes synthesized on the basis of the full or partial amino acid sequence of the enzyme, or by selecting for clones expressing the appropriate enzyme activity, or by selecting for clones producing a protein which is reactive with an antibody against the native enzyme.

Once selected, the DNA sequence, before or after sequence manipulation using recombinant DNA techniques, may be inserted into a suitable replicable expression vector comprising appropriate promoter, operator and terminator sequences permitting the enzyme to be expressed in a particular host organism, as well as an origin of replication enabling the vector to replicate in the host organism in question.

The resulting expression vector may then be transformed into a suitable host cell, such as a fungal cell, preferred examples of which are a species of Aspergillus, most preferably *Aspergillus oryzae* or *Aspergillus niger*. Fungal cells may be transformed by a process involving protoplast formation and transformation of the protoplasts followed by regeneration of the cell wall in a manner known per se. The use of Aspergillus as a host microorganism is described in EP 238,023 (of Novo Industri A/S), the contents of which are hereby incorporated by reference.

Alternatively, the host organisms may be a bacterium, in particular strains of Streptomyces, Bacillus, or *E. coli*. The transformation of bacterial cells may be performed according to conventional methods, e.g., as described in T. Maniatis et al., *Molecular Cloning. A Laboratory Manual*, Cold Spring Harbor, 1982.

The screening of appropriate DNA sequences and construction of vectors may also be carried out by standard procedures, cf. T. Maniatis et al., op. cit.

The medium used to cultivate the transformed host cells may be any conventional medium suitable for growing the host cells in question. The expressed enzyme may conveniently be secreted into the culture medium and may be recovered therefrom by well-known procedures including separating the cells from the medium by centrifugation or filtration, precipitating proteinaceous components of the medium by means of a salt such as ammonium sulphate, followed by chromatographic procedures such as ion exchange chromatography, affinity chromatography, or the like.

Dyeing Methods

In one series of embodiments, the material to be dyed is first soaked in an aqueous solution with the dye intermediate compounds, after which the soaked material is treated in an aqueous solution with (a) a hydrogen peroxide source and an enzyme exhibiting peroxidase activity or (b) an enzyme exhibiting oxidase activity on at least one of the color intermediate compounds. The same aqueous solution may be used to soak and dye the material. In another series of embodiments, the material to be dyed is contacted simultaneously with an aqueous solution comprising the dye intermediate compounds, oxidizing enzyme, and electron acceptor. In another series of embodiments, the material to be dyed is contacted with one dye intermediate, and contacted subsequently with the second dye intermediate, enzyme, and electron acceptor. In another series of embodiments, the material to be dyed is contacted with the enzyme, after which the dye intermediates and electron acceptor are added.

The dye intermediates are typically used in an amount between about 0.05% and 15% on weight of goods (o.w.g.), preferably between about 0.1% and 10% o.w.g., and more preferably between about 0.5% and 8% o.w.g.

The aqueous solution, i.e., the dye liquor, used to dye the material in the methods of the present invention may have a water ("liquor" or "bath"):material ratio (by weight) in the range of about 0.5:1 to about 200:1, preferably about 1:1 to 30:1, and most preferably about 5:1 to about 20:1.

In one embodiment, a pattern can be obtained on the material to be dyed by applying to the material a viscous paste containing at least one of the dye intermediate compounds using a brush, print screen, engraved roller or any application technique known in the art. The material is optionally dried. Then, the material is treated with an aqueous solution containing (a) a hydrogen peroxide source and an enzyme exhibiting peroxidase activity or (b) an enzyme exibiting oxidase activity on at least one of the dye intermediate compounds (and containing at least one suitable dye intermediate compound, if this was not present in the viscous paste). Polymeric thickeners known in the art, such as carboxymethyl cellulose, can be used to prepare the viscous paste.

In the methods of the present invention, the material is dyed at a temperature between about 5 to about 120° C., preferably between about 30 and about 100° C., more preferably between about 50 and about 100° C., and most preferably between about 60 and about 95° C.; and at a pH between about 2.5 and about 12, preferably between about 4 and about 10, more preferably between about 4.0 and about 7.0 or between about 7.0 and about 10.0. In some embodiments, a pH below 6.5 (e.g., a pH in the range of 3–6, preferably in the range of 4–6 and most preferably in the range of 4.5–5.5) or above 8.0 (e.g., a pH in the range of 8–10, preferably in the range of 8.5–10 and most preferably in the range of 9–10), is used. Surprisingly, the colors of the materials dyed by the methods of the present invention at a pH below 6.5 and above 8.0 are different than the colors of the same materials dyed by methods at a pH in the range of 6.5–8.0. In one embodiment, a temperature and pH near the temperature and pH optima of the enzyme, respectively, are used.

In some embodiments, the methods of the present invention further comprise adding to the aqueous solution a mono- or divalent ion which includes, but is not limited to, sodium, potassium, calcium and magnesium ions (0–3 M, preferably 25 mM–1 M); a polymer including, but not limited to, polyvinylpyrrolidone, polyvinylalcohol, polyaspartate, polyvinylamide, polyethelene oxide (0–50 g/l, preferably 1–500 mg/l); and a surfactant (0.01–5 g/l).

Useful surfactants include without limitation anionic surfactants such as carboxylates, for example, a metal carboxylate of a long chain fatty acid; N-acylsarcosinates; mono or di-esters of phosphoric acid with fatty alcohol ethoxylates or salts of such esters; fatty alcohol sulphates such as sodium dodecyl sulphate, sodium octadecyl sulphate or sodium cetyl sulphate; ethoxylated fatty alcohol sulphates; ethoxylated alkylphenol sulphates; lignin sulphonates; petroleum sulphonates; alkyl aryl sulphonates such as alkyl-benzene sulphonates or lower alkylnaphthalene sulphonates, e.g., butylnaphthalene sulphonate; salts or sulphonated naphthalene-formaldehyde condensates; salts of sulphonated phenol-formaldehyde condensates; or more complex sulphonates such as amide sulphonates, e.g., the sulphonated condensation product of oleic acid and N-methyl taurine or the dialkyl sulphosuccinates, e.g., the sodium sulphonate or dioctyl succinate. Further examples of such surfactants are non-ionic surfactants such as condensation products of fatty acid esters, fatty alcohols, fatty acid amides or fatty-alkyl- or alkenyl-substituted phenols with ethylene oxide, block copolymers of ethylene oxide and propylene oxide, acetylenic glycols such as 2,4,7,9-tetraethyl-5-decyn-4,7-diol, or ethoxylated acetylenic glycols. Further examples of such surfactants are cationic surfactants such as aliphatic mono-, di-, or polyamines such as acetates, naphthenates or oleates; oxygen-containing amines such as an amine oxide of polyoxyethylene alkylamine; amide-linked amines prepared by the condensation of a carboxylic acid with a di- or polyamine; or quaternary ammonium salts.

The methods of the present invention further comprise adding to the aqueous solution an agent which enhances the activity of the enzyme exhibiting peroxidase activity or the enzyme exhibiting oxidase activity. Enhancing agents are well known in the art. For example, the organic chemical compounds disclosed in WO 95/01426 are known to enhance the activity of a laccase. Furthermore, the chemical compounds disclosed in WO 94/12619 and WO 94/12621 are known to enhance the activity of a peroxidase.

The methods of the present invention further comprise simultaneously or sequentially treating the material with one or more traditional pre-formed dyestuffs of a type suitable for the material. Traditional pre-formed dyestuffs are well known to those of ordinary skill in the art of dyeing. Examples of traditional dyestuffs are acid, basic, direct, disperse, mordant, pigment, reactive, solvent, and vat, as described in *Colorants and Auxiliaries*, Vol. 1, John Shore, ed., Society of Dyers and Colorists, 1990, Chapter 1 and subsequent. Examples of traditional dyestuffs classified by chemical class include unmetallized azo, metal-complex azo, thiazole, stilbene, anthraquinone, indigoid, quinophthalone, aminoketone, phthalocyanine, formazan, methine, nitroso, triarylmethane, xanthene, acridine, azine, oxazine, and thiazine. Specific examples of dyes belonging to these classes and suggested methods for their application are found in *Colour Index International*, 3rd Edition, Society of Dyers and Colourists, CD-ROM version, AATCC Box 12215, Research Triangle Park, N.C. 27709. Specific commercial dyestuffs may be found, for example, in the *AATCC Buyer's Guide* published annually by the American Association of Textile Chemists and Colorists, P.O. Box 12215, Research Triangle Park, N.C. 27709. Treatment of a material with said traditional dyestuff in addition to treatment by the method of the present invention provides a means for adjusting the color of the material, such as may be desired for color shade matching. In a preferred embodiment, said traditional dyestuff is compatible with and is applied together in the same process as treatment by the method of the present invention.

The methods of the present invention further comprise treatment of the material with one or more dyeing auxiliaries. Dyeing auxiliaries include, without limitation, electrolytes, sequestering agents. e.g. polyphosphates, dispersing agents, e.g. ligninsulfonates and formaldehyde-arylsulfonic acid condensation products, solubilizing agents, levelling agents, e.g. poly(oxyethylene) adducts and amphoteric betaine compounds, retarding agents, thickening agents, e.g. guar gum and carboxymethyl cellulose, migration inhibitors, hydrotropic agents, e.g. urea, syntans, formaldehyde, metal salts, e.g. copper(II) sulfate and sodium dichromate, cationic surfactants, e.g. quaternary ammonium compounds, formaldehyde-melamine condensation product, polyamine-cyanuric chloride condensation product, chloroalkane-poly(ethylene imine) condensation product, epichlorohydrin, alkaline scour agents, e.g. sodium carbonate with olive oil, foaming agents, e.g. sodium lauryl sulfate, ammonium lauryl sulfate, sodium dioctyl sulfosuccinate, lauryl alcohol poly(oxyethylene), decyl alcohol poly (oxyethylene), and tridecyl alcohol poly(oxyethylene), defoaming agents, e.g. poly(dimethylsiloxane), lubricants, softeners, antistatic agents, soil release agents, soil repellent agents, and fluorescent brighteners. Dyeing auxiliaries are often specifically formulated for the type of material being dyed. Further examples of useful dyeing auxiliaries are given in *Colorants and Auxiliaries*, Vol. 2, John Shore, ed., Society of Dyers and Colourists, 1990, especially chapters 10 and 12. In a preferred embodiment, said dyeing auxiliaries increase the depth of color and color fastness properties of the material treated by the method of the present invention.

The present invention provides enzymatic dyeing methods whose efficacy can be monitored by determining the activation ratio (AR), which is a normalized measure of the difference in depth of color between control and enzyme-treated swatches. AR is expressed by equation (1).

$$AR=(L^* \text{ control}-L^* \text{ enzyme})/L^* \text{ enzyme} \qquad \text{Eqn. (1)}$$

where L* is a measure of lightness in the CIEL*a*b* color coordinate system. A high activation ratio is obtained when the dyeing system remains essentially colorless unless enzyme is added. Dyeing systems with a low activation ratio either produce no or limited color (even in the presence of enzyme), or produce nearly the same level of color without enzyme (by auto-oxidation) as with enzyme.

In the present invention, dyeing systems that give dark colors with high activation ratios are preferred because these systems are more stable and easier to handle and package than dyeing systems giving dark colors, but with low activation ratios. An activation ratio (AR) greater than 1 (when the dye intermediates are used in an aggregate amount of about 5% o.w.g) indicates a distinct difference between the depth of color on the control versus the enzyme-treated fabric, and typically indicates that little to no color has formed on the fabric in the control treatment.

The methods of the present invention preferably provide AR values (when the dye intermediates are used in an aggregate amount of about 5% o.w.g) greater than about 0.25, more preferably greater than about 1, and most preferably greater than about 2.

In the present invention, most preferred dyeing systems are those that give high activation ratios combined with good color fastness properties and ease of chemical handling.

Dyeing Kits

The present invention provides kits for use in dyeing materials. The kits comprise:

(a) at least one aromatic diamine;

(b) at least one compound selected from the group consisting of a naphthol and an aminonaphthalene; and (c) an enzyme selected from the group consisting of a peroxidase and a laccase.

In some embodiments, the aromatic diamine in the kit is substituted with a sulfonic acid (or salt thereof), a carboyxlic acid (or salt thereof), a sulfonamide, or a quaternary ammonium salt. In some embodiments, the naphthol in the kit is any naphthol other than α(alpha)-napthol, halogenated 1-naphthol, or unsubstituted dihydroxynaphthalene.

In preferred embodiments, the aromatic diamine of (a) is one of: 1,4-Phenylenediamine, N-Phenyl-p-phenylenediamine, N,N-Diethyl-1,4-phenylenediamine, 4-aminodiphenylamine-2-sulfonic acid, N-(4'-aminophenyl) aminobenzene-4-sulfonic acid, and 2-5-diaminobenzenesulfonic acid; the compound of (b) is one of 1-Naphthol-4-sulfonic acid, N-Phenyl J acid, 8-amino-1-naphthalenesulfonic acid, 8-anilino-1-naphthalenesulfonic acid, 8-amino-2-naphthalenesulfonic acid, and 5-amino-2-naphthalenesulfonic acid; and the enzyme is a laccase.

The kits may further comprise appropriate buffers for solubilizing the components and directions for using the components to dye material.

The invention is further illustrated by the following non-limiting examples.

Methods

Chemicals used as buffers and substrates were commercial products. The commercial wetting agent Intravon FW 75, dyeing auxiliary Intratex CWR, and surfactant Intravon NF were obtained from Crompton & Knowles Colors Incorporated, Charlotte, N.C. 28233. Style 526 worsted wool flannel, Style 530 chlorinated wool, and Style 1 multifiber fabric (containing spun cellulose acetate, bleached cotton, spun Nylon 6.6, spun silk, spun viscose, and worsted wool) were obtained from Testfabrics, Inc., West Pittston, Pa. 18643. Style 522 worsted wool gabardine was obtained from Textile Innovators Corporation, Windsor, N.C. 27983.

Determination of Laccase Activity

Laccase activity was determined from the oxidation of syringaldazine under aerobic conditions. The violet color produced was measured by spectrophotometry at 530 nm. The analytical conditions were 19 μM syringaldazine, 23.2 mM acetate buffer, pH 5.5 or pH 7.5, 30° C., and 1 minute reaction time. One laccase unit is the amount of enzyme that catalyzes the conversion of 1 μmole syringaldazine per minute at the given analytical conditions. For measurements made at pH 5.5 the activity units are labeled LACU. For measurements made at pH 7.5 the activity units are labeled LAMU.

Determination of Peroxidase Activity

One peroxidase unit (POXU) is the amount of enzyme that catalyzes the conversion of 1 μmol hydrogen peroxide per minute at the following analytical conditions: 0.88 mM hydrogen peroxide, 1.67 mM 2,2'-azinobis(3-ethylbenzothiazoline-6-sulfonate), 0.1 M phosphate buffer (containing Triton X405 (1.5 g/1000 ml)), pH 7.0, incubated at 30° C., photometrically followed at 418 nm (extinction coefficient of ABTS is set to 3.6 l/mmol*mm).

Evaluation of Color Fastness

Upon dyeing, the color and color fastness properties of the dyed fabrics were evaluated. The parameters "L", "a", and "b" and K/S were used to quantify color and color strength and are well known to persons of ordinary skill in the art of color science. See, for example, Billmeyer and Saltzman, *Principles of Color Technology*, Second Edition, John Wiley & Sons, New York, 1981, pages 59, 63, and 183. Color fastness is an important parameter for evaluation of dyed textiles and there are many standard methods known in the art for evaluating color fastness properties (see e.g. *AATCC Technical Manual*, Vol. 71, American Association of Textile Chemists and Colorists, Research Triangle Park, N.C., 1996). Color fastness was evaluated with respect to wash fastness, light fastness, and crock fastness as described below.

Wash Fastness Evaluation (W)

The AATCC Color Fastness to Laundering Test Method 61-2A (1989) was followed. CIEL*a*b* measurements were made on the original dyed and then washed samples using a Macbeth ColorEye 7000 Spectrophotometer (Macbeth, New Windsor, N.Y.), set with large area view, 10° observer, $D_{65}$ illuminant, and average of two measurements, according to the manufacturer's instructions. (See, for example, Billmeyer and Saltzman, *Principles of Color Technology*, Second Edition, John Wiley & Sons, New York, 1981, page 63, for an explanation of the CIEL*a*b* color coordinate system).

A gray scale rating was assigned based on the value of the CIEL*a*b* total color difference ($\Delta E^*=(\Delta L^*+\Delta a^*+\Delta b^*)^{0.5}$) between the dyed and the washed samples (AATCC Gray Scale Ranking Table, AATCC, Research Triangle Park, N.C., see also Table 9).

TABLE 9

AATCC Gray Scale Ranking Table

Conversion of ΔE values to Gray Scale Rating

| | | | | | | | | | | |
|---|---|---|---|---|---|---|---|---|---|---|
| Delta E (ΔE) | 0 | 0.4 | 1.25 | 2.1 | 2.95 | 4.1 | 5.8 | 8.2 | 11.6 | 13.6 |
| Gray Scale (GS) | 5 | 4–5 | 4 | 3–4 | 3 | 2–3 | 2 | 1–2 | 1 | <1 |

Light Fastness Evaluation

Light fastness (L) was measured following the AATCC Light Fastness Test Method 16 (1993), Option E. Dyed swatches (4 cm×4 cm) were stapled to the black side of a Fade-O-Meter Test Mask No. SL-8A (Atlas Electric Devices Co., Chicago, Ill., Part No. 12-7123-01). The mask was placed in a Suntest CPS+ (Slaughter Machinery Company, Lancaster, S.C.) and exposed to a Xenon light source at an irradiance of 756 W/m$^2$ for 20 hours according to the manufacturer's instructions.

ΔE* and gray scale ratings were generated as described above, except only single measurements were made on the exposed fabric face.

Crock Fastness Evaluation

The AATCC Color Fastness to Crocking Test Method 8-1989 was followed for dry crock (DC) and wet (WC) crock fastness.

Wet AATCC crock cloth squares were prepared by pressing each water-saturated crock cloth between AATCC blotting paper under an 18 g weight for 5 seconds to yield approximately 65±5% moisture.

A visual rating (5=best) was assigned using the AATCC Chromatic Transference Scale (AATCC, Research Triangle Park, N.C.) while viewing the samples in a Macbeth SpectraLight II light box (Macbeth, Newburgh, N.Y.) under daylight.

EXAMPLE 1

Five mg of a first compound (p-phenylenediamine ("A"), p-tolulenediamine ("B"), or o-aminophenol ("C")) and 5 mg of a second compound (m-phenylenediamine ("D"), α-naphthol ("E"), or 4-chlororesorcinol ("F")) (or 10 mg of the first compound in experiments without the second compound) were dissolved in 10 ml of 0.1 M $K_2HPO_4$, pH 7.0, buffer. A *Polyporus pinsitus* laccase ("PpL") with an activity of 71.7 LACU/ml (deposited with the Centraal Bureau voor Schimmelcultures and given accession number CBS 678.70) or a *Myceliophthora thermophila* laccase ("MtL") with an activity of 690 LACU/ml (deposited with the Centraal Bureau voor Schimmelcultures and given accession number CBS 117.65)) was diluted in the same buffer to an activity of 10 LACU/ml.

Multifiber swatches Style 10A (4×10 cm) obtained from Test Fabrics Inc. (Middlesex, N.J.) were rolled up and placed in a test tube. The swatches contained a strip of a fiber made of wool. 4.5 ml of the precursor/coupler solution and 1 ml of the laccase solution were added to the test tube. The test tube was closed, mixed and mounted in a test tube shaker and incubated for 60 minutes in a dark cabinet. After incubation the swatches were rinsed in running hot tap water for about 30 seconds.

The results of the experiment are provided in the following tables:

TABLE 10

| FABRIC | A alone | A + D | A + E | A + F |
|---|---|---|---|---|
| wool | gray brown | dark blue | dark purple | brown |

TABLE 11

| FABRIC | B alone | B + D | B + E | B + F |
|---|---|---|---|---|
| wool | brown | dark blue | blue brown | yellow/brown |

TABLE 12

| FABRIC | C alone | C + D | C + E | C + F |
|---|---|---|---|---|
| wool | orange/red | strong orange/red | strong orange | strong orange |

The results demonstrate that color is formed on wool in the presence of precursor and *Polyporus pinsitus* laccase. Similar results were obtained with the *Myceliophthora thermophila* laccase.

EXAMPLE 2

Various materials were dyed in an Atlas Launder-O-Meter ("LOM") at 30° C. for 1 hour at a pH in the range of 4–10. The materials dyed (all obtained from Test Fabrics Inc.) were worsted wool (Style 526, 7 cm×7 cm) and chlorinated worsted wool (Style 530, 7 cm×7 cm).

A 0.1 M Britton-Robinson buffer solution was prepared at the appropriate pH by mixing solution A (0.1 M $H_3PO_4$, 0.1 M $CH_3COOH$, 0.1 M $H_3BO_3$) and B (0.5 M NaOH In order to produce buffer solutions at pH's 4, 5, 6, 7, 8, 9 and 10, 806 ml, 742 ml, 706 ml, 656 ml, 624 ml, 596 ml and 562 ml of solution A, respectively, were diluted to one liter with solution B.

To 75 ml of each buffer solution was added 0.5 mg/ml of a compound selected from p-phenylenediamine, o-aminophenol and m-phenylenediamine. The pH was checked and adjusted if necessary. The 75 ml buffer/compound solutions were combined to form 150 ml of each buffer/compound combination solution which was added to a LOM beaker.

Swatches of the materials were then soaked in each buffer/compound combination solution. A volume corresponding to the volume of laccase to be added was then withdrawn. A *Myceliophthora thermophila* laccase ("MtL") with an activity of 690 LACU/ml was diluted in the buffer solution to an activity of 300 LACU/ml. 2 LACU/ml was added for each pH, except pH 7.0. At pH 7.0, 0, 1, 2, and 4 LACU/ml was added for the dosing profile. The LOM beakers were then mounted on the LOM. After 1 hour at 42 RPM and 30° C., the LOM was stopped. The liquid was poured off and the swatches were rinsed in the beaker in running deionized water for about 15 minutes. The swatches were dried and the CIEL*a*b* values measured using a ColorEye 7000 instrument. The CIEL*a*b* results are given in Tables 13–16.

TABLE 13

Dyeing with precursors p-phenylenediamine and m-phenylenediamine (pH-profile, 2 LACU/ml)

| | | pH 4 | pH 5 | pH 6 | pH 7 | pH 8 | pH 9 | pH 10 |
|---|---|---|---|---|---|---|---|---|
| Worsted Wool | L* | 41.57 | 28.21 | 20.25 | 14.73 | 18.94 | 35.06 | 13.52 |
| | a* | 2.71 | 1.24 | 0.43 | 1.63 | 3.56 | −1.92 | 1.79 |
| | b* | −0.75 | −2.09 | −5.76 | −5.84 | −17.52 | −14.05 | −4.28 |
| Chlori- | L* | 18.46 | 16.05 | 15.04 | 14.19 | 15.47 | 31.44 | 13.84 |

TABLE 13-continued

Dyeing with precursors p-phenylenediamine and m-phenylenediamine (pH-profile, 2 LACU/ml)

| | | pH 4 | pH 5 | pH 6 | pH 7 | pH 8 | pH 9 | pH 10 |
|---|---|---|---|---|---|---|---|---|
| nated Wool | a* | 2.32 | 1.01 | 0.88 | 1.83 | 2.78 | −3.05 | 2.97 |
| | b* | 0.09 | 0.87 | 1.03 | 1.53 | −11.43 | −13.27 | 2.06 |

TABLE 14

Dyeing with precursors p-phenylenediamine and m-phenylenediamine (Dosing profile - pH 7)

| | | 0 LACU/mL | 1 LACU/mL | 4 LACU/mL |
|---|---|---|---|---|
| Worsted Wool | L* | 54.97 | 14.52 | 14.27 |
| | a* | 1.48 | 1.55 | 1.49 |
| | b* | 1.26 | −6.09 | −5.6 |
| Chlorinated Wool | L* | 43.2 | 14.42 | 14.33 |
| | a* | 1.79 | 1.75 | 1.69 |
| | b* | 1.61 | 1.5 | 1.65 |

TABLE 15

Dyeing with precursors o-aminophenol and m-phenylenediamine (pH-profile, 2 LACU/ml)

| | | pH 4 | pH 5 | pH 6 | pH 7 | pH 8 | pH 9 | pH 10 |
|---|---|---|---|---|---|---|---|---|
| Worsted Wool | L* | 33.68 | 33.05 | 35.96 | 37.42 | 42.55 | 59.24 | 49.65 |
| | a* | 3.77 | 5.35 | 8.56 | 10.07 | 8.75 | 10.53 | 8.63 |
| | b* | 8.26 | 11.03 | 18.83 | 22.33 | 22.82 | 37.2 | 34.81 |
| Chlorinated Wool | L* | 21.07 | 19.11 | 21.01 | 24.7 | 34.42 | 59.9 | 48.74 |
| | a* | 3.14 | 2.77 | 4.82 | 7.22 | 6.88 | 10.08 | 10.4 |
| | b* | 4.23 | 4.31 | 8.04 | 12.64 | 18.08 | 36.78 | 34.76 |

TABLE 16

Dyeing with precursors o-aminophenol and m-phenylenediamine (Dosing profile - pH 7)

| | | 0 LACU/mL | 1 LACU/mL | 4 LACU/mL |
|---|---|---|---|---|
| Worsted Wool | L* | 80.23 | 38.57 | 36.18 |
| | a* | 1.1 | 9.21 | 10.8 |
| | b* | 20.09 | 21.33 | 22.76 |
| Chlorinated Wool | L* | 77.36 | 27.1 | 26.33 |
| | a* | 0.86 | 7.92 | 6.92 |
| | b* | 19.53 | 14.8 | 13.5 |

The results show that worsted wool and chlorinated worsted wool were dyed at all pH's, with strong shades ranging from gray at low pH to marine blue and black at high pH with the combination of p-phenylenediamine and m-phenylenediamine and shades from brown at low pH to orange/yellow at high pH with the combination of o-aminophenol and m-phenylenediamine.

In all dosing experiments, no notable difference was seen from dosing 1, 2 or 4 LACU/ml. The control experiment with 0 LACU/ml clearly demonstrates that dyeing is catalyzed by the laccase.

EXAMPLE 3

The time profile for dyeing was determined using the procedure described in Example 2 except the experiments were conducted only at pH 5.0 and 8.0 over time intervals of 0, 5, 15, 35 and 55 minutes. In each experiment, 2

LACU/ml of the *Myceliophthora thermophila* laccase was added. The results are shown in Tables 17–20.

TABLE 17

Dyeing with precursors p-phenylenediamine and m-phenylenediamine Time profile, 2 LACU/ml, pH 5

| | | 0 min | 5 min | 15 min | 35 min | 55 min |
|---|---|---|---|---|---|---|
| Worsted | L* | 76.48 | 52.08 | 36.3 | 27.02 | 26.56 |
| Wool | a* | 0.02 | 1.35 | 1.96 | 1.3 | 1.18 |
| | b* | 8 | −0.02 | −1.39 | −1.68 | −2.03 |
| Chlorinated | L* | 63.73 | 19.23 | 16.81 | 16.48 | 16.75 |
| Wool | a* | 0.1 | 1.86 | 1.28 | 0.77 | 1.11 |
| | b* | 10.3 | −0.68 | 0.49 | 1.04 | 1.03 |

TABLE 18

Dyeing with precursors p-phenylenediamine and m-phenylenediamine Time profile, 2 LACU/ml, pH 8

| | | 0 min | 5 min | 15 min | 35 min | 55 min |
|---|---|---|---|---|---|---|
| Worsted | L* | 64.43 | 23.66 | 14.57 | 13.11 | 13.06 |
| Wool | a* | −3.03 | 1.05 | 2.14 | 1.49 | 1.2 |
| | b* | −3.32 | −15.45 | −8.72 | −4.52 | −3.68 |
| Chlorinated | L* | 58.96 | 17.36 | 14.09 | 13.89 | 13.66 |
| Wool | a* | −1.66 | 0.57 | 1.9 | 2.71 | 2.64 |
| | b* | 2.68 | −3.98 | 0.14 | 2.21 | 1.99 |

TABLE 19

Dyeing with precursors o-aminophenol and m-phenylenediamine Time profile, 2 LACU/ml, pH 5

| | | 0 min | 5 min | 15 min | 35 min | 55 min |
|---|---|---|---|---|---|---|
| Worsted | L* | 79.4 | 50.67 | 35.94 | 32.4 | 32.89 |
| Wool | a* | 1.54 | 6.47 | 7.11 | 6.08 | 5.98 |
| | b* | 16.02 | 20.88 | 18.43 | 14.28 | 12.52 |
| Chlorinated | L* | 76.72 | 39.53 | 22.12 | 18.82 | 19.58 |
| Wool | a* | 2.33 | 6.81 | 4.21 | 2.88 | 3.1 |
| | b* | 18.26 | 16.48 | 8.23 | 4.89 | 4.77 |

TABLE 20

Dyeing with precursors o-aminophenol and m-phenylenediamine Time profile, 2 LACU/ml, pH 8

| | | 0 min | 5 min | 15 min | 35 min | 55 min |
|---|---|---|---|---|---|---|
| Worsted | L* | 80.06 | 63.03 | 49.37 | 42.51 | 41.24 |
| Wool | a* | 1.63 | 15.71 | 17.1 | 12.32 | 9.97 |
| | b* | 25.87 | 43.37 | 38.69 | 30.26 | 25.78 |
| Chlorinated | L* | 79.6 | 62.87 | 47.88 | 36.72 | 33.62 |
| Wool | a* | 0.57 | 13.17 | 14.46 | 10.26 | 7.88 |
| | b* | 24.63 | 41.64 | 34.34 | 24.47 | 19.7 |

The results show that most of the color forms within the first 15 minutes. Worsted wool and chlorinated worsted wool were dyed at both pH's.

EXAMPLE 4

Wool was dyed in an Atlas Launder-O-Meter ("LOM") at 30° C. for one hour at pH 5.5. The material dyed (obtained from Test Fabrics, Inc.) was worsted wool (style 526, 8 cm×8 cm).

A 0.5 mg/ml solution of a first compound (p-phenylenediamine, "A") and a 0.5 mg/ml solution of a second compound (1-naphthol, "B") was prepared by dissolving the compound in the appropriate amount of 0.1 M $CH_3COONa$, pH 5.5, buffer. A total volume of 100 ml was used in each LOM beaker. 100 ml "A" was added to one beaker and 50 ml "A" and 50 ml "B" were combined to form 100 ml in a second beaker. Swatches of the materials listed above were wetted in DI water and soaked in the precursor solutions. A *Myceliophthora thermophila* laccase ("MtL") with an activity of 690 LACU/ml (80 LACU/mg) was added to each beaker at a concentration of 12.5 mg/l. The LOM beakers were sealed and mounted in the LOM. After 1 hour at 42 RPM and 30° C., the LOM was stopped. The spent liquor was poured off and the swatches were rinsed in cold tap water for about 15 minutes. The swatches were dried at room temperature and CIELAB values were measured for all of the swatches using the Macbeth ColorEye 7000. The results are given in Tables 21 and 22.

TABLE 21

Dyeing with precursor p-phenylenediamine (pH 5.5, 12.5 mg/l MtL)

| | L* | a* | b* |
|---|---|---|---|
| Wool | 30.93 | 61.66 | 10.10 |

TABLE 22

Dyeing with precursors p-phenylnediamine and 1-naphthol (pH 5.5, 12.5 mg/l MtL)

| | L* | a* | b* |
|---|---|---|---|
| Wool | 30.70 | 61.12 | −4.28 |

The results show that wool can be dyed (brown using A, purple using A/B) using precursor and *Myceliophthora thermophila* laccase.

EXAMPLE 5

Wool was dyed in an Atlas Launder-O-Meter ("LOM") at 30° C. for one hour at pH 5.5. The material dyed (obtained from Test Fabrics, Inc.) was worsted wool (style 526, 8 cm×8 cm).

A 0.5 mg/ml solution of a first compound (p-phenylenediamine, "A") and a 0.5 mg/ml solution of a second compound (1-naphthol, "B") was prepared by dissolving the compound in the appropriate amount of 0.1 M $CH_3COONa$, pH 5.5, buffer. A total volume of 100 ml was used in each LOM beaker. 100 ml "A" was added to one beaker and 50 ml "A" and 50 ml "B" were combined to form 100 ml in a second beaker. Swatches of the materials listed above were wetted in DI water and soaked in the precursor solutions. A *Polyporus pinsitus* laccase ("PpL") with an activity of 70 LACU/ml (100 LACU/mg) was added to each beaker at a concentration of 12.5 mg/l. The LOM beakers were sealed and mounted in the LOM. After 1 hour at 42 RPM and 30° C., the LOM was stopped. The spent liquor was poured off and the swatches were rinsed in cold tap water for about 15 minutes. The swatches were dried at room temperature CIELAB values were measured for all of the swatches using the Macbeth ColorEye 7000. The results are given in Tables 23 and 24.

TABLE 23

| Dyeing with precursor p-phenylenediamine (pH 5.5, 12.5 mg/l PpL) | | | |
|---|---|---|---|
| | L* | a* | b* |
| Wool | 36.06 | 70.46 | 8.49 |

TABLE 24

| Dyeing with precursors p-phenylenediamine and 1-naphthol (pH 5.5, 12.5 mg/l PpL) | | | |
|---|---|---|---|
| | L* | a* | b* |
| Wool | 37.92 | 58.71 | −2.23 |

The results show that wool can be dyed (brown using A, purple using A/B) using precursor and *Polyporous pinsitus* laccase.

EXAMPLE 6

Wool was dyed in an Atlas Launder-O-Meter ("LOM") at 30° C. for one hour at pH 5.5. The material dyed (obtained from Test Fabrics, Inc.) was worsted wool (style 526, 8 cm×8 cm).

A 0.5 mg/ml solution of a first compound (p-phenylenediamine, "A") and a 0.5 mg/ml solution of a second compound (1-naphthol, "B") was prepared by dissolving the compound in the appropriate amount of 0.1 M $CH_3COONa$, pH 5.5, buffer. A total volume of 100 ml was used in each LOM beaker. 100 ml "A" was added to one beaker and 50 ml "A" and 50 ml "B" were combined to form 100 ml in a second beaker. Swatches of the materials listed above were wetted in DI water and soaked in the precursor solutions. A *Myrothecium verrucaria* bilirubin oxidase ("BiO") with an activity of 0.04 LACU/mg (1 mg/ml) was added to each beaker at a concentration of 12.5 mg/l. The LOM beakers were sealed and mounted in the LOM. After 1 hour at 42 RPM and 30° C., the LOM was stopped. The spent liquor was poured off and the swatches were rinsed in cold tap water for about 15 minutes. The swatches were dried at room temperature and CIELAB values were measured for all of the swatches using the Macbeth ColorEye 7000. The results are given in Tables 25 and 26.

TABLE 25

| Dyeing with precursor p-phenylenediamine | | | |
|---|---|---|---|
| | L* | a* | b* |
| Wool | 27.54 | 80.84 | −2.13 |

TABLE 26

| Dyeing with precursors p-phenylenediamine and 1-naphthol | | | |
|---|---|---|---|
| | L* | a* | b* |
| Wool | 40.21 | 87.73 | −13.47 |

The results show that wool can be dyed (brown using A, purple using A/B) using precursor and bilirubin oxidase.

EXAMPLE 7

Wool was dyed in an Atlas Launder-O-Meter ("LOM") at 30° C. for one hour at pH 5.5. The material dyed (obtained from Test Fabrics, Inc.) was worsted wool (style 526, 8 cm×8 cm).

A 0.5 mg/ml solution of a first compound (p-phenylenediamine, "A") and a 0.5 mg/ml solution of a second compound (1-naphthol, "B") was prepared by dissolving the compound in the appropriate amount of 0.1 M $CH_3COONa$, pH 5.5, buffer. A total volume of 100 ml was used in each LOM beaker. 100 ml "A" was added to one beaker and 50 ml "A" and 50 ml "B" were combined to form 100 ml in a second beaker. Swatches of the materials listed above were wetted in DI water and soaked in the precursor solutions. A *Rhizoctonia solani* laccase ("RsL") with an activity of 5.2 LACU/ml (2 mg/ml) was added to each beaker at a concentration of 12.5 mg/l. The LOM beakers were sealed and mounted in the LOM. After 1 hour at 42 RPM and 30° C., the LOM was stopped. The spent liquor was poured off and the swatches were rinsed in cold tap water for about 15 minutes. The swatches were dried at room temperature and CIEL*a*b* values were measured for all of the swatches using the Macbeth ColorEye 7000. The results are given in Tables 27 and 28.

TABLE 27

| Dyeing with precursor p-phenylenediamine (pH 5.5, 12.5 mg/l RsL) | | | |
|---|---|---|---|
| | L* | a* | b* |
| Wool | 27.89 | 58.97 | 1.59 |

TABLE 28

| Dyeing with precursors p-phenylnediamine and 1-naphthol (pH 5.5, 12.5 mg/l RsL) | | | |
|---|---|---|---|
| | L* | a* | b* |
| Wool | 29.03 | 63.94 | −3.65 |

The results show that wool can be dyed (brown using A, purple using A/B) using precursor and *Rhizoctonia solani* laccase.

EXAMPLE 8

The material dyed (obtained from Test Fabrics Inc.) was Wool (Style 526, 8 cm×8 cm) in an Atlas Launder-O-Meter ("LOM") at 60° C. and pH 5.5.

A 0.25 mg/ml solution of a first compound (p-phenylenediamine, "A") and a 0.25 mg/ml solution of a second compound (2-aminophenol, "B") were prepared by dissolving the compound in the appropriate amount of a 2 g/L $CH_3COONa$, pH 5.5, buffer. A total volume of 100 ml was used in each LOM beaker. 50 ml "A" and 50 ml "B" were combined to form 100 ml in an LOM beaker. Swatches of the material listed above were wetted in DI water and soaked in the precursor solutions. The LOM beakers were sealed and mounted in the LOM. After a 10, 15, or 30 minute incubation time in the LOM (42 RPM), the LOM was stopped and a *Myceliophthora thermophila* laccase ("MtL") with an activity of 690 LACU/ml (80 LACU/mg) was added to each beaker at a concentration of 1 LACU/ml. After 50, 45 or 30 minutes at 42 RPM and 60° C., the LOM was stopped and the sample was removed. Two controls without preincubation were made by adding the precursor solution, swatches, and enzyme to LOM beakers. The beakers were mounted in the LOM. After 30 minutes at 42 RPM and 60° C., one beaker was removed. The other control was run for a total of 60 minutes at 42 RPM and 60° C. and then removed. The spent liquor was poured off the samples and the swatches were rinsed in cold tap water for about 15 minutes. The swatches were dried at room temperature and CIELAB values were measured for all of the swatches using the Macbeth ColorEye 7000. The results are given in Tables 29–33.

TABLE 29

Control Dyeing with precursors A and B, 0 min./30 min.

| | L* | a* | b* |
|---|---|---|---|
| Wool | 36.26 | 2.01 | 7.28 |

TABLE 30

Control Dyeing with precursors A and B, 0 min./60 min.

| | L* | a* | b* |
|---|---|---|---|
| Wool | 36.49 | 2.28 | 7.42 |

TABLE 31

Dyeing with precursors A and B, 10 min./50 min.

| | L* | a* | b* |
|---|---|---|---|
| Wool | 32.95 | 2.41 | 10.16 |

TABLE 32

Dyeing with precursors A and B, 15 min./45 min.

| | L* | a* | b* |
|---|---|---|---|
| Wool | 33.20 | 2.65 | 10.80 |

TABLE 33

Dyeing with precursors A and B, 30 min./30 min.

| | L* | a* | b* |
|---|---|---|---|
| Wool | 33.45 | 2.87 | 11.59 |

The colorfastness to laundering (washfastness) for these swatches was evaluated using the American Association of Textile Chemist and Colorist (AATCC) Test Method 61-1989, 2A. The Launder-O-Meter was preheated to 49° C. and 200 ml 0.2% AATCC Standard Reference Detergent WOB (without optical brightener) and 50 steel balls were placed in each LOM beaker. The beakers were sealed and mounted in the LOM and run at 42 RPM for 2 minutes to preheat the beakers to the test temperature. The rotor was stopped and the beakers were unclamped. The swatches were added to the beakers and the LOM was run for 45 minutes. The beakers were removed and the swatches rinsed in hot tap water for 5 minutes, with occasional squeezing. The swatches were then dried at room temperature and evaluated by the Macbeth ColorEye 7000. A gray scale rating (1–5) was assigned to each swatch using the AATCC Evaluation Procedure 1, Gray Scale for Color Change. The results are given in Tables 34–38.

TABLE 34

Washfastness Results for A and B, 0 min./30 min.

| | L* | a* | b* | Gray Scale Rating |
|---|---|---|---|---|
| Wool | 40.10 | 2.06 | 3.53 | 3 |

TABLE 35

Washfastness Results for A and B, 0 min./60 min.

| | L* | a* | b* | Gray Scale Rating |
|---|---|---|---|---|
| Wool | 39.93 | 2.27 | 4.25 | 3 |

TABLE 36

Washfastness Results for A and B, 15 min./45 min.

| | L* | a* | b* | Gray Scale Rating |
|---|---|---|---|---|
| Wool | 36.02 | 2.70 | 4.93 | 3–4 |

TABLE 37

Washfastness Results for A and B, 10 min./50 min.

| | L* | a* | b* | Gray Scale Rating |
|---|---|---|---|---|
| Wool | 35.09 | 2.62 | 4.45 | 4 |

TABLE 38

Washfastness Results for A and B, 30 min./30 min.

| | L* | a* | b* | Gray Scale Rating |
|---|---|---|---|---|
| Wool | 35.86 | 2.89 | 5.38 | 4 |

The results show that wool can be dyed using precursor and *Myceliophthora thermophila* laccase. Both from the L* and the gray scale rating, it is evident that color intensity and washfastness are improved by incubating the swatches in the precursor solution before adding the enzyme.

EXAMPLE 9

The materials dyed (all obtained from Test Fabrics Inc.) were worsted wool (Style 526, 7 cm×7 cm) and chlorinated worsted wool (Style 530, 7 cm×7 cm) in an Atlas Launder-O-Meter ("LOM") at 40° C. for one hour at a pH 5.5.

Two mediators were evaluated in this experiment and each was dissolved in a buffer solution. Three buffer solutions were made: a 2 g/L $CH_3COONa$, pH 5.5, buffer ("1"), a 2 g/L $CH_3COONa$, pH 5.5, buffer containing 100 μM 10-propionic acid-phenothiazine (PPT) ("2∞), and a 2 g/L $CH_3COONa$, pH 5.5, buffer containing 100 μM methyl syringate ("3").

Three 0.25 mg/ml solutions of a first compound (p-phenylenediamine, "A") and three 0.25 mg/ml solutions of a second compound (m-phenylenediamine, "B") were prepared by dissolving the compound in the appropriate amount of buffer (1, 2 or 3). A total volume of 120 ml was used in each LOM beaker. 60 ml of A and 60 ml of B were combined to form 120 ml (for each buffer: 1, 2, or 3).

Swatches of the materials listed above were wetted in DI water and soaked in the precursor solutions. The LOM beakers were sealed and mounted in the LOM. After 10 minutes at 42 RPM and 40° C., the LOM was stopped. A *Myceliophthora thermophila* laccase ("MtL") with an activity of 690 LACU/ml (80 LACU/mg) was added to each beaker at an activity of 0.174 LACU/ml. The beakers were once again sealed and mounted in LOM and run (42 RPM) for 50 minutes at 40° C. The beakers were removed and the spent liquor was poured off and the swatches were rinsed in cold tap water for about 15 minutes. The swatches were dried at room temperature and CIELAB values were measured for all of the swatches using the Macbeth ColorEye 7000. The results are given in Tables 39–41.

TABLE 39

Dyeing with precursors A and B (2 g/L $CH_3COONa$, pH 5.5, MtL)

| | L* | a* | b * |
|---|---|---|---|
| Wool | 47.93 | 0.45 | −0.05 |
| Chlorinated Wool | 27.80 | 2.94 | −0.06 |

TABLE 40

Dyeing with precursors A and B (2 g/L $CH_3COONa$, pH 5.5, 100 μM PPT, MtL)

| | L* | a* | b * |
|---|---|---|---|
| Wool | 42.11 | 1.52 | −5.95 |
| Chlorinated Wool | 24.48 | 2.76 | −2.15 |

TABLE 41

Dyeing with precursors A and B 2 g/L $CH_3COONa$, pH 5.5, 100 μM methyl syringate, MtL)

| | L* | a* | b * |
|---|---|---|---|
| Wool | 47.83 | 0.99 | −0.14 |
| Chlorinated Wool | 25.77 | 3.37 | −0.99 |

The colorfastness to laundering (washfastness) for these swatches was evaluated using the American Association of Textile Chemist and Colorist (AATCC) Test Method 61-1989, 2A. A gray scale rating (1–5) was assigned to each swatch using the AATCC Evaluation Procedure 1, Gray Scale for Color Change. The results are given in Tables 42–44.

TABLE 42

Washfastness Results for precursors A and B (2 g/L $CH_3COONa$, pH 5.5, MtL)

| | L* | a* | b* | Gray Scale Rating |
|---|---|---|---|---|
| Wool | 50.59 | 1.11 | 7.07 | 3–4 |
| Chlorinated Wool | 31.74 | 2.83 | 7.09 | 3 |

TABLE 43

Washfastness results for precursors A and B (2 g/L $CH_3COONa$, pH 5.5, 100 μM PPT, MtL)

| | L* | a* | b* | Gray Scale Rating |
|---|---|---|---|---|
| Wool | 48.38 | −0.48 | 4.61 | 2–3 |
| Chlorinated Wool | 31.56 | 1.06 | 4.86 | 2 |

TABLE 44

Washfastness Results for precursors A and B (2 g/L $CH_3COONa$, pH 5.5, 100 μM methyl syringate, MtL)

| | L* | a* | b* | Gray Scale Rating |
|---|---|---|---|---|
| Wool | 52.02 | 0.06 | 6.59 | 3 |
| Chlorinated Wool | 32.17 | 2.02 | 6.08 | 2–3 |

The same experiment was repeated, except that a third compound (2-aminophenol, "C") and a fourth compound (m-phenylenediamine, "D") were used. The temperature used was 50° C. The results are given in Tables 45–50.

TABLE 45

Dyeing with precursors C and D (2 g/L $CH_3COONa$, pH 5.5, MtL)

| | L* | a* | b * |
|---|---|---|---|
| Wool | 53.52 | 5.92 | 18.19 |
| Chlorinated Wool | 47.79 | 4.73 | 17.08 |

TABLE 46

Dyeing with precursors C and D (2 g/L $CH_3COONa$, pH 5.5, 100 μM PPT, MtL)

| | L* | a* | b * |
|---|---|---|---|
| Wool | 52.38 | 6.70 | 21.84 |
| Chlorinated Wool | 46.86 | 5.55 | 17.87 |

TABLE 47

Dyeing with precursors C and D (2 g/L $CH_3COONa$, pH 5.5, 100 μM methyl syringate, MtL)

| | L* | a* | b * |
|---|---|---|---|
| Wool | 57.09 | 8.10 | 24.44 |
| Chlorinated Wool | 48.69 | 7.82 | 19.40 |

TABLE 48

Washfastness Results for precursors C and D (2 g/L $CH_3COONa$, pH 5.5, MtL)

| | L* | a* | b* | Gray Scale Rating |
|---|---|---|---|---|
| Wool | 57.38 | 7.23 | 10.97 | 3 |
| Chlorinated Wool | 51.35 | 7.04 | 13.16 | 3 |

TABLE 49

Washfastness results for precursors C and D
(2 g/L $CH_3COONa$, pH 5.5, 100 μM PPT, MtL)

| | L* | a* | b* | Gray Scale Rating |
|---|---|---|---|---|
| Wool | 51.37 | 8.18 | 12.33 | 5 |
| Chlorinated Wool | 46.86 | 5.55 | 17.87 | 2 |

TABLE 50

Washfastness Results for precursor C
(2 g/L $CH_3COONa$, pH 5.5, 100 μM methyl syringate, MtL)

| | L* | a* | b* | Gray Scale Rating |
|---|---|---|---|---|
| Wool | 59.61 | 7.24 | 11.89 | 4 |
| Chlorinated Wool | 50.01 | 7.94 | 14.38 | 4–5 |

The results from these two sets of experiments show that a chemical mediator that can transport electrons may be used for dyeing and for obtaining improved washfastness. In both experiments, worsted wool and chlorinated worsted wool were dyed at pH 5.5 in a $CH_3COONa$ buffer, in a $CH_3COONa$ buffer containing PPT, and in a $CH_3COONa$ buffer containing methyl syringate. However, a mediator resulted in improved washfastness only in the second experiment.

EXAMPLE 10

Wool was dyed in an Atlas Launder-O-Meter ("LOM") at 30° C. for one hour at pH 5.5. The material dyed (obtained from Test Fabrics, Inc.) was worsted wool (Style 526, 8 cm×8 cm).

A 0.5 mg/ml solution of a first compound (p-phenylenediamine, "A") and a 0.5 mg/ml solution of a second compound (1-naphthol, "B") was prepared by dissolving the compound in the appropriate amount of 0.1 M $CH_3COONa$, pH 5.5, buffer. A total volume of 100 ml was used in each LOM beaker. 100 ml "A" was added to one beaker and 50 ml "A" and 50 ml "B" were combined to form 100 ml in a second beaker. Swatches of the material listed above were then wetted in DI water and soaked in the precursor solutions. A *Coprinus cinereus* peroxidase (CiP) with an activity of 180,000 POXU/ml was added to each beaker at a concentration of 0.05 POXU/ml. Either 200 or 500 μM hydrogen peroxide was added to each LOM beaker. The LOM beakers were sealed and mounted in the LOM. After 1 hour at 42 RPM and 30° C., the LOM was stopped. The spent liquor was poured off and the swatches were rinsed in cold tap water for about 15 minutes. The swatches were dried at room temperature and CIELAB values were measured for all of the swatches using the Macbeth Color-Eye 7000. The results are given in Tables 51–54.

TABLE 51

Dyeing with precursor A, 200 μM $H_2O_2$

| | L* | a* | b* |
|---|---|---|---|
| Wool | 54.84 | 1.70 | −2.18 |

TABLE 52

Dyeing with precursor A, 500 μM $H_2O_2$

| | L* | a* | b* |
|---|---|---|---|
| Wool | 43.58 | 2.50 | −4.62 |

TABLE 53

Dyeing with precursors A and B, 200 μM $H_2O_2$

| | L* | a* | b* |
|---|---|---|---|
| Wool | 56.19 | 2.60 | −9.44 |

TABLE 54

Dyeing with precursors A and B, 500 μM $H_2O_2$

| | L* | a* | b* |
|---|---|---|---|
| Wool | 50.48 | 4.14 | −11.68 |

The results show that wool can be dyed (purple shades with A and A/B) using precursor, peroxide and *Coprinus cinereus* (CiP) peroxidase.

EXAMPLE 11

Chromed blue stock leather (Prime Tanning Corp., St. Joseph, Mo.) was dyed in a test tube at room temperature for 16 hours at pH 5, 7 and 9.

Three 0.5 mg/ml solutions of first compound (p-phenylenediamine, "A"), (pH 5, 7, and 9), three 0.5 mg/ml solutions of a second compound (1-naphthol, "B"), and three 0.5 mg/ml solutions of a third compound (4-hydroxycinnamic acid, "C") were prepared by dissolving each compound in the appropriate amount of 0.1 M Britten-Robinson Buffer (B-R buffer).

The leather substrate (1.5 cm×4 cm) was rolled up and placed in a four inch test tube. A total volume of 7 ml was used in each test tube. 6 ml of A (or 6 ml of C) was added to one test tube and 3 ml of A and 3 ml of B (or 3 ml of A and 3 ml of C) were combined to form 6 ml in a second test tube. A *Myceliophthora thermophila* laccase ("MtL") with an activity of 690 LACU/ml (80 LACU/mg) was added to each beaker at a concentration of 2 LACU/ml (1 ml enzyme solution added to each test tube to give a total of 7 ml per test tube). The test tubes were closed, mixed and mounted on a test tube rotator. The test tubes were incubated for 16 hours in a dark cabinet at room temperature. After incubation, the swatches were rinsed in running cold tap water for 1 minute and dried at room temperature.

The results of the experiments are provided in Table 55:

TABLE 55

| FABRIC | PRECURSOR | pH 5 | pH 7 | pH 9 |
|---|---|---|---|---|
| Leather | A | Purple | Brown | Brown |
| Leather | A/B | Dark Purple | Purple | Purple |
| Leather | C | Light Green | Green | Green |
| Leather | A/C | Light Brown | Light Brown | Light Brown |

These results demonstrate that colorant forms on leather in the presence of *Myceliophthora thermophila* laccase and different types of precursors over a range of pH conditions.

EXAMPLE 12

Silk was dyed in a test tube at ambient temperature for 16 hours at pH 5, 7 and 9. The material dyed (obtained from Test Fabrics, Inc.) was silk crepe de chine (Style 601, 1.5 cm×4 cm).

Three 0.5 mg/ml solutions of first compound (p-phenylenediamine, "A") (pH 5, 7, and 9) and three 0.5 mg/ml solutions of a second compound (1-naphthol, "B") were prepared by dissolving each compound in the appropriate amount of 0.1 M Britton-Robinson Buffer (B-R buffer).

The silk substrate was rolled up and placed in a four inch test tube. A total volume of 7 ml was used in each test tube. 6 ml of A was added to one test tube and 3 ml of A and 3 ml of B were combined to form 6 ml in a second test tube. A *Myceliophthora thermophila* laccase ("MtL") with an activity of 690 LACU/ml (80 LACU/mg) was added to each beaker at a concentration of 2 LACU/ml (1 ml enzyme solution added to each test tube to give a total of 7 ml per test tube). The test tubes were closed, mixed and mounted on a test tube rotator. The test tubes were incubated for 16 hours in a dark cabinet at room temperature. After incubation, the swatches were rinsed in running cold tap water for 1 minute and dried at room temperature. The results of the experiments are shown in Table 56.

TABLE 56

| FABRIC | PRECURSOR | pH 5 | pH 7 | pH 9 |
|---|---|---|---|---|
| Silk | A | Dark Brown | Dark Brown | Dark Purple |
| Silk | A/B | Dark Brown | Dark Brown | Dark Brown |

These results demonstrate that colorant forms on silk in the presence of *Myceliophthora thermophila* laccase and different types of precursors over a range of pH conditions.

EXAMPLE 13

A print paste is made by dissolving 5 mg/ml of paraphenylenediamine in 0.1 M sodium phosphate, pH 5.5, buffer and adding 2.5% gum arabic. The print paste is manually transferred to a wool fabric using a printing screen and a scraper. The portions of the fabric which are not to be printed are covered by a mask.

The fabric is then steamed for 10 minutes in a steam chamber and allowed to dry.

Color is developed by dipping the fabric into a 2 LACU/ml laccase solution followed by a one hour incubation.

EXAMPLE 14

A mono-, di- or polycyclic aromatic or heteroaromatic compound may be applied to the material by padding. For example, 0.5 mg/ml of p-phenylenediamine is dissolved in 500 ml of 0.1 M $K_2PO_4$, pH 7, buffer. A laccase is diluted in the same buffer. The p-phenylenediamine solution is padded on the material using a standard laboratory pad at 60° C. The fabric is steamed for 10 minutes. The steamed material may then be padded a second time with the enzyme solution. The dye is allowed to develop by incubating the swatches at 40° C. After incubation, the swatches are rinsed in running hot tap water for about 30 seconds.

EXAMPLE 15

Worsted wool fabric swatches (0.35 g; Style 526, TestFabrics, Inc., Box 26, West Pittston, Pa. 18643) were soaked for 5 minutes in a nonionic polyoxyethylene ether wetting agent (0.1% Diadavin UFN, Bayer, Pittsburgh, Pa. 15205-9741). One swatch of worsted wool was placed in a flask with 20 parts 0.1 M buffer (pH 5 or pH 8). Stock dye precursor and coupler solutions were prepared by dissolving compounds listed in Tables 1–8 in suitable solvents. A 10 mM total concentration was obtained in the bath by adding either a single precursor stock solution to give the 10 mM level, or by adding one stock precursor and one stock coupler solution at a one to one mole ratio to give the total 10 mM level. *Myceliophthora thermophilia* laccase was added to each flask at a 3.4 LAMU/mL level. Flasks were incubated for 60 minutes at 60° C. with gentle shaking. After incubation, swatches were rinsed for 1 minute in cold tap water, then air dried. Wool swatches were evaluated visually for color. Results are reported in Tables 57–70.

TABLE 57

Color on Wool for Laccase-treated Precursor Combinations at pH 5.

| | P3 | P5 | P19 | P75 | P79 | P83 |
|---|---|---|---|---|---|---|
| P3 | Dk. Brown | Grn./Brown | Gray Purple | Gray Br. | Brown | Maroon |
| P5 | | Brown Gray | Lt. Maroon | Gray | Dk. Gray | Rust Br. |
| P16 | Brown | Brown | Rust Red | Brown | Yel./Br. | Rust Br. |
| P17 | Brown | Br. Stain | Gray | Pink St. | Maroon | Dk. Brown |
| P19 | | | Brown | Gray | Gray | Dk. Red |
| P30 | Lt. Purple | Tan | Pk. Gray | Gray | Gray | Rust Red |
| P31 | Gray Pk. | Tan | Pk. Gray | Gray | Green | Pk. Brown |
| P32 | Brown | Lt. Br./Yel. | Mar. | Br./Green | Olive | Red |
| P46 | Brown | Dk. Brown | Brown | Dk. Br. | Brown | Dk. Brown |
| P74 | Pur./Red | Dk. Purple | Dk. Purple | Dk. Mar. | Maroon | Dk. Brown |
| P75 | | | | Dk. Brown | Gray | Brown |
| P78 | Brown | Dk. Green | Green | Dk. Gray | Gray | Dk. Brown |
| P79 | | | | | Dk. Brown | Purple |
| P80 | Lt. Br. | Orange | Brown | Br./Grn. | Grn./Br. | Rust Br. |
| P81 | Lt. Br. | Curry Yel. | Brown | Br./Grn. | Grn./Br. | Red |
| P83 | | | | | | Dk. Red/Br. |

TABLE 58

Color on Wool for Laccase-treated Precursor Combinations at pH 8.

| | P3 | P5 | P19 | P75 | P79 | P83 |
|---|---|---|---|---|---|---|
| P3 | Dk. Brown | Brown | Pur. Gray | Pur. Gray | Brown | Maroon |
| P5 | | Brown Gray | Pink | Purple | Blue | Rust Br. |
| P16 | Brown | Br. Yellow | Salmon | Brown | Brown | Brown |
| P17 | Olive | Stain | Pk. Gray | Yel./Br. | Red | Dk. Brown |
| P19 | | | Brown | Dk. Brown | Dk. Gray | Maroon |
| P30 | Lt. Purple | Lt. Tan | Pk. Gray | Brown | Pk. Brown | Rust Br. |
| P31 | Gray Pk. | Lt. Tan | Pk. Gray | Brown | Blue Gray | Pk. Brown |
| P32 | Brown | Lt. Br./Yel. | Red/Br. | Brown | Brown | Rust Br. |
| P46 | Brown | Brown | Brown | Brown | Gray | Brown |
| P74 | Dk. Br. | Dk. Purple | Dk. Pur/Br. | Dk. Brown | Dk. Gray | Dk. Brown |
| P75 | | | | Dk. Brown | Dk. Gray | Brown |
| P78 | Dk. Br. | Dk. Blue | Dk. Blue | Dk. Br/Blk. | Dk. Gray | Dk. Brown |
| P79 | | | | | Dk. Brown | Gray |
| P80 | Lt. Br. | Orange | Brown | Brown | Brown | Rust Br. |
| P81 | Lt. Br. | Curry Yel. | Brown | Brown | Gr./Br. | Rust Br. |
| P83 | | | | | | Dk. Red/Br. |

TABLE 59

Color on Wool for Laccase-treated Precursor Combinations at pH 5

| | P3 | P5 | P19 | P75 | P79* | P83 |
|---|---|---|---|---|---|---|
| P9 | Brown | Tan | Brown | Pk. Stain | Pk. Gray | Red |
| P10 | Br./Yel. | Tan | Olive | Br. Yel. | Br. Yel. | Brown |
| P11 | Lt. Brown | Tan | Brown | Gray St. | Pk. Gray | Red |
| P12 | Gray | Brown | Brown St. | Gray | Gray | Rust Red |
| P13 | Pk. Gray | Tan | Lt. Mar. | Green | Green | Wine Red |
| P14 | Pk. Gray | Tan | Lt. Mar. | Green | Purple | Red |
| P15 | Rust Br. | Tan | Lt. Mar. | Green | Lt. Gray | Red |
| P20 | Lt. Brown | Rust Br. | Br. St. | Gray | Olive | Rust Red |

TABLE 60

Color on Wool for Laccase-treated Precursor Combinations at pH 8

| | P3 | P5 | P19 | P75 | P79 | P83 |
|---|---|---|---|---|---|---|
| P9 | Olive | Lt. Tan | Olive | Pk. Stain | Pk. Stain | Pk. Gray |
| P10 | Tan | Lt. Olive | Gray | Br. Yel. | Tan | Pk. Gray |
| P11 | Brown | Lt. Tan | Tan | Pk. Stain | Pk. Stain | Pk. Brown |
| P12 | Brown | Yel./Br. | Tan | Gray St. | Gray | Olive |
| P13 | Pk. Gray | Lt. Tan | Pink | Blue | Teal | Dk. Pink |
| P14 | Blue | Tan | Pink | Br. Stain | Gray | Dk. Pink |
| P15 | Br. Yel. | Lt. Tan | Lt. Pink | Br. Stain | Lt. Orange | Pk. Br. |
| P20 | Lt. Brown | Gray Pk. | Br. Yel. | Brown | Lt. Brown | Lt. Brown |

TABLE 61

Color on Wool for Laccase-treated Precursor/Coupler Combinations at pH 5

| | P3 | P5 | P19 | P75 | P79* | P83 |
|---|---|---|---|---|---|---|
| P8 | Purple | Gray St. | Lt Purple | Blue | Blue | Red |
| P18 | Purple | Stain | Lt. Purple | Blue | Blue | Rust Red |
| P28 | Purple | Stain | Lt. Gray | Blue | Purple | Pink |
| P29 | Lt. Brown | Stain | Lt. Purple | Gray | Lt. Gray | Pk. Red |
| P33 | Gray | Br./Gray | Gray/Mar. | Gray | Gray St. | Rust Br. |
| P36 | Brown | Lt. B/Gray | Tan/Pk. | Brown | Gray | Rose Pk. |
| P37 | Purple | Salmon | Maroon | Blue | Turqs. | Wine Red |
| P38 | Olive | Olive | Olive | Green | Olive | Brown |
| P40 | Grn./Br. | Lt. Brown | Pur./Gray | Green | Lt. Green | Rose Pk. |
| P41 | Grn./Br. | Lt. Br./Grn. | Grn./Br. | Dk. Grn./Br. | Br./Green | Rose Pk. |
| P62 | Lt. Purple | Curry St. | Red/Br. | Gray st. | Green | Red |

TABLE 62

Color on Wool for Laccase-treated Precursor/Coupler Combinations at pH 8

| | P3 | P5 | P19 | P75 | P79* | P83 |
|---|---|---|---|---|---|---|
| P8 | Purple | Gray St. | Lt. Purple | Blue | Blue | Gray |
| P18 | Purple | Gray St. | Lt. Purple | Gray Blue | Blue | Lt. Pink |
| P28 | Lt. Purple | Stain | Lt. Gray | Gray | Blue | Pk. Br. |
| P29 | Brown | Lt. Tan | Pk. Gray | Br. Stain | Gray | Dk. Pink |
| P33 | Lt. Brown | Tan | Tan | Gray | Gray | Rust Br. |
| P36 | Lt. Brown | Gray | Lt. Brown | Brown | Dk. Gray | Lt. Brown |
| P37 | Purple | Lt. Salmon | Rose Pk. | Purple | Blue | Orange |
| P38 | Olive | Lt. Green | Tan | Olive | Olive | Brown |
| P40 | Brown | Lt. Green | Rose Pk. | Gray | Lt. Green | Rose Pk. |
| P41 | Grn./Br. | Lt. Green | Olive | Brown | Br./Green | Green |
| P62 | Dk. Brown | Br./Grn. | Rose Pk. | Dk. Brown | Green St. | Brown |

TABLE 63

Color on Wool for Laccase-treated Precursor/Coupler Combinations at pH 5

| | P3 | P5 | P19 | P75 | P79* | P83 |
|---|---|---|---|---|---|---|
| P35 | Brown | Lt. Br. Yel. | Maroon | Gray | Rose Pk. | Red |
| P44 | Brown | Lt. Br. St. | Maroon | Dk. Gray | Dk. Purple | Rose Pk. |
| P45 | Lt. Brown | Lt. Br. St. | Maroon | Dk. Gray | Gray | Red |
| P47 | Lt. Brown | Lt. Br. Sr. | Maroon | Dk. Gray | Gray | Red |
| P48 | Lt. Brown | Lt. Brown | Brown | Dk. Gray | Gray/Grn. | Red |
| P49 | Lt. Brown | Lt. Brown | Brown | Dk. Gray | Gray | Red |
| P50 | Lt. Brown | Lt. Brown | Brown | Dk. Gray | Gray | Red |
| P51 | Lt. Brown | Lt. Brown | Brown | Dk. Gray | Gray | Red |
| P63 | Brown | Pur./Gray | Rose Pk. | Br. St. | Lt. Gray | Red |
| P64 | Lt. Brown | Lt. Brown | Brown | Gray | Green | Wine Red |

TABLE 64

Color on Wool for Laccase-treated Precursor/Coupler Combinations at pH 8

| | P3 | P5 | P19 | P75 | P79* | P83 |
|---|---|---|---|---|---|---|
| P35 | Tan | Tan | Rose Pk. | Blue/Gray | Lt. Brown | Brown |
| P44 | Lt. Brown | Lt. Brown | Rose Pk. | Brown | Gray | Brown |
| P45 | Lt. Brown | Lt. Brown | Rose Pk. | Brown | Brown | Brown St. |
| P47 | Lt. Brown | Lt. Br./Yel. | Rose Pk. | Brown | Gray | Brown St. |
| P48 | Lt. Brown | Lt. Br. Yel. | Rose Pk. | Brown | Brown | Brown |
| P49 | Lt. Brown | Lt. Brown | Rose Pk. | Brown | Brown | Tan St. |
| P50 | Lt. Brown | Lt. Brown | Rose Pk. | Brown | Brown | Brown |
| P51 | Lt. Brown | Lt. Brown | Rose Pk. | Brown | Brown | Brown |
| P63 | Brown | Green | Rose Pk. | Brown | Brown St. | Brown |
| P64 | Olive | Tan | Lt. Brown | Brown | Green St. | Brown |

TABLE 65

Color on Wool for Laccase-treated Precursor/Coupler Combinations at pH 5

| | P3 | P5 | P19 | P75 | P79* | P83 |
|---|---|---|---|---|---|---|
| P34 | Dk. Purple | Lt. Brown | Maroon | Dk. Blue | Dk. Blue | Red |
| P39 | Lt. Purple | Rose Pk. | Lt. Purple | Blue | Blue | Red |
| P42* | Purple | Rose Pk. | Lt. Purple | Blue | Blue | Wine Red |
| P43 | Purple | Rose Pk. | Lt. Purple | Blue | Blue | Red |
| P53 | Tan | Rose Pk. | Rose Pk. | Br./Gray | Lt. Rose | Rose Pk. |
| P68 | Brown | Gray St. | Brown | Dk. Blue | Dk. Gray | Red/Br. |

TABLE 66

Color on Wool for Laccase-treated Precursor/Coupler Combinations at pH 8

| | P3 | P5 | P19 | P75 | P79* | P83 |
|---|---|---|---|---|---|---|
| P34 | Dk. Gray | Gray | Rose Pk. | Brown | Blue | Red |
| P39 | Purple | Lt. Br. Yel. | Pur./Rose | Blue | Blue | Wine Red |
| P42* | Purple | Tan | Maroon | Purple | Blue | Wine Red |
| P43 | Purple | Tan | Maroon | Purple | Blue | Red/Br. |
| P53 | Tan | Tan | Lt. Rose | Lt. Br. | Lt. Rose | Brown |
| P68 | Dk. Brown | Br. St. | Rose Pk. | Dk. Purple | Dk. Blue | Brown |

TABLE 67

Color on Wool for Laccase-treated Precursor/Coupler Combinations at pH 5

| | P3 | P5 | P19 | P75 | P79* | P83 |
|---|---|---|---|---|---|---|
| P98 | Lt. Brown | Tan | Brown | Br./Grn. | Gray | Red |
| P100 | Lt. Brown | Tan | Rose Pk. | Br./Grn. | Gray | Red |
| P101 | Lt. Brown | Lt. Brown | Rose Pk. | Br./Gray | Gray | Red |
| P102 | Br. St. | Tan | Brown | Green | Grn./Gray | Red |
| P103 | Brown | Lt. Curry | Brown | Br./Grn. | Grn./Gray | Red |
| P112 | Brown | Lt. Brown | Brown | Br./Grn. | Grn./Gray | Red |

TABLE 68

Color on Wool for Laccase-treated Precursor/Coupler Combinations at pH 8

| | P3 | P5 | P19 | P75 | P79* | P83 |
|---|---|---|---|---|---|---|
| P98 | Brown | Brown | Brown | Brown | Brown | Brown |
| P100 | Brown | Lt. Brown | Rose Pk. | Brown | Brown | Rust Br. |
| P101 | Brown | Lt. Brown | Rose Pk. | Brown | Brown | Rust Br. |
| P102 | Brown | Orange | Brown | Brown | Brown St. | Brown |
| P103 | Brown | Lt. Brown | Rose Pk. | Brown | Gray | Brown |
| P112 | Brown | Lt. Brown | Rose Pk. | Brown | Gray | Rose Pk. |

TABLE 69

Color on Wool for Laccase-treated Precursor/Coupler Combinations at pH 5

| | P3 | P5 | P19 | P75 | P79* | P83 |
|---|---|---|---|---|---|---|
| P104 | Brown | Lt. Brown | Brown | Dk. Gray | Grn./Gray | Red |
| P105 | Brown | Lt. Brown | Brown | Dk. Gray | Gray | Red |
| P120 | Lt. Purple | Lt. Brown | Curry Yel. | Green | Green | Brown |

TABLE 70

Color on Wool for Laccase-treated Precursor/Coupler Combinations at pH 8

| | P3 | P5 | P19 | P75 | P79* | P83 |
|---|---|---|---|---|---|---|
| P104 | Brown | Lt. Brown | Rose Pk. | Brown | Gray | Brown |
| P105 | Brown | Lt. Brown | Rose Pk. | Brown | Gray | Brown |
| P120 | Curry Yel. | Lt. Yel. | Lt. Rose | Lt. Gray | Green | Yel./Br. |

EXAMPLE 16

Chlorinated wool fabric swatches (5 g; Style 530, TestFabrics, Inc., Box 26, West Pittston, Pa. 18643) were soaked for 10 minutes in 1% o.w.f. of a commercial wetting agent (Intravon FW 75, Crompton & Knowles Colors Inc., Box 33188 Charlotte, N.C. 28233). Soaked wool swatches were placed in stainless steel containers with 20 parts 0.1 M Britton-Robinson buffer (pH 5) to which was added 2% o.w.f. of a dyeing auxiliary (Intratex CWR, Crompton & Knowles Colors Inc., Box 33188 Charlotte, N.C. 28233). Stock dye precursor and stock dye coupler solutions were prepared by dissolving compounds selected from the groups listed in Tables 1–8 in suitable solvents. A 10 mM total concentration was obtained in the bath by adding either a single precursor stock solution to give the 10 mM level, or by adding one stock precursor solution and one stock coupler solution at a one to one mole ratio to give the total 10 mM level. *Myceliophthora thermophilia* laccase was added to each test container at a 3.4 LAMU/mL level. Control treatments were made by adding an equivalent amount of buffer to the test container in place of the enzyme. Containers were sealed and rotated for 60 minutes at 60° C. in an Atlas Launder-O-Meter (Atlas Electronic Devices Company, Chicago, Ill. 60613). After treatment, swatches were rinsed in cold tap water, then air dried. Swatch color was evaluated visually and instrumentally. Dyed swatches were evaluated for color fastness with respect to wash fastness, light fastness, and crock fastness by standard methods as described previously. CIEL*a*b* color values for control and enzyme-treated swatches were measured on a Macbeth ColorEye 2000 (Macbeth, New Windsor, N.Y. 12553–6148) and are shown in Tables 71 and 72.

TABLE 71

CIE L*a*b* of Control and Enzymatic Dyed Chlorinated Wool.

| | | P75 | | | P78 | | | P79 | | | P1 | | |
|---|---|---|---|---|---|---|---|---|---|---|---|---|---|
| | Treatment | L* | a* | b* | L* | a* | b* | L* | a* | b* | L* | a* | b* |
| Prec. | Control | 55.14 | 1.05 | 18.87 | 58.95 | 0.34 | 11.23 | 71.92 | −0.87 | 9.85 | 68.79 | 0.35 | 15.00 |
| | Enz. | 17.08 | 0.44 | 0.88 | 15.54 | 1.78 | 1.32 | 16.24 | 0.81 | 1.03 | 15.74 | 1.38 | 2.85 |
| P5 | Control | 63.6 | −0.73 | 16.4 | 61.9 | −0.31 | 9.49 | 72.3 | −1.29 | 7.81 | 67.8 | 0.41 | 11.4 |
| | Enz. | 17.1 | 5.21 | −0.43 | 15.9 | 1.47 | −1.43 | 17.1 | −0.53 | −3.12 | 18.7 | 3.75 | 4.77 |
| P7 | Control | 43.4 | 3.95 | 13.3 | 58.8 | 1.267 | 12.1 | 57.5 | 3.70 | 14.9 | 62.9 | 1.68 | 13.6 |
| | Enz. | 15.3 | 0.90 | 0.41 | 16.6 | 2.20 | 1.15 | 16.1 | 1.75 | −1.96 | 18.0 | 4.94 | 5.22 |
| P8 | Control | 63.3 | −0.65 | 16.4 | 63.1 | 1.12 | 10.8 | 73.5 | −1.11 | 8.67 | 70.0 | −0.16 | 13.5 |
| | Enz. | 25.0 | −0.57 | 0.04 | 19.5 | 1.17 | −6.03 | 23.8 | −0.18 | −11.1 | 19.2 | 5.53 | 4.44 |
| P11 | Control | 59.8 | −1.01 | 13.5 | 50.7 | −8.19 | −1.24 | 66.5 | −5.94 | 3.85 | 53.7 | 1.76 | 1.62 |
| | Enz. | 22.3 | −0.92 | −9.02 | 20.1 | −2.89 | −6.29 | 28.3 | −7.56 | −4.92 | 16.1 | 3.552 | −2.72 |
| P17 | Control | 61.6 | 0.42 | 16.0 | 52.6 | 6.90 | 6.74 | 56.0 | 5.17 | 8.23 | 65.6 | 2.98 | 13.9 |
| | Enz. | 18.9 | 7.01 | 3.145 | 17.1 | 9.60 | −3.40 | 15.0 | 8.80 | −2.90 | 16.7 | 5.619 | 4.87 |
| P18 | Control | 61.3 | 0.29 | 15.4 | 56.9 | −5.32 | 4.10 | 67.2 | −5.26 | 5.34 | 52.8 | 2.17 | −0.09 |
| | Enz. | 24.4 | −1.94 | −10.7 | 20.1 | −2.13 | −9.96 | 24.4 | −6.32 | −5.90 | 15.8 | 4.389 | −5.18 |
| P29 | Control | 59.13 | 0.12 | 17.73 | 58.64 | 0.98 | 11.50 | 68.10 | 0.40 | 9.47 | 61.78 | 1.95 | 12.74 |
| | Enz. | 28.28 | 1.40 | 6.20 | 37.37 | 2.76 | 12.22 | 43.00 | 2.25 | 17.70 | 29.53 | 8.53 | 7.71 |
| P33 | Control | 54.82 | 0.01 | 14.64 | 36.64 | 2.00 | 4.27 | 49.15 | 2.33 | 6.50 | 40.29 | 2.44 | 8.10 |
| | Enz. | 23.94 | 5.00 | 4.41 | 30.89 | 4.69 | 6.28 | 25.40 | 3.79 | 5.56 | 26.82 | 7.27 | 9.97 |
| P37 | Control | 58.93 | 0.29 | 17.16 | 56.93 | −3.31 | 3.64 | 71.74 | −1.62 | 6.28 | 51.69 | 2.81 | 0.43 |
| | Enz. | 22.22 | −1.96 | −4.57 | 17.80 | −1.16 | −4.44 | 22.22 | −5.60 | −1.31 | 15.34 | 3.88 | −3.30 |
| P38 | Control | 50.56 | 1.51 | 15.57 | 27.81 | −4.41 | 5.78 | 38.33 | 0.53 | 4.17 | 30.88 | −3.49 | 9.37 |
| | Enz. | 22.84 | 4.09 | 8.55 | 27.39 | −4.30 | 9.49 | 25.98 | −0.94 | 10.18 | 21.58 | 0.93 | 8.18 |
| P39 | Control | 48.82 | −0.54 | 9.38 | 23.72 | −2.40 | −11.6 | 68.64 | −3.27 | 7.99 | 23.04 | 6.83 | −0.16 |
| | Enz. | 17.23 | 0.71 | −3.15 | 19.36 | −0.26 | −0.31 | 23.59 | −3.05 | −1.63 | 16.47 | 3.26 | −1.86 |
| P40 | Control | 62.75 | 0.42 | 18.79 | 59.64 | −0.01 | 9.95 | 69.67 | 0.04 | 8.70 | 65.17 | 0.82 | 13.57 |
| | Enz. | 23.63 | 2.27 | 6.08 | 27.09 | 0.92 | 6.62 | 26.97 | 0.09 | 5.63 | 25.74 | 8.55 | 8.48 |
| P41 | Control | 52.36 | 0.40 | 14.83 | 35.89 | −0.76 | 2.60 | 50.82 | −1.66 | 4.65 | 42.61 | 1.00 | 9.73 |
| | Enz. | 14.92 | 1.77 | 2.00 | 19.78 | 1.52 | 8.31 | 17.63 | −0.87 | 5.58 | 18.58 | 2.54 | 6.91 |
| P42 | Control | 57.14 | −0.03 | 16.59 | 35.70 | −5.09 | −6.03 | 66.76 | −0.71 | 8.18 | 51.73 | 2.49 | 5.97 |
| | Enz. | 16.39 | −1.05 | −5.22 | 19.36 | −3.87 | −6.29 | 24.90 | −9.23 | −3.95 | 20.72 | 4.89 | −1.88 |
| P43 | Control | 59.12 | 0.43 | 17.55 | 27.92 | −4.14 | −6.64 | 58.86 | −1.95 | 5.78 | 41.46 | 3.53 | 2.72 |
| | Enz. | 16.41 | 0.32 | −6.25 | 20.75 | −4.28 | −6.27 | 26.01 | −9.49 | −3.75 | 21.99 | 4.47 | −2.16 |
| P70 | Control | 63.6 | −0.34 | 17.5 | 66.1 | 0.07 | 13.2 | 73.7 | −1.18 | 8.52 | 71.0 | −0.56 | 13.8 |
| | Enz. | 17.7 | 6.39 | 3.11 | 19.9 | 2.79 | 3.12 | 19.7 | 2.79 | 3.243 | 19.4 | 5.65 | 5.49 |
| P127 | Control | 61.9 | −0.55 | 17.6 | 58.3 | −3.44 | 7.90 | 71.4 | −3.52 | 9.04 | 65.0 | −1.07 | 8.99 |
| | Enz. | 14.9 | −0.55 | −1.76 | 17.8 | −4.90 | −0.68 | 18.2 | −9.67 | −5.06 | 15.6 | 1.16 | −0.15 |
| P202 | Control | 63.3 | −0.22 | 17.5 | 64.9 | 0.50 | 13.5 | 73.7 | −0.98 | 8.68 | 70.7 | −0.28 | 13.6 |
| | Enz. | 16.0 | 5.62 | 2.08 | 15.9 | 7.98 | −0.20 | 14.53 | 7.2 | −1.60 | 19.4 | 14.4 | 9.22 |

TABLE 72

CIE L*a*b* of Control and Enzymatic Dyed Chlorinated Wool

| | | P203 | | | P236 | | | P182 | | |
|---|---|---|---|---|---|---|---|---|---|---|
| | Treatment | L* | a* | b* | L* | a* | b* | L* | a* | b* |
| Prec. | Control | 66.77 | 2.24 | 9.65 | 34.52 | 22.72 | 30.24 | 57.85 | 0.92 | 9.54 |
| | Enz. | 28.41 | 15.15 | 16.09 | 27.16 | 17.84 | 21.41 | 16.30 | 7.40 | 4.79 |
| P5 | Control | 69.1 | −0.90 | 9.93 | 41.5 | 21.4 | 33.6 | 63.5 | −0.48 | 8.46 |
| | Enz. | 24.3 | 6.29 | 8.94 | 23.3 | 13.9 | 15.0 | 18.9 | 0.43 | 3.51 |
| P7 | Control | 56.8 | 3.36 | 13.6 | 39.5 | 21.6 | 32.8 | 55.9 | 2.28 | 12.5 |
| | Enz. | 31.6 | 15.6 | 12.6 | 26.6 | 11.9 | 17.8 | 17.9 | 3.52 | −0.51 |
| P8 | Control | 67.4 | 1.58 | 5.92 | 42.1 | 21.2 | 33.5 | 65.6 | 0.28 | 8.30 |
| | Enz. | 17.3 | 5.92 | −4.73 | 22.9 | 16.7 | 12.8 | 14.4 | 3.26 | −8.41 |
| P11 | Control | 69.9 | −0.12 | 10.9 | 40.5 | 22.3 | 33.7 | 64.8 | −0.39 | 9.16 |
| | Enz. | 31.3 | 9.77 | 15.2 | 35.2 | 17.4 | 30.8 | 22.4 | 12.6 | 9.05 |
| P17 | Control | 59.4 | 14.9 | 8.07 | 39.8 | 21.0 | 30.9 | 60.1 | 2.46 | 7.46 |
| | Enz. | 17.7 | 14.8 | 3.46 | 32.5 | 15.0 | 23.5 | 16.2 | 10.1 | −0.54 |
| P18 | Control | 64.6 | 2.36 | 4.36 | 40.9 | 21.4 | 33.1 | 64.6 | 0.06 | 10.3 |
| | Enz. | 16.4 | 5.14 | −4.28 | 22.1 | 16.1 | 12.1 | 14.4 | 2.62 | −6.48 |
| P29 | Control | 69.56 | 0.70 | 10.37 | 43.00 | 21.50 | 33.86 | 63.23 | −0.35 | 11.43 |
| | Enz. | 31.16 | 8.71 | −0.56 | 35.39 | 18.84 | 28.37 | 27.98 | 5.93 | 4.51 |
| P33 | Control | 54.42 | 0.39 | 5.91 | 41.45 | 19.16 | 30.59 | 53.35 | −0.99 | 6.48 |
| | Enz. | 35.38 | 8.11 | 18.00 | 37.83 | 19.48 | 31.77 | 28.55 | 9.77 | 8.62 |
| P37 | Control | 67.35 | 1.35 | 6.52 | 41.62 | 22.21 | 34.34 | 63.05 | −0.52 | 9.46 |
| | Enz. | 19.01 | 6.40 | −4.68 | 25.50 | 18.39 | 16.48 | 15.28 | 3.73 | −5.09 |
| P38 | Control | 58.42 | 3.24 | 8.75 | 38.38 | 18.81 | 29.23 | 52.52 | 3.05 | 4.89 |
| | Enz. | 34.35 | 11.79 | 24.26 | 32.69 | 17.66 | 27.43 | 25.40 | 11.39 | 14.39 |
| P39 | Control | 67.87 | −0.14 | 8.94 | 40.29 | 21.57 | 33.21 | 60.33 | 1.01 | 7.38 |

TABLE 72-continued

CIE L*a*b* of Control and Enzymatic Dyed Chlorinated Wool

| | | P203 | | | P236 | | | P182 | | |
|---|---|---|---|---|---|---|---|---|---|---|
| | Treatment | L* | a* | b* | L* | a* | b* | L* | a* | b* |
| | Enz. | 21.54 | 7.28 | −1.65 | 24.51 | 18.72 | 15.29 | 16.23 | 2.74 | −5.47 |
| P40 | Control | 70.98 | 0.23 | 10.62 | 42.39 | 21.13 | 33.85 | 63.35 | 0.07 | 10.90 |
| | Enz. | 35.01 | 12.54 | 13.67 | 34.92 | 20.80 | 29.35 | 23.51 | 9.96 | 9.28 |
| P41 | Control | 54.47 | 3.72 | 5.51 | 39.92 | 19.47 | 31.13 | 50.76 | 1.83 | 4.89 |
| | Enz. | 25.11 | 11.31 | 16.41 | 22.08 | 12.57 | 14.18 | 17.62 | 6.34 | 6.19 |
| P42 | Control | 69.57 | 0.76 | 9.31 | 39.67 | 22.17 | 33.48 | 65.73 | −0.84 | 9.03 |
| | Enz. | 20.53 | 4.65 | −8.78 | 24.52 | 18.91 | 14.32 | 16.82 | 1.92 | −12.0 |
| P43 | Control | 69.23 | 1.01 | 9.50 | 40.52 | 22.22 | 33.64 | 64.67 | 0.02 | 8.98 |
| | Enz. | 20.90 | 4.51 | −9.18 | 24.91 | 17.83 | 14.23 | 16.44 | 2.17 | 41.7 |
| P70 | Control | 69.3 | −0.62 | 11.0 | 40.9 | 21.5 | 33.2 | 65.2 | −0.51 | 9.70 |
| | Enz. | 26.2 | 10.6 | 11.5 | 31.4 | 17.8 | 26.4 | 17.8 | −1.47 | −2.35 |
| P127 | Control | 69.3 | −0.91 | 9.60 | 42.0 | 21.8 | 34.2 | 64.2 | −0.43 | 9.73 |
| | Enz. | 16.7 | −0.52 | −1.94 | 21.3 | 6.67 | 10.4 | 19.4 | −1.87 | −2.15 |
| P202 | Control | 71.4 | 0.61 | 11.4 | 40.9 | 22.3 | 34.0 | 65.2 | −0.45 | 10.0 |
| | Enz. | 30.1 | 25.5 | 18.6 | 47.4 | 17.8 | 34.8 | 15.4 | 7.79 | 0.15 |

L* is a measure of the lightness of a color. Therefore, a high L* value corresponds to a lighter color, whereas a low L* value corresponds to a darker color. In the current invention, a darker color (lower L*) compared to the control is preferred. In each case, the results show that the control treatment produced a lighter (higher L*) color than the corresponding enzyme treatment. This demonstrates the importance of the enzyme in catalyzing the color-forming reaction. This is particularly important in cases where the difference between the L* of the control and the L* of the enzyme treatment is large. The CIEL*a*b*. of untreated chlorinated wool was L* 88.5, a* −0.86, b* 15.7, which corresponds to a pale off-white color.

Visual color and color fastness results for enzyme-treated samples are shown in Table 73. Wash fastness (W), light fastness (L), and dry and wet crock fastness (C) were measured as described previously, and are reported on a scale from 1 (worst) to 5 (best). Two instruments, a Suntest CPS+ and an Atlas Weather-O-Meter, were used for light exposure of light fastness samples. Both results are reported. Dry and wet crock fastness were evaluated visually by a single observer.

A normalized measure of the difference in depth of color between the control and enzyme treated swatches was defined as the activation ratio (AR), equation (1).

$$AR=(L^* \text{ control}-L^* \text{ enzyme})/L^* \text{ enzyme} \qquad \text{Eqn.(1)}$$

A high activation ratio is obtained when the dyeing system remains essentially colorless unless enzyme is added. Dyeing systems with a low activation ratio either produce no or limited color (even in the presence of enzyme), or produce nearly the same level of color without enzyme (by auto-oxidation) as with enzyme.

In the present invention, dyeing systems that give dark colors with high activation ratios are preferred because these systems are more stable and easy to handle and package than dyeing systems giving dark colors, but with low activation ratios for the given experimental conditions. An activation ratio (AR) greater than 1 indicates a distinct difference between the depth of color on the control versus the enzyme-treated fabric, and typically indicates that little to no color has formed on the fabric in the control treatment.

In the present invention, most preferred dyeing systems are those that give high activation ratios combined with good color fastness properties and ease of chemical handling.

Chemical handling is improved by substituting precursor or coupler compounds with solubilizing functional groups that allow easy dissolution of the compounds in aqueous dyebaths, and that can contribute to increased affinity between the dye product and the material being dyed. Examples of anionic solubilizing groups are sulfonic acid or salts of sulfonic acid and carboxylic acid or salts of carboxylic acid. Examples of cationic solubilizing groups are quaternary ammonium groups. The presence of anionic solubilizing groups contributes to enhanced affinity of the dye product for materials with cationic charge, such as nylon, wool, silk, leather, and cationic polysaccharides. The presence of cationic solubilizing groups contributes to enhanced affinity of the dye product for materials with anionic charge, such as polyacrylic.

TABLE 73

Color Properties of Enzymatic Dyed Chlorinated Wool.

| | P75 | P78 | P79 | P1 | P203 | P236 | P182 |
|---|---|---|---|---|---|---|---|
| Prec. | black | dk brown | black | dk brown | brown | brown | dk brown |
| alone | AR 2.23 | AR 2.79 | AR 3.43 | AR 3.37 | AR 1.35 | AR 0.27 | AR 2.55 |
| | W 3 | W 3 | W 2-3 | W 2 | W 1 | W 2 | W 1-2 |
| | L 4-5/4-5 | L 4-5/4-5 | L 2-3/3 | L 4/4 | L 2-3/3 | L 3-4/3 | L 4-5/4-5 |
| | C 4/1 | C 4/1 | C 4/1 | C 2/1 | C 4/1 | C 4-5/3 | C 4-5/1-2 |
| P5 | purple | black | dk gray | brown | tan | brown | dk olive |
| | AR 2.71 | AR 2.90 | AR 3.23 | AR 2.63 | AR 1.82 | AR 0.78 | AR 2.35 |
| | W 2-3 | W 2 | W 3 | W 2 | W 1-2 | W 1-2 | W 1-2 |

TABLE 73-continued

Color Properties of Enzymatic Dyed Chlorinated Wool.

| | P75 | P78 | P79 | P1 | P203 | P236 | P182 |
|---|---|---|---|---|---|---|---|
| | L 2-3/2-3 | L 4/4 | L 3/3-4 | L 2/3-4 | L 2/2-3 | L 2/3-4 | L 2-3/2-3 |
| | C 4/1 | C 4/1 | C 3-4/1 | C 4/1 | C 5/4 | C 5/3 | C 5/2-3 |
| P7 | dk brown | dk brown | dk purple | brown | peach | tan | pink gray |
| | AR 1.83 | AR 2.54 | AR 2.56 | AR 2.48 | AR 0.80 | AR 0.48 | AR 2.12 |
| | W 2-3 | W 2 | W 2 | W 2 | W 1 | W 1-2 | W 1-2 |
| | L 4-5/4 | L 3-4/3-4 | L 2-3/3 | L 4/4 | L 2/3 | L 1-2/2 | L 2/3 |
| | C 2-3/1 | C 3-4/1 | C 4/1 | C 4-5/1 | C 5/4 | C 5/4 | C 5/2 |
| P8 | gray | gray blue | lt blue | brown | purple | rust | dk blue |
| | AR 1.54 | AR 2.23 | AR 2.09 | AR 2.65 | AR 2.89 | AR 0.84 | AR 3.55 |
| | W 2 | W 2-3 | W 2 | W 1-2 | W 2 | W 2 | W 3 |
| | L 3/4 | L 4/3 | L 2/2-3 | L 2-3/4-5 | L 4/4-5 | L 3-4/3-4 | L 4-5/4-5 |
| | C 4-5/1 | C 4-5/1-2 | C 4/1 | C 5/1 | C 5/4-5 | C 5/4-5 | C 5/3 |
| P11 | lt blue | teal | lt teal | purple | tan | tan | brown |
| | AR 1.68 | AR 1.53 | AR 1.35 | AR 2.33 | AR 1.23 | AR 0.15 | AR 1.89 |
| | W 2 | W 2-3 | W 2-3 | W 2-3 | W 1-2 | W 3 | W 1-2 |
| | L 3/3 | L 3/3 | L 3-4/3 | L 4-5/3 | L 2/3 | L 2-3/3-4 | L 2-3/2-3 |
| | C 3-4/1-2 | C 4/2 | C 3-4/2 | C 4-5/2-3 | C 5/4 | C 5/4-5 | C 5/3-4 |
| P17 | lt rust | magenta | dk magenta | brown | burgundy | tan | magenta |
| | AR 2.27 | AR 2.08 | AR 2.74 | AR 2.93 | AR 2.35 | AR 0.22 | AR 2.72 |
| | W 1-2 | W 1 | W 1 | W 1 | W 1 | W 1-2 | W 1 |
| | L 2/2 | L 2-3/2-3 | L 2-3/3 | L 4/4-5 | L 3/3-4 | L 3-4/3-4 | L 2-3/2-3 |
| | C 4-5/1 | C 4-5/1-2 | C 4-5/1-2 | C 3-4/1 | C 5/3-4 | C 4-5/2-3 | C 5/1-2 |
| P18 | lt blue | blue | lt teal | purple | purple | brown | dk blue |
| | AR 1.51 | AR 1.83 | AR 1.76 | AR 2.34 | AR 2.94 | AR 0.85 | AR 3.48 |
| | W 2-3 | W 3-4 | W 2-3 | W 3-4 | W 2 | W 1-2 | W 2-3 |
| | L 3/3-4 | L 4/4 | L 3/3-4 | L 3-4/4-5 | L 4/4-5 | L 3-4/4 | L 4-5/4-5 |
| | C 4/2 | C 4/2 | C 4/1-2 | C 4-5/1-2 | C 5/4 | C 5/4 | C 5/3 |
| P29 | gray | olive | tan | lt purple | lt purple | orange | gray |
| | AR 1.09 | AR 0.57 | AR 0.58 | AR 1.09 | AR 1.23 | AR 0.21 | AR 1.26 |
| | W 2 | W 2-3 | W 2-3 | W 2 | W 1 | W 2 | W 2 |
| | L 4/4 | L 3/5 | L 3-4/3 | L 3-4/4 | L 3-4/3-4 | L 4-5/4-5 | L 3/3-4 |
| | C 5/4 | C 5/4 | C 5/4 | C 4-5/4 | C 5/4-5 | C 5/4 | C 5/4 |
| P33 | brown | pink-gray | brown | brown | tan | orange | lt gray |
| | AR 1.29 | AR 0.19 | AR 0.93 | AR 0.50 | AR 2.54 | AR 0.10 | AR 0.87 |
| | W 1-2 | W 2 | W 1-2 | W 2-3 | W 2 | W 1-2 | W 1-2 |
| | L 2-3/3 | L 2/3 | L 3-4/3 | L 3/3-4 | L 4/4 | L 4-5/4-5 | L 2-3/2-3 |
| | C 5/1-2 | C 5/2-3 | C 4-5/1-2 | C 5/2 | C 5/4 | C 5/4 | C 5/3-4 |
| P37 | blue-gray | dk blue | blue-green | dk purple | purple | rust | dk purple |
| | AR 1.65 | AR 2.20 | AR 2.23 | AR 2.37 | AR 2.54 | AR 0.63 | AR 3.13 |
| | W 2-3 | W 3-4 | W 2-3 | W 2-3 | W 2 | W 2 | W 2 |
| | L 3/3-4 | L 4/4 | L 3-4/3-4 | L 4-5/4-5 | L 3-4/4-5 | L 4/4 | L 3-4/4 |
| | C 4-5/3 | C 4-5/3 | C 5/2 | C 4-5/2 | C 5/4 | C 5/4 | C 5/3-4 |
| P38 | brown | green | dk olive | green-gray | brown | orange | brown |
| | AR 1.21 | AR 0.02 | AR 0.48 | AR 0.43 | AR 0.70 | AR 0.17 | AR 1.07 |
| | W 2 | W 1 | W 1-2 | W 1 | W 1-2 | W 1 | W 1-2 |
| | L 3/4 | L 1-2/2-3 | L 3/3-4 | L 2/3 | L 2-3/3 | L 4/3 | L 2-3/3-4 |
| | C 5/3 | C 5/3 | C 5/1-2 | C 4-5/2 | C 5/4 | C 5/4 | C 5/3-4 |
| P39 | dk blue | dk gray | blue-gray | purple | purple | rust | dk purple |
| | AR 1.83 | AR 0.23 | AR 1.91 | AR 0.40 | AR 2.15 | AR 0.64 | AR 2.72 |
| | W 2 | W 2-3 | W 2-3 | W 2-3 | W 2-3 | W 1-2 | W 2 |
| | L 4/4 | L 3/3-4 | L 2-3/4 | L 4-5/4-5 | L 4/4 | L 4-5/5 | L 4-5/5 |
| | C 5/1-2 | C 5/1-2 | C 5/2-3 | C 4-5/1-2 | C 5/4 | C 5/4 | C 5/4 |
| P40 | brown | brown | gray brown | brown | brown | orange | brown |
| | AR 1.66 | AR 1.20 | AR 1.58 | AR 1.53 | AR 1.03 | AR 0.21 | AR 1.70 |
| | W 1-2 | W 1 | W 1 | W 1-2 | W 2 | W 1-2 | W 1 |
| | L 4/4-5 | L 1-2/2-3 | L 1-2/2-3 | L 4/4-5 | L 3/3-4 | L 3-4/4 | L 2-3/2-3 |
| | C 5/3-4 | C 5/3 | C 4-5/3 | C 5/2 | C 5/4 | C 5/4 | C 5/4-5 |
| P41 | dk brown | brown | dk olive | v. dk olive | brown | brown | brown |
| | AR 2.51 | AR 0.81 | AR 1.88 | AR 1.29 | AR 1.17 | AR 0.81 | AR 1.88 |
| | W 2 | W 1 | W 1 | W 1 | W 2 | W 1 | W 1 |
| | L 4/4 | L 2/3 | L 2/3 | L 2-3/4 | L 3-4/4 | L 3-4/3 | L 4/4 |
| | C 5/2 | C 4/2-3 | C 5/2-3 | C 5/1-2 | C 5/4 | C 5/3-4 | C 5/3-4 |
| P42 | dk blue | dk blue | teal blue | purple | purple | rust | dk blue |
| | AR 2.49 | AR 0.84 | AR 1.68 | AR 1.50 | AR 2.39 | AR 0.62 | AR 2.91 |
| | W 3 | W 3 | W 2-3 | W 2-3 | W 2-3 | W 2 | W 2-3 |
| | L 4-5/4 | L 4-5/3-4 | L 3-4/3 | L 3-4/4 | L 4-5/4-5 | L 3-4/4-5 | L 4/4 |
| | C 5/1-2 | C 5/3 | C 5/3-4 | C 5/2 | C 5/4 | C 5/4 | C 4-5/4 |
| P43 | dk blue | dk blue | teal blue | purple | purple | rust | dk blue |
| | AR 2.60 | AR 0.35 | AR 1.26 | AR 0.89 | AR 2.31 | AR 0.63 | AR 2.93 |
| | W 2-3 | W 3 | W 3-4 | W 2-3 | W 2-3 | W 2 | W 2-3 |
| | L 4/4-5 | L 4/4 | L 3-4/3-4 | L 4-5/4-5 | L 4-5/4-5 | L 4-5/4-5 | L 4-5/4-5 |
| | C 5/1-2 | C 5/3-4 | C 5/3-4 | C 5/2 | C 5/4 | C 5/4 | C 5/4 |
| P70 | brown | brown | brown | tan | tan | tan | teal blue |
| | AR 2.59 | AR 2.33 | AR 2.74 | AR 2.66 | AR 1.64 | AR 0.30 | AR 2.66 |
| | W 2-3 | W 2 | W 1-2 | W 1-2 | W 1 | W 2 | W 1-2 |

TABLE 73-continued

Color Properties of Enzymatic Dyed Chlorinated Wool.

| | P75 | P78 | P79 | P1 | P203 | P236 | P182 |
|---|---|---|---|---|---|---|---|
| | L 3-4/3-4 | L 3-4/3 | L 2-3/2-3 | L 3/3 | L 1-2/2-3 | L 3-4/4-5 | L 3-4/4 |
| | C 4/1 | C 4-5/1-2 | C 4-5/1 | C 4-5/1 | C 5/4-5 | C 5/4-5 | C 4-5/3-4 |
| P127 | black | green | teal | black | dk teal | dk brown | teal blue |
| | AR 3.15 | AR 2.27 | AR 2.91 | AR 3.16 | AR 3.16 | AR 0.97 | AR 2.30 |
| | W 2-3 | W 2-3 | W 2 | W 2-3 | W 1-2 | W 1-2 | W 2 |
| | L 4-5/4 | L 3-4/3 | L 2-3/2-3 | L 4/4 | L 3/3-4 | L 3-4/3-4 | L 3-4/3-4 |
| | C 3-4/1 | C 4-5/1-2 | C 4-5/1-2 | C 5/1 | C 5/3 | C 4-5/3-4 | C 4-5/3-4 |
| P202 | brown | magenta | purple | rust | orange | yellow | dk brown |
| | AR 2.97 | AR 3.07 | AR 4.07 | AR 2.65 | AR 1.37 | AR −0.14 | AR 3.23 |
| | W 1-2 | W 1-2 | W 1 | W 1 | W 1 | W 2 | W 1 |
| | L 2-3/3-4 | L 1-2/2 | L 2/1-2 | L 3/3 | L 1-2/1-2 | L 3-4/3 | L 3/3-4 |
| | C 4-5/1-2 | C 3-4/2-3 | C 5/2-3 | C 5/2 | C 5/4-5 | C 5/5 | C 5/3-4 |

EXAMPLE 17

The dyeing effect of a substituted aromatic diamine precursor combined with a sulfonated naphthylamine was tested on filament nylon knit (Testfabrics Style #322) and chlorinated wool (Testfabrics Style #530) at pH 5 and 60° C. The enzyme used was *Myceliophthora thermophila* laccase obtained from Novo Nordisk A/S (2880 Bagsvaerd, Denmark). The precursor used was N-phenyl-1,4-phenylenediamine (P75) and the coupler used was 5-amino-2-naphthalenesulfonic acid (P43), each obtained from Aldrich Chemical Co., Inc., Milwaukee, Wis. 53201.

Nylon and chlorinated wool swatches (15 g) were pre-wetted for 10 minutes in an aqueous solution containing 1% o.w.f. Intravon FW 75. Britton-Robinson buffer (0.1 M, pH 5) and Intratex CWR (2% o.w.f.) were added to each beaker to give a dyeing liquor ratios of 15:1. The following were added in order: coupler (P43), then precursor (P75), then pre-wetted swatches, and enzyme last. The enzyme dose was 2.2 LAMU/mL. The ratio of precursor to coupler was 50/50 mole %. The beakers were capped and run in an Atlas Launder-O-meter (LOM) for 75 minutes at 60° C. Swatches were removed from the dyebaths, squeezed to remove excess dye, then were overflow rinsed in a bucket with cold tap water for 15 minutes, squeezed and air dried flat. Color and wash fastness of the swatches was measured as described previously, and is reported in Table 74. The results show that chlorinated wool dyed to a blue gray color, and nylon dyed to a bright blue color. The difference in CIEL*a*b* between the enzyme-treated and no-enzyme control shows the importance of laccase in generating color.

TABLE 74

CIEL*a*b* Color Values Nylon and Chlorinated Wool after Dyeing with P75/P43 in the Presence and Absence of Laccase, and after Wash Fastness Testing.

| Sample | L* | a* | b* |
|---|---|---|---|
| Control Nylon | 58.4 | 2.32 | −5.63 |
| Enzyme-treated Nylon | 28.6 | 5.60 | −26.1 |
| Washed Nylon | 30.9 | 5.96 | −28.0 |
| Control Cl-Wool | 72.2 | 0.80 | 22.8 |
| Enzyme-treated Cl-Wool | 27.8 | −2.54 | −7.19 |
| Washed Cl-Wool | 33.3 | −3.22 | −7.48 |

EXAMPLE 18

The ability to dye a material with pre-formed product from enzyme catalyzed reaction of dye intermediates was tested and compared to a material dyed in situ with the same dye intermediates and enzyme. Buffer (100 mL, pH 5, 0.M Britton-Robinson), commercial dyeing auxiliary (0.1% o.w.b. Intratex CWR, Crompton & Knowles Colors, Inc., Box 33188, Charlotte, N.C. 28233), precursor (5 mM 4-aminodiphenylamine-2-sulfonic acid obtained from Aldrich Chemical Co., Inc., Milwaukee, Wis. 53201), coupler (5 mM 5-amino-2-naphthalenesulfonic acid obtained from Aldrich Chemical Co., Inc., Milwaukee, Wis. 53201), and enzyme (3.4 LAMU/mL *Myceliophthora thermophila* laccase obtained from Novo Nordisk A/S (2880 Bagsvaerd, Denmark) were combined in a stainless steel container. The beaker was sealed and rotated for 60 minutes at 60° C. in an Atlas Launder-O-Meter (LOM). The dark blue dyebath was freeze-dried to yield a powder containing the dye products, buffer salts, and residual dye auxiliaries. The freeze-dried powder was diluted in a stainless steel beaker to its original volume with Britton-Robinson buffer (0.1M, pH 5). A 5 g swatch of chlorinated wool, pre-wetted in 1% o.w.f. commercial wetting agent (Intravon FW 75, Crompton & Knowles Colors, Inc., Box 33188, Charlotte, N.C. 28233) was added. The beaker was sealed and rotated for 60 minutes at 60° C. in a LOM. After treatment, swatches were rinsed in cold tap water, then air dried. Dyed swatches were evaluated for color and wash fastness as described previously. CIEL*a*b* color values and wash fastness for chlorinated wool dyed with pre-formed dye product are shown in Table 75. For comparison, color data for in situ dyed chlorinated wool is also shown. Results show that it is possible to dye a material with dye products pre-formed by a enzyme mediated reaction. In this example, the in situ dyeing gave a deeper (lower L*), bluer (more negative b*) color on the fabric than the pre-formed dye. The measured wash fastness for the in situ dyed wool (ΔE 5.77, GS 2–3) was slightly better than for the wool dyed with pre-formed product (ΔE 6.28, GS 2). It is anticipated that process optimization when using pre-formed dye products, such as isolation and formulation of the dye products, and adjustments of the temperature, time, pH, and dyeing auxiliaries used for dyeing, would lead to improved dyeing results with the pre-formed products.

TABLE 75

Color Values for Chlorinated Wool Dyed In Situ or with Dye Product Pre-formed from Laccase Mediated Reaction of P182 with P43.

| Swatch Treatment | L* | a* | b* |
|---|---|---|---|
| Pre-formed Dye Product | 20.5 | 1.26 | −10.7 |
| Washed Pre-Formed Dye Product | 26.7 | 1.06 | −10.2 |
| In Situ Dyed | 16.4 | 2.17 | −11.7 |
| Washed In Situ Dyed | 21 .9 | 1.30 | −13.2 |

EXAMPLE 19

The effects of buffer strength and liquor ratio were tested on wool at pH 5 and 80° C. The enzyme used was *Myceliophthora thermophila* laccase obtained from Novo Nordisk A/S (2880 Bagsvaerd, Denmark). The precursor used was 4-aminodiphenylamine-2-sulfonic acid (P182) and the coupler used was 5-amino-2-naphthalenesulfonic acid (P43), each obtained from Aldrich Chemical Co., Inc., Milwaukee, Wis. 53201.

Wool swatches (10 g) were pre-wetted for 10 minutes in an aqueous solution containing 1% o.w.f. Intravon FW 75. Sodium acetate buffer (pH 5), at different buffer strength, and Intratex CWR (2% o.w.f.) were added to each beaker to give a dyeing liquor ratios of 10:1, 15:1, and 20:1. The following were added in order: coupler (P43), then precursor (P182), then pre-wetted wool swatches, and enzyme last. The ratio of precursor to coupler was 50/50 mole %. The beakers were capped and run in an Atlas Launder-O-meter (LOM) for 60 minutes at 80° C. Sulfuric acid was added to lower the pH to ~pH 2, and the beakers were run at 80° C. for 30 minutes. Wool swatches were removed from the dyebaths, squeezed to remove excess dye, transferred to LOM beakers pre-filled to a liquor ratio of 20:1 with 0.1% w/v Intravon NF, and run in a LOM at 40° C. for 15 minutes to post-wash the fabric and remove surface dye. Swatches were then overflow rinsed in a bucket with cold tap water for 15 minutes, squeezed and air dried flat. Color on wool was measured as described previously, and is reported in Table 76. The results show that a similar color and depth of shade was obtained across a range of different liquor ratios and buffer strengths.

TABLE 76

CIEL *a*b* Color for Wool Treated with 3% o.w.f. Total P182/P43 at pH 5, and 1 LAMU/mL Laccase at Different Levels of Liquor Ratio and Buffer Strength.

| Liquor Ratio | Buffer Strength (M) | L* | a* | b* |
|---|---|---|---|---|
| 10:1 | 0.1 | 16.3 | 1.49 | −7.28 |
| 15:1 | 0.1 | 16.2 | 1.98 | −7.48 |
| 20:1 | 0.1 | 16.4 | 2.34 | −7.78 |
| 10:1 | 0.01 | 16.8 | 2.26 | −7.76 |
| 10:1 | 0.05 | 16.4 | 1.54 | −6.96 |
| 10:1 | 0.1 | 16.4 | 1.46 | −7.40 |

EXAMPLE 20

The effect of increasing the total combined precursor and coupler level was tested on three types of wool at pH 5 and 80° C. The enzyme used was *Myceliophthora thermophila* laccase obtained from Novo Nordisk A/S (2880 Bagsvaerd, Denmark). The precursor used was 4-aminodiphenylamine-2-sulfonic acid (P182) and the coupler used was 5-amino-2-naphthalenesulfonic acid (P43), each obtained from Aldrich Chemical Co., Inc., Milwaukee, Wis. 53201.

Wool swatches (5 g) were pre-wetted for 10 minutes in an aqueous solution containing 1% o.w.f. Intravon FW 75. Britton-Robinson buffer (0.1 M, pH 5) and Intratex CWR (2% o.w.f.) were added to each beaker to give a dyeing liquor ratio of 20:1. The following were added in order: coupler (P43), then precursor (P182), then pre-wetted wool swatches, and enzyme last. The ratio of precursor to coupler was 55/45 mole %. The beakers were capped and run in an Atlas Launder-O-meter (LOM) for 60 minutes at the relevant temperature. Wool swatches were removed from the dyebaths, squeezed to remove excess dye, transferred to LOM beakers pre-filled to a liquor ratio of 40:1 with 0.1% w/v Intravon NF, and run in a LOM at 40° C. for 15 minutes to post-wash the fabric and remove surface dye. Swatches were then overflow rinsed in a bucket with cold tap water for 15 minutes, squeezed and air dried flat. Color fastness was measured as described previously. Depth of the blue color obtained was measured as K/S at 580nm, where K/S increases as depth of color increases. The color and fastness results are shown in Tables 77 and 78. The results show that an increased depth of color is obtained on the fabric with increased total precursor/coupler level.

TABLE 77

K/S Color Strength for Three Types of Wool Treated with 2 LAMU/mL Laccase and Different Levels of Total P182/P43 at pH 5 and 80° C.

| Total P182/P43 (mM) | Wool Gabardine | Wool Flannel | Chlorinated Wool |
|---|---|---|---|
| 6 | 22.06 | 22.97 | 26.12 |
| 4 | 19.03 | 19.17 | 20.71 |
| 2 | 11.63 | 11.80 | 9.78 |

TABLE 78

Gray Scale Light (L) and Wash (W) Fastness for Three Types of Wool Treated with 2 LAMU/mL Laccase and Different Levels of Total P182/P43 at pH 5 and 80° C.

| Total | Wool Gabardine | | Wool Flannel | | Chlorinated Wool | |
|---|---|---|---|---|---|---|
| P182/P43 (mM) | L | W | L | W | L | W |
| 6 | 4.5 | 4 | 4.5 | 4.5 | 4 | 2.5 |
| 4 | 4.5 | 4.5 | 4.5 | 2.5 | 3.5 | 2.5 |
| 2 | 3.5 | 4.5 | 4 | 4.5 | 3.5 | 2 |

EXAMPLE 21

The effect of increasing temperature was tested on three types of wool at pH 5 with 1% o.w.f. total precursor/coupler. The enzyme used was *Myceliophthora thermophila* laccase obtained from Novo Nordisk A/S (2880 Bagsvaerd, Denmark). The precursor used was 4-aminodiphenylamine-2-sulfonic acid (P182) and the coupler used was 5-amino-2-naphthalenesulfonic acid (P43), each obtained from Aldrich Chemical Co., Inc., Milwaukee, Wis. 53201. The dyeing procedure and test methods described in Example 20 were used. The color and color fastness results are shown in Tables 79 and 80. The results show that an of color is obtained on the fabric with increased temperature.

TABLE 79

K/S Color Strength for Three Types of Wool Treated with 2 LAMU/mL Laccase at Different Temperatures with 1% o.w.f. Total P182/P43 at pH 5.

| Temperature (° C.) | Wool Gabardine | Wool Flannel | Chlorinated Wool |
|---|---|---|---|
| 60 | 10.61 | 9.65 | 7.17 |
| 70 | 12.89 | 13.19 | 10.57 |
| 80 | 13.66 | 11.92 | 11.89 |

TABLE 80

Gray Scale Light (L) and Wash (W) Fastness for Three Types of Wool Treated with 2 LAMU/mL Laccase at Different Temperatures with 1% o.w.f. Total P182/P43 at pH 5.

| Temperature | Wool Gabardine | | Wool Flannel | | Chlorinated Wool | |
|---|---|---|---|---|---|---|
| (° C.) | L | W | L | W | L | W |
| 60 | 3 | 3.5 | 3.5 | 4.5 | — | 2.5 |
| 70 | 4.5 | 4.5 | 4 | 4 | — | 2 |
| 80 | 4 | 4.5 | 4 | 4 | — | 2.5 |

EXAMPLE 22

The effect of peroxidase as a catalyst for enzymatic dyeing was tested on wool at pH 5 with 3% o.w.f. total precursor/coupler. The enzyme used was *Coprinus cinereus* peroxidase obtained from Novo Nordisk A/S (2880 Bagsvaerd, Denmark). The precursor used was 4-aminodiphenylamine-2-sulfonic acid (P182) and the coupler used was 5-amino-2-naphthalenesulfonic acid (P43), each obtained from Aldrich Chemical Co., Inc., Milwaukee, Wis. 532201.

Wool swatches (10 g) were pre-wetted for 10 minutes in an aqueous solution containing 1% o.w.f. Intravon FW 75. Britton-Robinson buffer (0.1 M, pH 5) and Intratex CWR (2% o.w.f.) were added to each beaker to give a dyeing liquor ratio of 15:1. The following were added in order: coupler (P43), then precursor (P182), then pre-wetted wool swatches, and enzyme last. The ratio of precursor to coupler was 50/50 mole %. The beakers were capped and run in an Atlas Launder-O-meter (LOM) for 60 minutes at 80° C. Sulfuric acid (0.3% o.w.b.) was added to lower the pH and exhaust the dyebath. The beakers were run for 30 minutes at 80° C. Wool swatches were removed from the dyebaths, squeezed to remove excess dye, transferred to LOM beakers pre-filled to a liquor ratio of 40:1 with 0.1% w/v Intravon NF, and run in a LOM at 40° C. for 15 minutes to post-wash the fabric and remove surface dye. Swatches were then overflow rinsed in a bucket with cold tap water for 15 minutes, squeezed and air dried flat. Color on the fabric was measured as CIEL*a*b*. Results reported in Table 81 show that a reddish-blue color is produced on wool. The depth of color increased with increasing peroxide dose.

TABLE 81

CIEL*a*b* Color for Wool Treated with 3% o.w.f. Total P182/P43 at pH 5, and with 1.2 POXU/mL Peroxidase and Different Levels of Hydrogen Peroxide.

| $H_2O_2$ (mM) | L* | a* | b* |
|---|---|---|---|
| 0.5 | 27.6 | 2.81 | −9.08 |
| 1 | 21.4 | 3.07 | −9.77 |
| 2 | 18.5 | 3.40 | −9.08 |
| 3 | 19.1 | 3.48 | −8.77 |

EXAMPLE 23

The color produced on wool by a sulfonated aromatic diamine precursor combined with two different sulfonated aminonaphthalenes in the presence of two different oxidoreductases was measured. The enzymes used were *Coprinus cenerius* peroxidase and *Myceliophthora thermophila* laccase obtained from Novo Nordisk A/S (2880 Bagsvaerd, Denmark). The precursor used was 4-aminodiphenylamine-2-sulfonic acid (P182) and the couplers used were 5-amino-2-naphthalenesulfonic acid (P43) and 8-anilino-1-naphthalenesulfonic acid (P287), each obtained from Aldrich Chemical Co., Inc., Milwaukee, Wis. 53201. Precursor and coupler were dosed at 3% o.w.f. at a 1:1 molar ratio.

The dyeing procedure and test methods described in Example 22 were used. Color on the fabric was measured as CIEL*a*b*. Results reported in Table 82 show that the same precursor can give different colors with different couplers. The results show that with the same precursor/coupler system, treatment with peroxidase and laccase can yield colors within the same quadrant of CIEL*a*b* color space.

TABLE 82

CIEL*a*b* Color for Wool Treated with 3% o.w.f. Total Precursor/Coupler at pH 5, with either 1.2 POXU/mL Peroxidase plus 1 mM $H_2O_2$ or 2 LAMU/mL Laccase.

| Precursor/Coupler | Enzyme | L* | a* | b* |
|---|---|---|---|---|
| P182/P43 | Peroxidase | 21.4 | 3.07 | −9.77 |
| P182/P43 | Laccase | 18.5 | 1.30 | −4.68 |
| P182/P287 | Peroxidase | 27.6 | 1.79 | 5.54 |
| P182/P287 | Laccase | 16.9 | 1.75 | 0.27 |

EXAMPLE 24

Multifiber fabric swatches (0.85 g; Style 1, TestFabrics, Inc., Box 26, West Pittsboro, Pa. 18643), containing spun diacetate, bleached cotton, spun polyamide (nylon 6.6), spun silk, spun viscose, and worsted wool, were soaked for 5 minutes in a nonionic polyoxyethylene ether wetting agent (0.1% Diadavin UFN, Bayer, Pittsburgh, Pa. 15205-9741). One multifiber fabric swatch was placed in a flask with 20 parts 0.1 M buffer (pH 5 or pH 8). Stock dye precursor and coupler solutions were prepared by dissolving compounds listed in Tables 1–8 in suitable solvents. A 10 mM total concentration was obtained in the bath by adding either a single precursor or coupler stock solution to give the 10 mM level, or by adding one stock precursor and one stock coupler solution at a one to one mole ratio to give the total 10 mM level. *Myceliophthora thermophilia* laccase was added to each flask at a 3.4 LAMU/mL level. Flasks were incubated for 60 minutes at 60° C. with gentle shaking. After incubation, swatches were rinsed for 1 minute in cold tap water, then air dried. Multifiber swatches were evaluated visually for color. Results are reported in Table 83 for colors produced by single precursors or couplers, and results are reported in Table 84 for colors produced by precursor-coupler combinations. Results show that different colors are obtained when the precursors or couplers are used alone, compared to when they are used in combination. Results also show that colors can be obtained on a range of different fiber types.

TABLE 83

Colors Produced on Different Fiber Types by Single Compounds Treated with Laccase.

| Single Compound | pH | Wool | Viscose | Silk | Nylon 6.6 | Cotton | Diacetate |
|---|---|---|---|---|---|---|---|
| P3 | 5 | brown | brown st. | black | brown | brown | brown |
| P3 | 8 | brown | brown st. | black | brown | brown | lt. brown |
| P5 | 5 | lt. brown | brown st. | lt. brown | lt. brown | brown | lt. brown |
| | 8 | lt. brown | brown st. | lt. brown | lt. brown | brown | lt. brown |
| P16 | 5 | brown | brown | brown | brown | lt. brown | lt. st. |
| | 8 | lt. st. | brown | lt. st. | n.c. | tan | n.c. |
| P17 | 5 | gray | gray | gray | gray | dk. gray | gray |
| | 8 | n.c. | n.c. | n.c. | n.c. | lt. pink | n.c. |
| P19 | 8 | brown | pink st. | dk. maroon | mauve | mauve | lt. brown |
| P28* | 8 | lt. st. | olive | lt. st. | n.c. | olive | n.c. |
| P36* | 5 | pink | olive | oliye | pink | olive | n.c. |
| | 8 | lt. st. | dk. olive | lt. gray | n.c. | olive | n.c. |
| P37 | 5 | lt. st. | n.c. | lt. st. | lt. st. | n.c. | n.c. |
| | 8 | lt. st. | n.c. | lt. st. | lt. st. | n.c. | n.c. |
| P39 | 5 | lt. gray | lt. purple | purple | beige | lt. st. | n.c. |
| | 8 | beige | lt. olive | beige | lt. st. | lt. st. | n.c. |
| P42 | 5 | pink | pink st. | dk. pink | pink | pink st. | n.c. |
| | 8 | lt. pink | pink st. | lt. pink | lt. st. | n.c. | n.c. |
| P43 | 5 | pink | pink st. | dk. pink | pink | pink st. | n.c. |
| | 8 | lt. peach | pink st. | n.c. | n.c. | n.c. | n.c. |
| P75 | 5 | black | purple | black | dk. purple | purple | black |
| | 8 | black | purple | black | black | mauve | black |
| P78 | 5 | gray | lt. purple | dk. purple | lt. brown | purple | lt. brown |
| P79 | 5 | brown | lt. st. | dk. brown | lt. st. | lt. brown | lt. st. |
| | 8 | brown | dk. st. | dk. brown | brown | brown | brown |
| P83 | 5 | rust red | pink st. | dk. red | lt. orange | pink st. | lt. orange |
| | 8 | brown | tan | rust red | rust red | beige | rust red |
| P120 | 8 | n.c. | n.c. | n.c. | n.c. | n.c. | n.c. |
| P157 | 5 | lt. st. | n.c. | lt. st. | n.c. | n.c. | lt. st. |

Key to Abbreviations: lt. = light; dk. = dark; st. = stain; n.c. = no color; * = colors similar to those reported in the table were also obtained in the absence of enzyme (if no asterisk, no or less color obtained in the absence of enzyme).

TABLE 84

Colors Produced on Different Fiber Types by Compound Combinations Treated with Laccase.

| Precursor/ Coupler | pH | Wool | Viscose | Silk | Nylon 6.6 | Cotton | Diacetate |
|---|---|---|---|---|---|---|---|
| P5/P16 | 5 | brown | brown st. | brown | brown | mauve | lt. st. |
| | 8 | dk. gold | rust br. | gold | lt. orange | dk. mauve | n.c. |
| P3/P17 | 8 | gold | lt. brown | brown | mauve | brown | lt. st. |
| P79/P17 | 5 | maroon | purple st. | maroon | dk. pink | purple | pink |
| | 8 | brown | pink st. | maroon | pink | blue | lt. peach |
| P83/P17 | 5 | brown | purple | dk. brown | gray st. | purple | lt. st. |
| P5/P28 | 8 | lt. st. | olive | lt. st. | n.c. | olive | n.c. |
| P19/P28 | 8 | lt. gray | olive | lt. gray | n.c. | olive | lt. st. |
| P75/P28 | 8 | dk. gray | green | dk. blue | dk. blue | gray | brown |
| P79/P28 | 8 | dk. gray | lt. blue | dk. blue | blue gray | gray | gray st. |
| P3/P36 | 5 | dk. gray | lt. st. | dk. purple | brown | lt. st. | gold |
| | 8 | gray | lt. st. | dk. mauve | lt. brown | n.c. | yellow |
| P75/P36 | 8 | dk. gray | lt. gray | black | dk. gray | lt. gray | brown |
| P3/P37 | 5 | dk. purple | purple st. | dk. purple | dk. purple | purple st. | purple |
| | 8 | dk. purple | purple st. | dk. purple | dk. purple | purple st. | purple |
| P75/P37 | 5 | dk. blue | lt. st. | dk. blue | purple | lt. st. | purple |
| | 8 | purple | lt. st. | purple | purple | lt. st. | purple |
| P79/P37 | 5 | green | lt. st. | dk. blue | blue | lt. st. | blue |
| | 8 | blue | lt. st. | dk. blue | blue | lt. st. | blue |
| P83/P39 | 5 | red | pink | dk. red | red | pink | pink |
| | 8 | dk. red | lt. purple | maroon | dk. pink | lt. purple | pink |

TABLE 84-continued

Colors Produced on Different Fiber Types by Compound Combinations Treated with Laccase.

| Precursor/ Coupler | pH | Wool | Viscose | Silk | Nylon 6.6 | Cotton | Diacetate |
|---|---|---|---|---|---|---|---|
| P79/P42 | 5 | blue | n.c. | dk. blue | blue | n.c. | n.c. |
| | 8 | blue | n.c. | dk. blue | blue | n.c. | n.c |
| P79/P43 | 5 | blue | n.c. | dk. blue | blue | n.c. | blue st. |
| | 8 | blue | n.c. | dk. blue | blue | n.c. | blue st. |
| P3/P120 | 8 | gold | n.c. | gold | orange | n.c. | yellow |
| P79/P157 | 5 | dk. blue | purple st. | dk. blue | lt. purple | purple st. | lt. purple |

EXAMPLE 25

The ability of the enzyme-mediated dyeing system to produce color on a cationic polysaccharide was tested by applying the dyeing system to a chitosan film. Chitosan is a heteropolysaccharide composed mainly of b-(1,4)-2-deoxy-2-amino-D-glucopyranose units and partially of b-(1,4)-2-deoxy-2-acetamido-D-glucopyranose. Under acidic conditions, chitosan acquires a cationic character by virtue of the substituent amino groups along the polymer backbone.

Transparent, colorless, chitosan film was dyed with 1:1 mole ratio P79/P43 at a total precursor/coupler level of 6% o.w.f. The dyeing conditions were pH 5; LR 20:1; 90° C. for 45 minutes; with 4 LAMU/mL of *Myceliophthora thermophila* laccase to produce a blue colored film with the following color coordinates: L* 26.8, a* −1.52, b* −14.9.

EXAMPLE 26

Multifiber fabric (Style 1, TestFabrics, Inc., Box 26, West Pittsboro, Pa. 18643), containing spun diacetate, bleached cotton, spun polyamide (nylon 6.6), spun silk, spun viscose, and worsted wool, was treated with 10 mM 4-(4'-N,N-di-(2-hydroxyethyl))-phenylazoaniline (P46) as described in Example 26, in the presence and absence of 3.4 LAMU/ml *Myceliophthora thermophilia* laccase. Swatches were evaluated visually for color. Results are reported in Table 85. Results show that an aromatic diamine type precursor that already has color by virtue of its extended conjugated aromatic system can react in the presence of laccase to produce a different color.

TABLE 85

Color Produced on Different Fiber Types by 4-(4'-N,N-di-(2-hydroxyethyl))-phenylazoaniline in the Presence and Absence of Laccase.

| Laccase | pH | Wool | Viscose | Silk | Nylon 6.6 | Cotton | Diacetate |
|---|---|---|---|---|---|---|---|
| No | 5 | orange | yellow | gold | orange | lt. yellow | orange |
| Yes | 5 | dk. brown | brown | black | brown | dk. brown | dk. gray |
| No | 8 | orange | yellow | gold | orange | lt. yellow | orange |
| Yes | 8 | dk. brown | brown | black | brown | dk. brown | black |

EXAMPLE 27

Multifiber fabric (Style 1, TestFabrics, Inc., Box 26, West Pittsboro, Pa. 18643), containing spun diacetate, bleached cotton, spun polyamide (nylon 6.6), spun silk, spun viscose, and worsted wool, was treated with 10 mM 4,4'-diaminodiphenylamine sulfate (P74) as described in Example 26, in the presence and absence of 3.4 LAMU/mL *Myceliophthora thermophilia* laccase. Swatches were evaluated visually for color. Results are reported in Table 86. Results show that laccase can enhance the color forming reaction of compounds that auto-oxidize under the dyeing conditions. In this example, the effect is seen particularly on viscose and cotton.

TABLE 86

Color Produced on Different Fiber Types by 4,4'-Diaminodiphenylamine Sulfate in the Presence and Absence of Laccase.

| Laccase | pH | Wool | Viscose | Silk | Nylon 6.6 | Cotton | Diacetate |
|---|---|---|---|---|---|---|---|
| No | 5 | purple | purple st. | purple | lt. purple | purple st. | purple |
| Yes | 5 | purple | purple | black | purple | dk. purple | purple |
| No | 8 | dk. purple | purple st. | dk. purple | dk. purple | purple st. | black |
| Yes | 8 | dk. purple | purple | black | black | dk. purple | black |

EXAMPLE 28

The ability of laccase to produce color with a mixture of sulfonated aromatic diamine and sulfonated aminonaphthalene dye intermediates was tested on raw hide leather at pH 5 and 80° C., and compared to the performance without laccase. The enzyme used was *Myceliophthora thermophila* laccase obtained from Novo Nordisk A/S (2880 Bagsvaerd, Denmark). The precursor used was 4-aminodiphenylamine- 2-sulfonic acid (P182) and the coupler used was 5-amino-2-naphthalenesulfonic acid (P43), each obtained from Aldrich Chemical Co., Inc., Milwaukee, Wis. 53201.

Raw hide leather swatches (10 g) were washed three times in boiling water containing 1% o.w.g. ("on weight of goods") commercial wetting agent, Intravon FW 75. Sodium acetate buffer (0.1 M, pH 5), Intravon FW75 (1% o.w.g.), and Intratex CWR (2% o.w.f.) were added to 150 mL LOM beakers to give a dyeing liquor ratio of 15:1. The following were added in order: coupler (P43), then precursor (P182), then pre-wetted leather swatches. The ratio of precursor to coupler was 50/50 mole %. The beakers were rotated in a LOM at 80° C. for 10 minutes. Laccase (0.8 LAMU/mL) was added, and the beakers were rotated for an additional 50 minutes at 80° C. Concentrated formic acid (5% o.w.g.) was added to each beaker, and the beakers were rotated at 80° C. for 30 minutes. Swatches were removed from the dyebaths, rinsed with copious warm water, and air dried. Color was measured as described previously, and is reported in Table 87 as an average of four readings. The initial, untreated color of the raw hide leather was L* 83.7, a* −1.11, and b* 20.4. The results show that laccase treatment produced darker color (lower final L* value) on the leather swatches compared to the no-enzyme control.

TABLE 87

CIEL*a*b* Color Values for Laccase Treated and Control Leather Swatches.

| Treatment | L* | a* | b* |
|---|---|---|---|
| Laccase | 24.2 | 1.04 | −5.10 |
| Control | 33.8 | 1.34 | −7.48 |

EXAMPLE 29

The ability of peroxide alone and peroxide combined with peroxidase to produce color with a mixture of sulfonated aromatic diamine and sulfonated aminonaphthalene dye intermediates was tested on wool at pH 5 and 80° C., and compared to the performance with laccase. The enzymes used were *Myceliophthora thermophila* laccase and *Coprinus cinereus* peroxidase obtained from Novo Nordisk A/S (2880 Bagsvaerd, Denmark). The precursor used was 4-aminodiphenylamine-2-sulfonic acid (P182) and the coupler used was 5-amino-2-naphthalenesulfonic acid (P43), each obtained from Aldrich Chemical Co., Inc., Milwaukee, Wis. 53201. Reagent grade aqueous hydrogen peroxide solution was obtained from Fisher Scientific, Fair Lawn, N.J. 07410.

Wool swatches (10 g) were pre-wetted for 10 minutes in an aqueous solution containing 1% o.w.f. Intravon FW 75. Sodium acetate buffer (0.1 M, pH 5), and Intratex CWR (2% o.w.f.) were added to 150 mL LOM beakers to give a dyeing liquor ratio of 15:1. The following were added in order: coupler (P43), then precursor (P182), then pre-wetted wool swatches. Laccase (2 LAMU/mL), hydrogen peroxide (15-300 mM) or a combination of peroxidase (3 POXU/mL) and peroxide (15 mM) was added last. The ratio of precursor to coupler was 50/50 mole %. The beakers were capped and run in an Atlas Launder-O-meter (LOM) for 60 minutes at 80° C. Sulfuric acid was added to lower the pH to ~pH 2, and the beakers were run at 80° C. for 30 minutes. Wool swatches were removed from the dyebaths, squeezed to remove excess dye, transferred to LOM beakers pre-filled to a liquor ratio of 20:1 with 0.1% w/v Intravon NF, and run in a LOM at 40° C. for 15 minutes to post-wash the fabric and remove surface dye. Swatches were then overflow rinsed in a bucket with cold tap water for 15 minutes, squeezed and air dried flat. Depth of color on wool was measured as K/S at 580 nm, and is reported in Table 88. The results show that the deepest color on wool (highest K/S) is obtained with the laccase or peroxidase/peroxide systems. Peroxide alone gave a similar color though a lower depth of shade across a range of peroxide levels. Wash fastness tests gave mixed results, however the laccase-treated sample had much better light fastness (lower dE Light) than the peroxide-only or peroxide/peroxidase treated samples.

TABLE 88

K/S Depth of Shade and Wash and Light Fastness for Wool Treated with P182/P43 and Peroxide, Peroxide/Peroxidase, or Laccase.

| Enzyme | Peroxide (mM) | K/S at 580 nm | dE Wash | dE Light (40 hour) |
|---|---|---|---|---|
| | 15 | 16.3 | — | — |
| | 45 | 20.9 | 0.75 | 3.81 |
| | 75 | 20.2 | — | — |
| | 100 | 21.2 | 1.78 | 3.61 |
| | 300 | 11.4 | — | — |
| Peroxidase | 15 | 22.4 | 1.95 | 3.20 |
| Laccase | 0 | 23.8 | 1.68 | 1.97 |

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims. In the case of conflict, the present disclosure including definitions will control.

Various references are cited herein, the disclosures of which are incorporated by reference in their entireties.

What is claimed is:

1. A method for dyeing an undyed material, said method comprising contacting the material with a dyeing system which comprises:

(a) a mixture of (i) at least one aromatic diamine and (ii) at least one compound selected from the group consisting of a naphthol and an aminonaphthalene, wherein at least one of the compounds of (i) or (ii) is substituted with a functional group selected from the group consisting of a sulfonic acid, a sulfonamide, and a quaternary ammonium salt; and (b) an oxidation system comprising (i) a hydrogen peroxide source and an enzyme exhibiting peroxidase activity or (ii) an enzyme exhibiting oxidase activity on one or more of the compounds of mixture (a), under conditions in which a colored material is produced.

2. A method as defined in claim 1, wherein said material is a fabric, yarn, fiber, garment or film made of a material selected from the group consisting of fur, hide, leather, silk, wool, cationic polysaccharide, cotton, diacetate, flax, linen, lyocel, polyacrylic, synthetic polyamide, polyester, ramie, rayon, triacetate, and viscose.

3. A method as defined in claim 1, wherein said naphthol is not unsubstituted α(alpha)-naphthol, halogenated 1-naphthol, or an unsubstituted dihydroxynaphthalene.

4. A method as defined in claim 1, wherein said aromatic diamine is substituted with a functional group selected from the group consisting of a sulfonic acid, a carboxylic acid, a salt of a sulfonic acid or carboxylic acid, a sulfonamide, and a quaternary ammonium salt.

5. A method as defined in claim 1, wherein either said aromatic diamine is substituted with a functional group selected from the group consisting of a sulfonic acid, a carboxylic acid, a salt of a sulfonic acid or carboxylic acid, a sulfonamide, and a quaternary ammonium salt or said naphthol is not unsubstituted α(alpha)-naphthol, halogenated 1-naphthol, or an unsubstituted dihydroxynaphthalene.

6. A method as defined in claim 1, wherein said aromatic diamine is a compound of formula A, said naphthol is a compound of formula B, and said aminonaphthalene is a compound of formula C

A

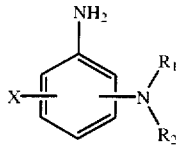

B

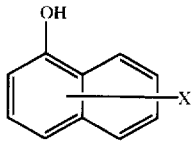

C

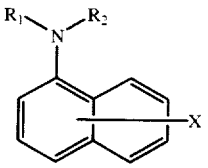

wherein, X is selected from the group consisting of hydrogen, sulfonic acid, carboxylic acid, a salt of sulfonic acid, a salt of carboxylic acid, sulfonamide, and a quaternary ammonium salt; R1 and R2 are each independently selected from the group consisting of hydrogen, $C_{1-18}$-alkyl, $C_{1-18}$-hydroxyalkyl, phenyl, aryl, azobenzene, amidophenyl, azobenzene substituted with one or more functional groups, and amidophenyl substituted with one or more functional groups; and the remaining positions on the aromatic ring(s) of A, B, and C are optionally substituted with one or more functional groups selected from the group consisting of hydrogen, halogen, sulfo, sulfonato, sulfamino, sulfanyl, amino, amido, amidoaryl, nitro, azo, azoaryl, imino, carboxy, cyano, formyl, hydroxy, halocarbonyl, carbamoyl, carbamidoyl, phenyl, aryl, phosphonato, phosphonyl, $C_{1-8}$-alkyl, $C_{2-18}$-alkenyl, $C_{2-18}$-alkynyl, $C_{1-18}$-alkoxy, $C_{1-18}$-oxycarbonyl, $C_{1-18}$-oxoalkyl, $C_{1-18}$-alkyl sulfanyl, $C_{1-18}$-alkyl imino, and amino which is substituted with one, two, or three $C_{1-18}$-alkyl groups.

7. A method as defined in claim 6, wherein the halogen is selected from the group consisting of fluorine, chlorine, bromine, and iodine.

8. A method as defined in claim 1, wherein said naphthol is a compound of formula D

D

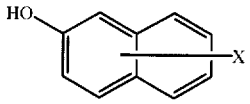

wherein X is selected from the group consisting of hydrogen, sulfonic acid, sulfonamide, and a quaternary ammonium salt, and the remaining positions on the aromatic rings of D are optionally substituted with one or more functional groups selected from the group consisting of hydrogen, halogen, sulfo, sulfonato, sulfamino, sulfanyl, amino, amido, amidoaryl, nitro, azo, azoaryl, imino, carboxy, cyano, formyl, hydroxy, halocarbonyl, carbamoyl, carbamidoyl, phenyl, aryl, phosphonato, phosphonyl, $C_{1-18}$-alkyl, $C_{2-18}$-alkenyl, $C_{2-18}$-alkynyl, $C_{2-18}$-alkoxy, $C_{1-18}$-oxycarbonyl, $C_{1-18}$-oxoalkyl, $C_{1-18}$-alkyl sulfanyl, $C_{1-18}$-alkyl imino, and amino which is substituted with one, two, or three $C_{1-18}$-alkyl groups.

9. A method as defined in claim 1, wherein said aromatic diamine is selected from the group consisting of 2-methoxy-p-phenylenediamine, N,N-bis-(2-hydroxyethyl-p-phenylenediamine, N-β-methoxyethyl-p-phenylenediamine, 2-methyl-1,3-diamino-benzene, 2,4-diaminotoluene, 2,5-Diaminotoluene, 2,6-diaminopyridine, 1-N-methylsulfonato4-aminobenzene, 1-methoxy-2,4-diamino-benzene, 1-ethoxy-2,3-diamino-benzene, 1-β-hydroxyethyloxy-2,4-diamino-benzene, 1,4-Phenylenediamine, 2-Chloro-1,4-phenylenediamine, 1,3-Phenylenediamine, 2,3-diaminobenzoic acid, 2,4-diaminobenzoic acid, 2,5-diaminobenzoic acid, 3,4-diaminobenzoic acid, 3,5-diaminobenzoic acid, methyl-2,3-diaminobenzoate, ethyl-2,3-diaminobenzoate, isopropyl-2,3-diaminobenzoate, methyl-2,4-diaminobenzoate, ethyl-2,4-diaminobenzoate, isopropyl-2,4-diaminobenzoate, methyl-3,4-diaminobenzoate, ethyl-3,4-diaminobenzoate, isopropyl-3,4-diaminobenzoate, methyl-3,5-diaminobenzoate, ethyl-3,5-diaminobenzoate, isopropyl-3,5-diaminobenzoate, N,N-dimethyl-3,4-diaminobenzoic acid amide, N,N-diethyl-3,4-diaminobenzoic acid amide, N,N-dipropyl-3,4-diaminobenzoic acid amide, N,N-dibutyl-3,4-diaminobenzoic acid amide, N-phenyl-p-phenylenediamine, Disperse Black 9, Solvent Brown 1 (CI 11285), 4,4'-Diaminodiphenylamine sulfate, 4-aminodiphenylamine-2-sulfonic acid, N-(4'-aminophenyl)aminobenzene-4-sulfonic acid, N,N-dimethyl-1,4-phenylenediamine, N,N-diethyl-1,4-phenylenediamine, Disperse Yellow 9, N-phenyl-1,2-phenylenediamine, 1,2-phenylenediamine, 4'-aminoacetanilide, N-phenyl-2-aminobenzene-4-sulfonic acid, and 2,5-diaminobenzenesulfonic acid.

10. A method as defined in claim 1, wherein said naphthol is selected from the group consisting of 4-Chloro-1-naphthol, 4-Bromo-1-naphthol, 4-Methoxy-1-naphthol, 2-Nitroso-1-naphthol, 1-Naphthol-3-sulfonamide, 1-Naphthol-8-sulfonamide, 4,8-Disulfonato-1-naphthol, 3-Sulfonato-6-amino-1-naphthol, 6,8-Disulfonato-2-naphthol, 4,5-Dihydroxynapthalene-2,7-disulfonic acid, 2-Amino-8-naphthol-6-sulfonic acid, 5-Amino-1-naphthol-3-sulfonic acid, 2-Naphthol-3,6-disulfonic acid, 1-Amino-8-naphthol-2,4-disulfonic acid, 1-Naphthol-4-sulfonic acid, N-Benzoyl-2-amino-5-naphthol-7-sulfonic acid, N-Phenyl-2-amino-5-naphthol-7-sulfonic acid, Mordant Black 3 (CI 14640), 4-Amino-5-hydroxy-2,6-naphthalene disulphonic acid, Acid Black 52 (CI 15711), Palantine Chrome Black 6BN (CI 15705), Eriochrome Blue Black R, Mordant Black 11, Acid Black 1 (CI 20470), Acid Red 176 (CI 1657), Acid Red 29 (CI 16570), Acid Red 14 (CI 14720), and 1-Naphthol-3-sulfonic acid.

11. A method as defined in claim 1, wherein said aminonaphthalene is selected from the group consisting of 1-Amino-8-hydroxynaphthalene-4-sulfonic acid, 2-Amino-8-naphthol-6-sulfonic acid, 5-Amino-1-naphthol-3-sulfonic acid, 1-Amino-8-naphthol-2,4-disulfonic acid, 8-Amino-1-naphthalenesulfonic acid, 8-Anilino-1-naphthalenesulfonic acid, 8-Amino-2-naphthalenesulfonic acid, 5-Amino-2-naphthalenesulfonic acid, 4-Amino-5-hydroxy-2,6-naphthalenedisulphonic acid, 2,3-Diaminonaphthalene, 1,5-Diaminonaphthalene, 1,8-Diaminonaphthalene, 6-Amino-2-naphthol, 3-Amino-2-naphthol, 5-Amino-1-naphthol, Acid Black 1 (CI 20470), 4-Amino-1-naphthalenesulfonic acid, 6-(p-Toluidino)-2-naphthalenesulfonic acid, 1,4-Diamino-2-naphthalenesulfonic acid, and 5,8-Diamino-2-naphthalenesulfonic acid.

12. A method as defined in claim 1, wherein the aromatic diamine of (a) (i) is selected from the group consisting of 2-methoxy-p-phenylenediamine, N-β-methoxyethyl-p-phenylenediamine, N,N-bis-(2-hydroxyethyl)-p-phenylenediamine, 1-N-methylsulfonato-4-aminobenzene, 1,4-Phenylenediamine, 2,5-Diaminotoluene, 2-Chloro-1,4-phenylenediamine, N-Phenyl-p-phenylenediamine, Disperse Black 9, N,N-Dimethyl-1,4-phenylenediamine, N,N-Diethyl-1,4-phenylenediamine, 4-aminodiphenylamine-2-sulfonic acid, N-(4'-aminophenyl)aminobenzene-4-sulfonic acid, N-phenyl-2-aminobenzene-4-sulfonic acid, 2,3-diaminobenzoic acid, 2,5-diaminobenzoic acid, 3,4-diaminobenzoic acid, 2,3-diaminobenzenesulfonic acid, 2,4-diaminobenzenesulfonic acid, 2,5-diaminobenzenesulfonic acid, 3,4-diaminobenzenesulfonic acid, and 3,5-diaminobenzenesulfonic acid; and the compound of (a) (ii) is selected from the group consisting of 3-sulfonato-6-amino-1-naphthol, 4,5-Dihydroxynapthalene-2,7-disulfonic acid, 2-Amino-8-naphthol-6-sulfonic acid, 5-Amino-1-naphthol-3-sulfonic acid, 2-Naphthol-3,6-disulfonic acid, 1-Amino-8-naphthol-2,4-disulfonic acid, 1-Naphthol-4-sulfonic acid, N-Benzoyl-2-amino-5-naphthol-7-sulfonic acid, N-Phenyl-2-amino-5-naphthol-7-sulfonic acid, 4-Amino-5-hydroxy-2,6-naphthalene disulphonic acid, 1-Amino-8-hydroxynaphthalene-4-sulfonic acid, 8-amino-1-naphthalenesulfonic acid, 8-anilino-1-naphthalenesulfonic acid, 8-amino-2-naphthalenesulfonic acid, 5-amino-2-naphthalenesulfonic acid, 4,8-disulfonato-1-naphthol, and 6,8-disulfonato-2-naphthol.

13. A method as defined in claim 1, wherein the aromatic diamine of (a) (i) is selected from the group consisting of: 1,4-Phenylenediamine, N-Phenyl-p-phenylenediamine, N,N-Diethyl-1,4-phenylenediamine, 4-aminodiphenylamine-2-sulfonic acid, N-(4'-aminophenyl) aminobenzene-4-sulfonic acid, and 2,5-diaminobenzenesulfonic acid; and the compound of (a) (ii) is selected from the group consisting of: 1-Naphthol-4-sulfonic acid, N-Phenyl-2-amino-5-naphthol-7-sulfonic acid, 8-amino-1-naphthalenesulfonic acid, 8-anilino-1-naphthalenesulfonic acid, 8-amino-2-naphthalenesulfonic acid, and 5-amino-2-naphthalenesulfonic acid.

14. A method as defined in claim 1, wherein the aromatic diamine of (a)(i) is selected from the group consisting of: 2,3-diaminobenzoic acid, 2,4-diaminobenzoic acid, 3,4-diaminobenzoic acid, 3,5-diaminobenzoic acid, 2,5-diaminobenzoic acid, 4-aminophenylamine-2-sulfonic acid, N-(4'-aminophenyl)aminobenzene-4-sulfonic acid, N-phenyl-2-aminobenzene-4-sulfonic acid, 2,3-diaminobenzenesulfonic acid, 2,4-diaminobenzenesulfonic acid, 3,5-diaminobenzenesulfonic acid, and 2,5-diaminobenzenesulfonic acid; and the compound of (a)(ii) is selected from the group consisting of: 1-naphthol, 4-chloro-1-naphthol, 4-bromo-1-naphthol, 4-methoxy-1-naphthol, 2-nitro-1-naphthol, 1-naphthol-3-sulfonamide, and 1-naphthol-8-sulfonamide.

15. A method as defined in claim 1, wherein the enzyme of (b) (ii) is a laccase.

16. A method as defined in claim 1, wherein the enzyme of (b)(i) is a peroxidase or haloperoxidase.

17. A method as defined in claim 1, wherein said material is contacted simultaneously with (a) and (b).

18. A method as defined in claim 1, wherein said material is contacted first with the compounds of (a), simultaneously or sequentially, and subsequently with the oxidation system of (b).

19. A method as defined in claim 1, wherein said material is contacted first with the oxidation system of (b) and subsequently with the mixture of (a).

20. A method as defined in claim 1, wherein said material is contacted first with said aromatic diamine of (a)(i) and subsequently with a compound of (a)(ii) and the oxidation system of (b).

21. A method as defined in claim 1, wherein said material after dyeing exhibits an activation ratio (AR) of at least about 0.25.

22. A method as defined in claim 21, wherein said AR is at least about 1.

23. A method as defined in claim 22, wherein said AR is at least about 2.

24. A dye mixture comprising:

(i) at least one aromatic diamine and (ii) at least one compound selected from the group consisting of a naphthol and an aminonaphthalene, wherein at least one of the compounds of (i) or (ii) is substituted with a functional group selected from the group consisting of a sulfonic acid, a sulfonamide, and a quaternary ammonium salt.

25. A dyeing kit comprising:

(a) at least one aromatic diamine;

(b) at least one compound selected from the group consisting of a naphthol and an aminonaphthalene; and (c) an enzyme selected from the group consisting of a peroxidase and a laccase, wherein at least one of the compounds of (a) or (b) is substituted with a functional group selected from the group consisting of a sulfonic acid, a carboxylic acid, a salt of a sulfonic acid or carboxylic acid, a sulfonamide, and a quaternary ammonium salt.

26. A kit as defined in claim 25, wherein said naphthol is not α(alpha)-naphthol, halogenated 1-naphthol, or an unsubstituted dihydroxynaphthalene.

27. A kit as defined in claim 25, wherein either said aromatic diamine is substituted with a functional group selected from the group consisting of a sulfonic acid, a carboxylic acid, a salt of a sulfonic acid or carboxylic acid, a sulfonamide, and a quaternary ammonium salt or said naphthol is not unsubstituted α(alpha)-naphthol, halogenated 1-napthol, or an unsubstituted dihydroxynaphthalene.

28. A kit as defined in claim 25, wherein said aromatic diamine is selected from the group consisting of: 1,4-Phenylenediamine, N-Phenyl-p-phenylenediamine, N,N-Diethyl-1,4-phenylenediamine, 4-aminodiphenylamine-2-sulfonic acid, N-(4'-aminophenyl)aminobenzene-4-sulfonic acid, and 2,5-diaminobenzenesulfonic acid.

29. A kit as defined in claim 25, wherein said compound of (b) is selected from the group consisting of: 1-Naphthol-4-sulfonic acid, N-Phenyl-2-amino-5-naphthol-7-sulfonic acid, 8-amino-1-naphthalenesulfonic acid, 8-anilino-1-naphthalenesulfonic acid, 8-amino-2-naphthalenesulfonic acid, and 5-amino-2-naphthalenesulfonic acid.

30. A kit as defined in claim 25, wherein said enzyme is a laccase.

* * * * *